US011370627B1

(12) United States Patent
Reikow

(10) Patent No.: US 11,370,627 B1
(45) Date of Patent: Jun. 28, 2022

(54) HOUSE WRAP DISPENSER APPARATUS

(71) Applicant: Bruce Reikow, Gig Harbor, WA (US)

(72) Inventor: Bruce Reikow, Gig Harbor, WA (US)

( * ) Notice: Subject to any disclaimer, the term of this patent is extended or adjusted under 35 U.S.C. 154(b) by 0 days.

(21) Appl. No.: 17/465,544

(22) Filed: Sep. 2, 2021

(51) Int. Cl.

| | |
|---|---|
| ***B65H 16/06*** | (2006.01) |
| ***E04B 1/62*** | (2006.01) |
| ***B65H 75/40*** | (2006.01) |
| ***B65H 16/00*** | (2006.01) |

(52) U.S. Cl.
CPC ..... *B65H 16/06* (2013.01); *B65H 16/005* (2013.01); *B65H 75/40* (2013.01); *E04B 1/625* (2013.01); *B65H 2701/1922* (2013.01)

(58) Field of Classification Search
CPC ..... B65H 16/06; B65H 16/005; B65H 75/40; B65H 2701/1922; B65H 75/425; B65H 75/4468; E04B 1/625; E04D 15/06; E04G 21/16; E04H 9/14; E04H 9/145; B29C 63/024; G09F 15/00; G09F 15/0025; G09F 7/18; G09F 19/226; Y02A 50/00; Y10T 29/53361; Y10T 225/246; Y10T 156/1795
See application file for complete search history.

(56) References Cited

U.S. PATENT DOCUMENTS 2,622,752 A * 12/1952 Herzog ..... B44C 7/06 156/577
3,706,421 A 12/1972 Popham
4,102,513 A 7/1978 Guard
4,531,632 A 7/1985 Weber
4,693,042 A * 9/1987 Villarreal ..... E02D 27/04 52/202
5,149,003 A 9/1992 Tharp
5,152,073 A 10/1992 Sloan
5,667,165 A * 9/1997 Gardner ..... B65H 35/0086 242/588.2
5,685,054 A * 11/1997 Yasnogorodskiy .... B65H 16/00 29/446
5,725,173 A * 3/1998 Yasnogorodskiy .... B65H 16/00 160/24
5,743,484 A * 4/1998 Baskett ..... E04H 9/145 242/596.8
6,637,562 B2 10/2003 Oh
7,984,591 B2 7/2011 Cashin et al.
(Continued)

*Primary Examiner* — William A. Rivera
(74) *Attorney, Agent, or Firm* — Elizabeth Reilly; Patentpending, PLLC

(57) ABSTRACT

A house wrap dispenser apparatus for use by a single user to use with a roll of house wrap in installation of house wrap on an exterior wall(s) of a stable structure. The house wrap dispenser apparatus includes a house wrap dispenser having a lower house wrap bracket operational with an upper house wrap bracket, a bag, removable fasteners, and a driver. In another embodiment, a water-resistive barrier wrap dispenser apparatus includes a water-resistive barrier wrap dispenser, a multiplicity of threaded dowels, removable fasteners, a bag, and a driver. In an embodiment, a house wrap dispenser apparatus kit, includes a house wrap dispenser apparatus carrying case to contain the house wrap dispenser apparatus. In an embodiment, a water-resistive barrier wrap dispenser apparatus kit includes a water-resistive barrier wrap dispenser apparatus carrying case to contain the water-resistive barrier wrap dispenser apparatus.

38 Claims, 25 Drawing Sheets

(56) References Cited

U.S. PATENT DOCUMENTS

| | | | | |
|---|---|---|---|---|
| 8,528,301 | B1 * | 9/2013 | Robbins | E04D 15/06 52/746.1 |
| 2006/0266875 | A1 * | 11/2006 | Chou | A47K 10/3836 242/597.7 |
| 2007/0108338 | A1 * | 5/2007 | Martinez | B65H 16/06 242/596 |
| 2009/0075032 | A1 | 3/2009 | Weston et al. | |
| 2009/0189010 | A1 * | 7/2009 | Scanlon | B29C 63/024 242/566 |
| 2010/0263245 | A1 * | 10/2010 | Bowser | G09F 17/00 40/517 |
| 2011/0233255 | A1 | 9/2011 | Tiamson | |
| 2014/0174667 | A1 * | 6/2014 | Eliason | B44C 7/06 156/577 |
| 2015/0028149 | A1 * | 1/2015 | Szymaszek | B65H 16/005 242/598 |
| 2017/0137254 | A1 * | 5/2017 | Becker | B66F 11/04 |

* cited by examiner

HOUSE WRAP DISPENSER APPARATUS

TECHNICAL FIELD

The disclosure generally relates to a house wrap dispenser apparatus of two independent house wrap brackets to provide support to a roll of house wrap or water-resistive barrier wrap to facilitate a single user's control over the rotation of the roll of the house wrap when installing house wrap on the exterior walls and/or sheathing of a stable structure in order to protect the exterior walls and sheathing from moisture and water.

BACKGROUND OF THE INVENTION

This invention relates to certain new and useful improvements in efficient and economical practice of installing house wrap or water-resistive barrier wrap over the exterior walls of stable structures, for example, residential buildings or commercial builders. More particularly this invention is an apparatus and method to apply house wrap or water-resistive barrier wrap for wrapping the exterior walls and or stable structural components of the residential building or commercial building by a single user. The exterior walls may include sheathing.

The house wrap dispenser seeks to assist and improve current methods for improved installation of house wrap or water-resistive barrier wrap on stable structures and or structural components in residential and commercial buildings and to follow the guidance of the International Residential Code 2015 and the Washington State Building Code Chapter 51-51 WAC, in order to protect the stable structures and or structural components from liquid penetration. These types of house wrap installations are common in single family dwellings, multi-family apartment type buildings, commercial buildings, office buildings and where more than one exterior wall is installed in one building. Building construction, both residential and commercial involves the application of house wrap or water-resistive barrier wrap over the exterior walls or to cover the sheathing. The sheathing is usually applied on the exterior surface of an exterior wall. Such house wraps and/or water-resistive barrier wraps for residential buildings and commercial buildings can include, by way of example, Grade D building paper, asphalt-saturated kraft paper, building felt, polymeric house wrap. Known polymeric house wraps for use as weather-resistive barriers or house wraps include, spunbond polyethelene sheet available under the trade name DuPont TYVEK® HOMEWRAP® and TYVEK® STUCCOWRAP® from E.I. du Pont de Nemours & Co., Wilmington, Del.; BARRICADE® from Barricade Building Products, Doswell, Va.; polyolefin nonwoven sheet available under the trade name STYROFOAM™ WEATHERMATE™ PLUS from the Dow Chemical Company, Midland, Mich.; spunbonded polypropylene-microporous film laminate available under the trade woven polypropylene sheet with a perforated coating available under the trade name Pinkwrap® from Owens Corning, Corning, N.Y. The space between the two layers provides a drainage space for any liquid water that penetrates the outer layer, and Everbuilt a Home Depot Product Authority.

Currently, the installation of house wrap or the water-resistive barrier wrap to the sheathing or directly to the exterior wall is performed by two installers where a first user holds the house wrap or water-resistive barrier wrap manually rolling the house wrap or the water-resistive barrier wrap along the exterior wall to which the sheathing is applied, and a second user nailing or stapling the house wrap or the water-resistive barrier wrap to the sheathing of the exterior wall. This, generally, involves one person on a ladder or scaffolding, and one person walking along the ground, as both manually manipulate the roll of house wrap or water-resistive barrier wrap. In windy conditions the house wrap may unravel, which then takes time to replace on the roll of reverse rolling. In addition, it is costly to hire two users or installers to install house wrap on the sheathing of the exterior walls of the residential building or the commercial building.

Building infrastructure has become an important subject of efficient moisture control methods. The stoppage or minimization of outdoor atmospheric moisture and environmental water coming into the exterior walls of the building is a very important issue, as this negatively affects the controlled aridity of the building and will allow the moisture of the building present a breeding ground for mildew and mold.

There are, also, many associated performance installation challenges when house wall installation is required by the International Residential Code (Section R703.11 Water Resistance) (hereinafter, the "IRC"). For example, the IRC requires that the exterior wall envelope shall be designed and constructed in a manner that prevents the accumulation of water within the wall assembly by providing a house wrap or a water-resistive barrier behind the exterior veneer and a means of draining to the exterior water that enters the assembly (Section R703.2 Water Resistant Barrier). Pursuant to Section R703.2 Water Resistant Barrier, one layer of a Mo.15 asphalt felt, free from holes and breaks, complying with ASTM D226 for Type 1 felt or other approved water-resistive barrier shall be applied over studs or sheathing of all exterior walls. Such felt of material shall be applied horizontally, with the upper layer lapped over the lower layer not less than 2 inches (51 mm). Where joints occur, felt shall be lapped not less than 6 inches (152 mm). Fasteners to affix the felt to the sheathing should be inserted no closer than 6.0 inches and no farther than 18.0 inches on vertical stud lines. The felt or other approved material shall be continuous to the top of walls and terminated at penetration and building appendages in a manner to meet the requirements of the exterior wall envelope, pursuant to Section R703.1. In addition, the felt must extend over the sill plate interface by at least 1.0 inch or 2.0 inches or greater is recommended, and to extend to bottom of sill plate for slab on grade foundations, or be properly integrated with water drainage components such as kick out flashing or weep screed (for stucco wall exteriors).

Therefore, there is a need for a house wrap dispenser apparatus and/or for a water-resistive barrier wrap dispenser apparatus for use by a single user or installer, rather than two users or installers, for the installation of house wrap or water-resistive barrier wrap to the exterior walls of the stable structures, residential building or the commercial building with or without sheathing that can accommodate and secure the roll of house wrap or the water-resistive barrier wrap and enable the house wrap or the water-resistive barrier wrap to unrolled from the house wrap dispenser and/or water-resistive barrier wrap dispenser in a horizontal direction as the user is nailing or stapling the house wrap and/or water-resistive barrier wrap to the exterior wall of the stable structure, residential building or commercial building. Further, there is a need for a house wrap dispenser and/or water-resistive barrier wrap dispenser that can accommodate a variety of sizes lengths and widths of house wrap or water-resistive barrier wrap. The house wrap dispenser and/or the water-resistive barrier wrap dispenser allows the single user to removably attach, detach, and reattach the house wrap dispenser and/or the water-resistive barrier wrap dispenser to various locations along the lower and upper exterior wall areas of the stable structure, residential building or the commercial building, throughout the process of nailing and stapling the house wrap or water-resistive wrap onto the exterior walls and wherewith the user can replace a depleted roll of house wrap with a fresh roll of house wrap or water-resistive, as needed, until completion of installing the house wrap and/or water-resistive barrier wrap. The house wrap dispenser and/or the water-resistive barrier wrap dispenser allows for the single user to unroll the house wrap and/or the water-resistive barrier wrap to stream in a horizontal direction while installing the house wrap or water-resistive barrier wrap, as recommended by the International Residential Code 2015 and the Washington State Building Code Chapter 51-51 WAC, from the roll or house wrap and/or water-resistive barrier wrap in an even and in a more controlled continuous manner. The house wrap and/or the water-resistive barrier wrap can be installed by the single user in a time efficient and highly cost saving operation where it is economically efficient to employ a single user or installer rather than two or more users or installers to install the house wrap and/or the water-resistive barrier wrap.

As noted, one of the problems which exist in conventional installation techniques of house wrap and/or water-resistive barrier wrap is the tendency of the roll of house wrap or the water-resistive barrier wrap to unroll from the roll of house wrap and/or the water-resistive barrier wrap in an uncontrollable quantity and a haphazard manner when pulled by the user. In addition, there is no facility or mechanism for easy installation of the roll of house wrap and/or water-resistive barrier wrap upon a house wrap dispenser. Similarly, there is no facility or mechanism to removably attach, detach, and reattach the house wrap dispenser and/or the water-resistive barrier wrap dispenser on one location on the exterior surface of the exterior wall of the stable structure, house or commercial building, by a single user, followed by detaching the house wrap dispenser from the exterior surface of the exterior wall, and subsequently, relocating the house wrap dispenser to another location on the exterior surface of the exterior wall of the stable structure, house, or commercial building, to complete the installation of the house wrap on all required exterior surfaces of the exterior wall.

The embodiments disclosed, herein, provide a solution to the problems, mentioned above. In addition, the embodiments, represent an improvement in the installing and uninstalling of the roll of house wrap and/or the water-resistive barrier wrap on the house wrap dispenser and/or the water-resistive barrier wrap dispenser, by providing the two independent brackets to conjointly provide support for the roll of house wrap and/or the water-resistive barrier wrap, the controlled unrolling of selected lengths and widths of the house wrap, and/or water-resistive barrier wrap, and facilitate the installation of the house wrap upon the exterior surfaces of the exterior walls of the stable structure, a house, or commercial building, by a single user.

SUMMARY

Disclosed herein, is a house wrap dispenser for use by a single user, adapted to use with a roll of a house wrap of one or more rolls of the house wrap used to install on an exterior wall of one or more exterior walls of a stable structure, the exterior wall having a longitudinal axis, the roll of the house wrap having a given length, and a hollow cylindrical core limited by a top open end, a bottom open end, and a cylindrical core diameter. The house wrap dispenser apparatus comprised of a house wrap dispenser; a bag to contain at least two removable fasteners; a driver operably configured to actuate one or more of the at least two removable fasteners. The house wrap dispenser comprised of a set of two independent house wrap brackets including a lower house wrap bracket operatively associated with an upper house wrap bracket, the lower house wrap bracket including a lower wall plate, a lower base plate, and a lower non-rotative dowel, the upper house wrap bracket including an upper wall plate, an upper base plate, and an upper non-rotative dowel, a lower house wrap bracket and an upper house wrap bracket wherein each the lower house bracket and the upper house wrap bracket are adapted for removably attaching, detaching, and reattaching on a multiple number of locations on an exterior wall(s) of a stable structure, residential building or a commercial building wherein each of the lower house bracket and the upper house bracket are configured to receive and support a roll of house wrap whereby a single user or installer can affix the house wrap to the exterior walls of the residential buildings or the commercial buildings.

Further disclosed herein is a house wrap dispenser apparatus kit comprised of a house wrap dispenser; a bag; at least two removable fasteners; a driver; a house wrap dispenser apparatus instruction sheet; and a house wrap dispenser apparatus carrying case for transporting and storing the house wrap dispenser apparatus.

Further, disclosed herein is a disclosed a water-resistive barrier wrap dispenser apparatus comprised of a water-resistive barrier wrap dispenser apparatus adapted to use with a selected roll of a water-resistive barrier wrap of one or more rolls of the water-resistive barrier wrap used to install on an exterior wall of one or more exterior walls of a residential building or a commercial building, the exterior wall having a longitudinal axis, the roll of the water-resistive barrier wrap having a given length, and a hollow cylindrical core limited by a top open end, a bottom open end, and a cylindrical core diameter. The water-resistive barrier wrap dispenser apparatus is comprised of a water-resistive barrier wrap dispenser comprised of a set of two independent barrier wrap brackets including a lower barrier wrap bracket operatively associated with an upper barrier wrap bracket, the lower barrier wrap bracket including a lower wall plate having a first elongated rectangular plane conjoined at a right angle to a lower base plate having a first horizontal plane such that the lower barrier wrap bracket is configured in a L-shape, the lower base plate including a first threaded annular anchor hole sculpted therethrough a central portion of a top surface of the lower base plate, and the upper barrier wrap bracket including an upper wall plate having a second elongated rectangular plane conjoined to an upper base plate having a second horizontal plane such that the upper barrier wrap bracket is configured in an inverted L-shape, the upper base plate including a second threaded annular anchor hole sculpted therethrough a central portion of a bottom surface of the upper base plate; a multiplicity of threaded dowels including a first set of lower threaded dowels and a second set of upper threaded dowels wherein each of the lower threaded dowels and the upper threaded dowels includes an outer diameter which is less than the cylindrical core diameter of the selected roll of water-resistive barrier wrap of the one or more rolls of the water-resistive barrier wrap.

Further disclosed, herein, a water-resistive barrier wrap dispenser apparatus kit, comprising: a water-resistive barrier wrap dispenser; a bag; at least two removable fasteners; a driver; a water-resistive barrier wrap dispenser apparatus instruction sheet; and a water-resistive barrier wrap dispenser apparatus carrying case for transporting and storing the house wrap dispenser apparatus.

One of the primary objects of the invention is to provide a wall mounted house wrap dispenser apparatus to be operated by a single user or installer without the need of a second user or installer. Another objective is that the house wrap dispenser apparatus will provide a time efficient and highly cost efficient solution in the installation of house wrap whereby the single user, rather than two users or more, can unroll the house wrap and install the house wrap in a more continuous manner, and economically efficient manner where it is economically efficient to employ a single user or installer to install the house wrap.

Another object of the invention is to provide a house wrap dispenser that strongly supports a roll of house wrap maintained in an upright position aligned with the longitudinal axis of the exterior walls of the residential building or the commercial building whereby a single user can unroll the house wrap in a horizontal direction as recommended by the International Residential Code 2015 and the Washington State Building Code Chapter 51-51 WAC, whereby a lower layer of affixed house wrap or water-resistive barrier wrap can be overlayed by an upper layer of house wrap or water-resistive barrier wrap by 6.0 inches. Further, the house wrap dispenser allows for the controlled rotation of the house wrap preventing the house wrap from unrolling in a haphazard manner.

The present invention responds to these objectives as evidenced in the disclosure of the embodiments and the Claims submitted herewith. All of the foregoing principals, operations, and advantages of the present invention will be more fully appreciated upon consideration of the following detailed description, with reference to the appended drawings.

BRIEF DESCRIPTION OF THE DRAWINGS

The embodiments of the disclosure set forth in the drawing are illustrative and exemplary in nature and not intended to limit the subject matter defined by the claims. The following detailed description of the illustrative embodiments can be understood when read in conjunction with the following drawings, where like structure is indicated with the like reference numeral.

FIG. 1013 is a perspective view towards a rear face of the bag of FIG. 10A.

DETAILED DESCRIPTION

Figure 1:
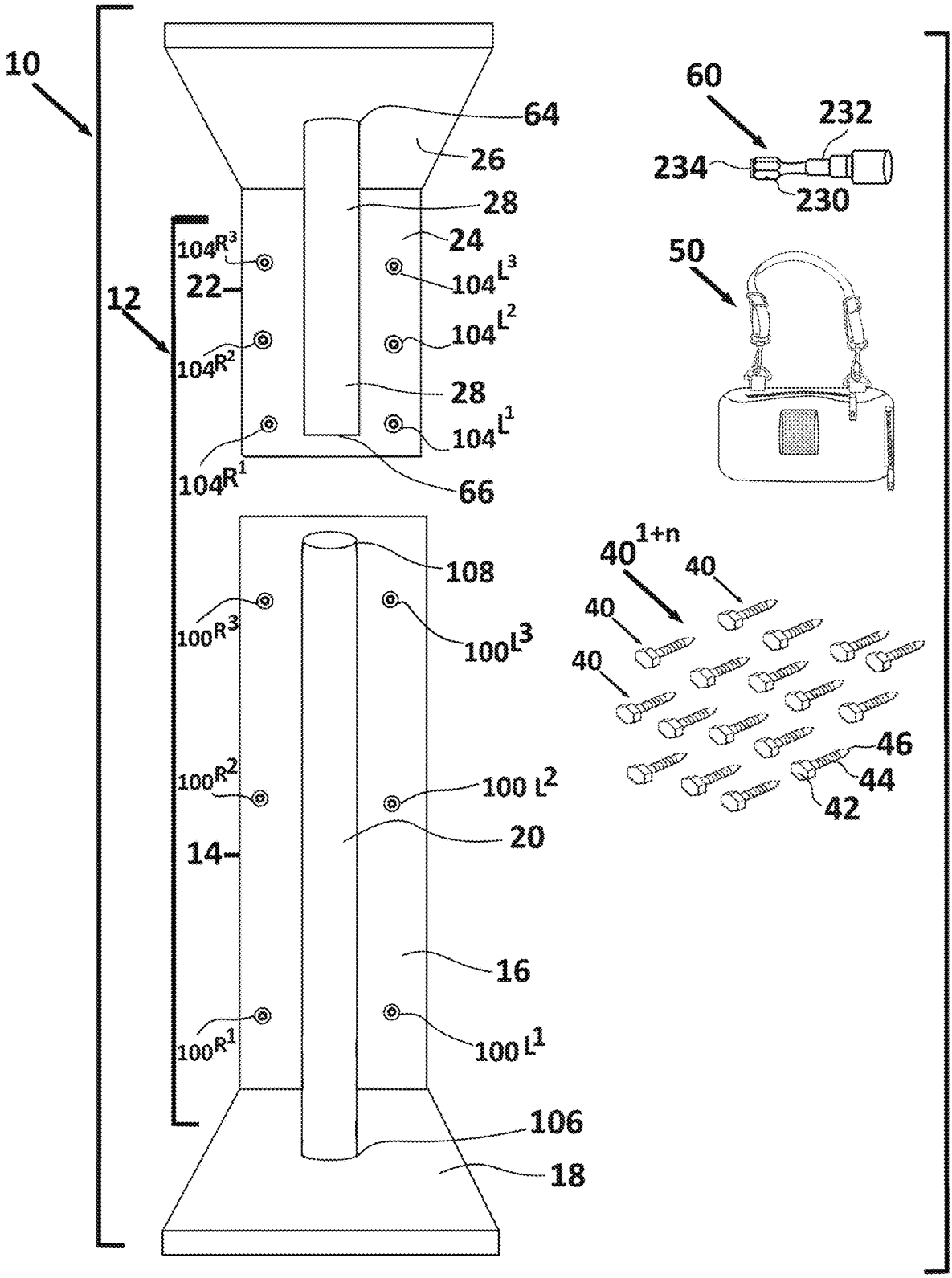
FIG. 1 is a perspective view of an embodiment of a house wrap dispenser apparatus.

Hereinafter, embodiments of the disclosure and for implementing the embodiments is described with reference to the drawings, FIGS. 1-21 illustrating a house wrap dispenser apparatus as illustrated in FIGS. 1-5B, designated as reference numeral 10; a water-resistive barrier wrap dispenser apparatus, as illustrated in FIGS. 12-16B, designated as reference numeral 400; a house wrap dispenser apparatus kit, as illustrated in FIGS. 6-11, designated as reference numeral 200; and a water-resistive barrier wrap dispenser apparatus kit, as illustrated in FIGS. 17A-21, designated as reference numeral 500.

FIGS. 1-5B illustrates an embodiment of the present disclosure including the house wrap dispenser apparatus 10 for use by a single user, adapted to use with a roll of a house wrap 70 of one or more rolls of the house wrap 70 used to install on an exterior wall 78 of one or more exterior walls of a stable structure 76, residential building, or commercial building, the exterior wall 78 having a longitudinal axis (which is an invisible line indicated at numeral 84), the roll of the house wrap 70 having a given length, and a hollow cylindrical core 70' limited by a top open end 72, a bottom open end 74, and a cylindrical core diameter.

A given length refers to the length of the roll of house wrap 70 or a selected roll of house wrap 70 or as a given length of water-resistive barrier wrap 140 with reference to FIGS. 12-15, disclosed in detail in an embodiment below, where the user can purchase the roll of house wrap 70 or water-resistive barrier wrap 140 in a given length or the user can take a commercially available roll of house wrap 70 or water-resistive barrier wrap 140 and cut the roll of house wrap 70 or the water-resistive barrier wrap to a given length that is required for a specific roll of house wrap 70 or water-resistive barrier wrap 140 for the installation on the particular stable structure 76, residential building, or commercial building that the user is installing the house wrap. For example, TYVEC® provides rolls of house wrap 70 or rolls of water-resistive barrier wrap 140 having a variety of given lengths including 3 feet, 5 feet, 9 feet, 10 feet. Here, the user can select any one of the given lengths of the rolls house wrap 70 or the water-resistive barrier wrap 140 and customize the rolls of house wrap 70 or water-resistive barrier wrap to a given length as needed for the particular exterior wall 78 of the stable structure 76, residential building, or commercial building. Thus, such embodiments of the present invention includes a plurality of given lengths of rolls of house wrap 70 and/or rolls of water-resistive barrier wrap 140.

As depicted in FIG. 1, the house wrap dispenser apparatus 10 comprises a house wrap dispenser 12 including a set of two independent house wrap brackets, 14 and 22, including a lower house wrap bracket 14 operatively associated with an upper house wrap bracket 22, at least two removable fasteners $\mathbf{40}^{1+n}$, wherein each removable fastener of the at least two removable fasteners $\mathbf{40}^{1+n}$ is designated with the numeral 40, a bag 50 to contain the at least two removable fasteners $\mathbf{40}^{1+n}$, and a driver 60 to implement the at least two removable fasteners $\mathbf{40}^{1+n}$ when the single user assembles the house wrap dispenser 12 for use and removably attaches, detaches, and reattaches, the house wrap dispenser 12 to the exterior wall 78 of the stable structure 76, residential building, or commercial building.

Further, as depicted in FIG. 1, the lower house wrap bracket 14 includes a lower wall plate 16, a lower base plate 18, and a lower non-rotative dowel 20. Similarly, the upper house wrap bracket 22 includes an upper wall plate 24, an upper base plate 26, and an upper non-rotative dowel 28. In use, as illustrated in FIGS. 3-5B, the lower house wrap bracket 14 is removably attached to a first exterior wall area 80 of the exterior wall 78 of the stable structure 76, the residential building, or the commercial building, the roll of house wrap 70 is installed onto the lower non-rotative dowel 20, by the single user, wherein the distal end 108 of the lower non-rotative dowel 20 is inserted into the bottom open end 74 of the roll of house wrap 70, and, subsequently, the upper house wrap bracket 22 is removable attached to a second exterior wall area 82 of the exterior wall 78 of the stable structure 76, wherein the distal end 66 of the upper-non-rotative dowel being inserted into the top open end 72 of the hollow cylindrical core 70' of the roll of house wrap 70. As illustrated in FIGS. 1-2B, and 3-5B, and more particularly as illustrated in FIG. 3, the upper house wrap bracket 22 and the lower house wrap bracket 14 being removably attached to the stable structure 76, the residential building, or the commercial building, such that the lower non-rotative dowel 20 of the lower house wrap bracket 14 is oriented facing the upper non-rotative dowel 28 of the upper house wrap bracket 22 whereby a lower wall plate 16 medial axis 30 is aligned with an upper wall plate 24 medial axis 32 of the upper wall plate 24.

As shown in FIGS. 3-5B, the upper house wrap bracket 22 is spaced above from the lower house wrap bracket 14 a distance greater than the given length of the roll of the house wrap 70 whereby the bottom open end 74 of the roll of house wrap 70 can be readily received by the lower non-rotative dowel 20 and the top open end 72 of the roll of house wrap 70 can be readily received by the upper non-rotative dowel 28 such that the lower non-rotative dowel 20 and the upper non-rotative dowel 28 conjointly support the roll of house wrap 70 in an upright orientation for rotation of the roll of the house wrap 70 relative to the lower non-rotative dowel 20 and the upper non-rotative dowel 28 whereby the roll of house wrap 70 can unroll in a horizontal direction relative to the exterior wall 78 of the stable structure 76, residential building, or commercial building.

Figure 5A:
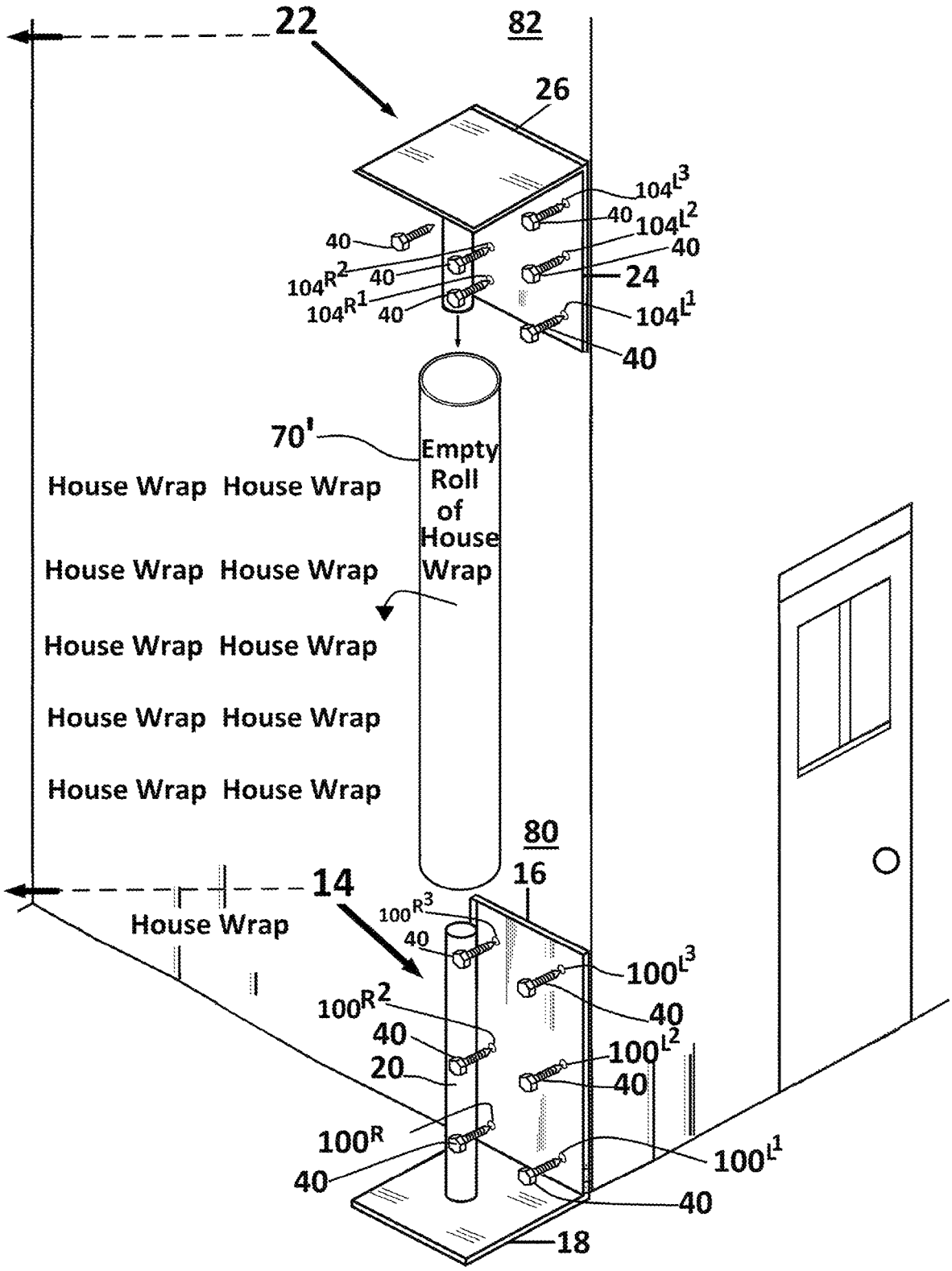
FIG. 5A is a perspective view of the house wrap dispenser of FIG. 1 showing the house wrap dispenser, in use, removably detached from a first exterior wall area showing a depleted first roll of house wrap.
Figure 5B:
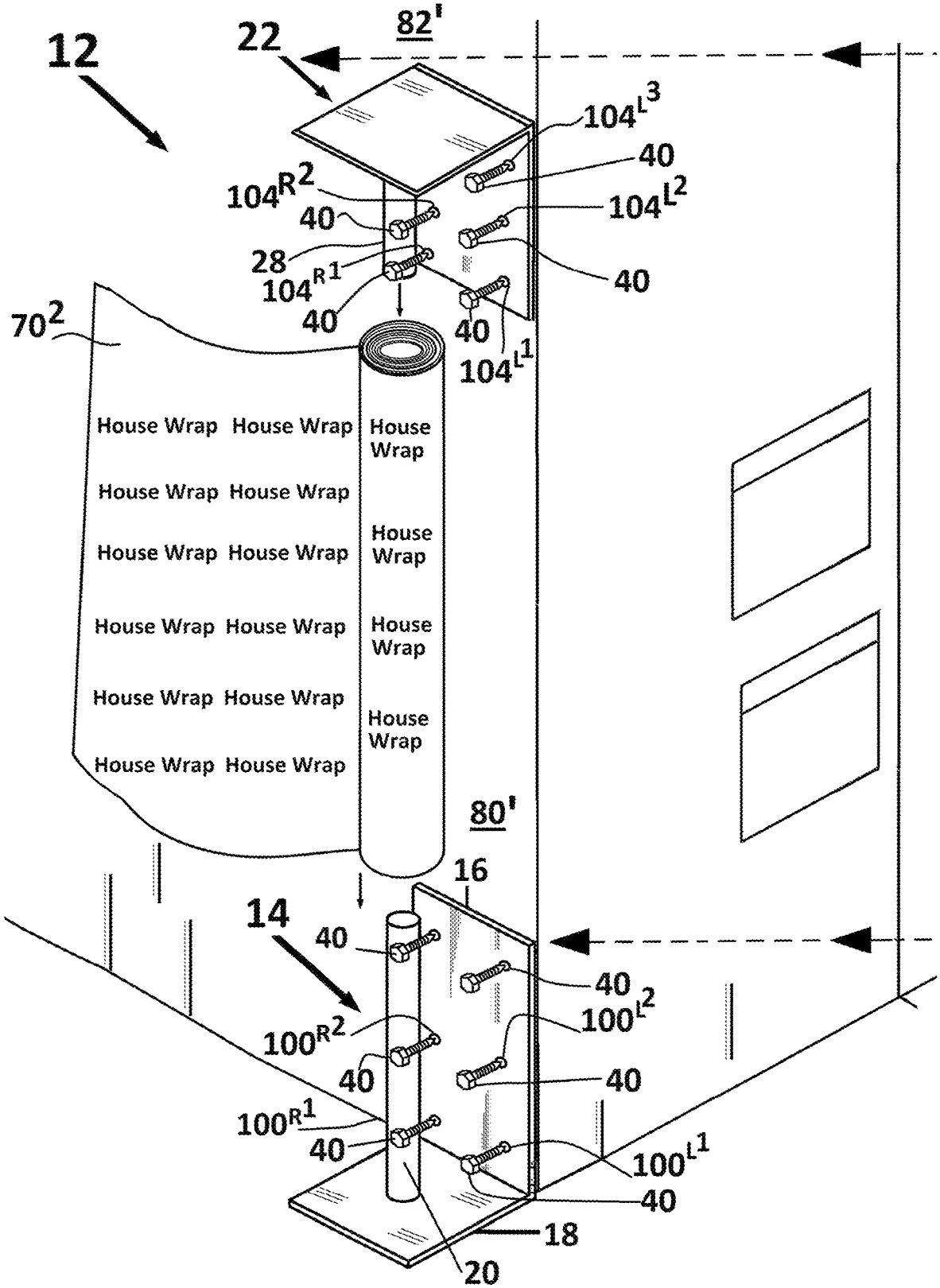
FIG. 5B is a perspective view of the house wrap dispenser continued from FIG. 5A, in use, being removably reattached on a second exterior wall area showing a second roll of house wrap.

Further, as illustrated in FIGS. 5A-5B, the house wrap dispenser 12, can be attached, detached, and reattached from exterior wall areas 80 and 82 or other locations, as needed, on the exterior wall 78 of the stable structure 76 and relocated to another exterior wall area 80' and 82' while the user installs the house wrap on the exterior wall 78 of the stable structure 76. Specifically, the lower house wrap bracket 14 is removably attached at the first exterior wall area 80, and the upper house wrap bracket 22 is removably attached to the second exterior wall area 82 plum with the lower wall bracket 14. Further, upon completion of the installation of the house wrap onto a first lower area of the exterior wall(s) 78 and the depletion of the roll of house wrap 70, the single user can detach the lower house wrap bracket 14 and detach the upper house wrap bracket 22 and relocate the lower house wrap bracket 14 and the upper house wrap bracket 22 to the next location on the exterior wall 78, and continue with the process of nailing and stapling the house wrap on the to the next location of the exterior wall 78. The single user, can removably reattach the lower house wrap bracket 14 to a third exterior wall area 80', replace the remaining hollow cylindrical core 72 with a second roll of house wrap $\mathbf{70}^2$ and mount the second roll of house wrap $\mathbf{70}^2$ onto the lower non-rotative dowel 20 of the lower house wrap bracket 14, as depicted in FIGS. 5A-5B, by inserting the distal end 108 of the lower house wrap dowel 20 into the bottom open end 74 of the second roll of the house wrap $70^2$. Subsequently, the single user can removably reattach the upper house wrap bracket 22 to a fourth exterior wall area 82' wherein the upper non-rotative dowel 28 of the upper house wrap bracket 22 is inserted, by the single user, into the top open end 72 of the hollow cylindrical core 70' of the roll of house wrap 70 such that the lower non-rotative dowel 20 of lower house wrap bracket 14 and the upper non-rotative dowel 28 of the upper house wrap bracket 22 are coaxial whereby the lower non-rotative dowel 20 and the upper non-rotative dowel 28 conjointly support the second roll of house wrap 70' such that the house wrap can be pulled from the second roll of house wrap 70' in a horizontal direction. The process of the installation of the house wrap on the exterior wall(s) 78 of the stable structure 76, is repeated until the exterior walls 78 of the stable structure 76 are completely covered by the house wrap as required.

As illustrated in FIGS. 1-5B, the house wrap dispenser apparatus 10 is a useful solution to the installation of house wrap from the roll of house wrap 70 which can be affixed to exterior walls 78 of stable structures 76, or residential buildings or commercial buildings. In addition, the house wrap dispenser apparatus 10 can be used in the installation of house wrap from the roll of house wrap 70 that can be affixed to sheathing of the exterior walls 78 of the stable structures 76, or residential buildings or the commercial buildings. The stable structures 76, residential buildings and commercials building can include single family dwellings, multi-family apartment type buildings, commercial buildings, office buildings, a garage, a shed, and where more than one exterior walls 78 are installed in one stable structure 76, residential building or commercial building, as these multiple stable structures 76 have similar or substantially the same features, for example, at least four exterior walls. In another embodiment, the stable structure 76 can include a geodesic dome structure, geodesic dome residential building, a geodesic dome commercial building. The term stable structure 76, as recited in the disclosure of the embodiments of the present invention can be interpreted to mean a stable structure 76, residential building or a commercial building, as defined above.

The house wrap dispenser apparatus 10 seeks to assist and improve current methods for improved installation of house wrap from a roll(s) of house wrap 70 on exterior walls 78 of stable structures 76, residential buildings and commercial buildings, and to be compliant with the International Residential Code (2015), and the Washington State Building Code (Chapter 51-51 WAC), and building codes of the particular jurisdiction where the stable structure 76, residential building, or commercial building is located. The exterior wall(s) 78 of the stable structure 76, residential building or the commercial building may include sheathing. In the following embodiments, the plurality of roll(s) of house wrap, including the roll of house wrap 70 and 70', can include commercially available house wraps 70 and water-resistive barrier wraps 140, as shown in FIGS. 14-16B and, therefore, can be substituted for one for the other in the embodiments, as disclosed. Such rolls of house wrap(s) 70 and/or water-resistive barrier wraps 140 for stable structures, residential buildings and commercial buildings can include, by way of example, Grade D building paper, asphalt-saturated kraft paper, building felt, polymeric house wrap. Known polymeric house wraps for use as weather-resistive barriers or house wraps include, spunbond polyethelene sheet available under the trade name DuPont TYVEK® HOMEWRAP® and TYVEK® STUCCOWRAP® from E.I. du Pont de Nemours & Co., Wilmington, Del.; BARRICADE® from Barricade Building Products, Doswell, Va.; polyolefin nonwoven sheet available under the trade name STYROFOAM™ WEATHERMATE™ PLUS from the Dow Chemical Company, Midland, Mich.; spunbonded polypropylene-microporous film laminate available under the trade woven polypropylene sheet with a perforated coating available under the trade name Pinkwrap® from Owens Corning, Corning, N.Y. The space between the two layers provides a drainage space for any liquid water that penetrates the outer layer, and Everbuilt a Home Depot Product Authority.

Referring, again, to FIG. 1, which illustrates a perspective view of the embodiment of the house wrap dispenser apparatus 10 including the house wrap dispenser 12, the bag 50, the at least two removable fasteners $40^{1+n}$, where each removable fastener of the at least two removable fasteners $40^{1+n}$ is depicted by the numeral 40, and the driver 60, the house wrap dispenser 12 includes the set of the two independent house wrap brackets 14 and 22 including the lower house wrap bracket 14 and the upper house wrap bracket 22 to be removably attached onto one or more locations or exterior wall areas of the exterior wall(s) 78 of the stable structure 76, or the residential buildings, or the commercial buildings. FIGS. 3-5B illustrate the house wrap dispenser 12 including the lower house wrap bracket 14 and the upper house wrap bracket 22 can be attached, detached, and reattached to one or more locations or exterior wall areas 80, 80' on the exterior wall(s) 78 of the house.

The house wrap dispenser 12 can be manufactured using a suitable polymer resin, plastic, metal, steel, aluminum, or other rigid material sufficiently strong to support the roll of house wrap 70 on the exterior wall(s) 78 of the stable structure 76, residential building or commercial building.

Figure 2A:
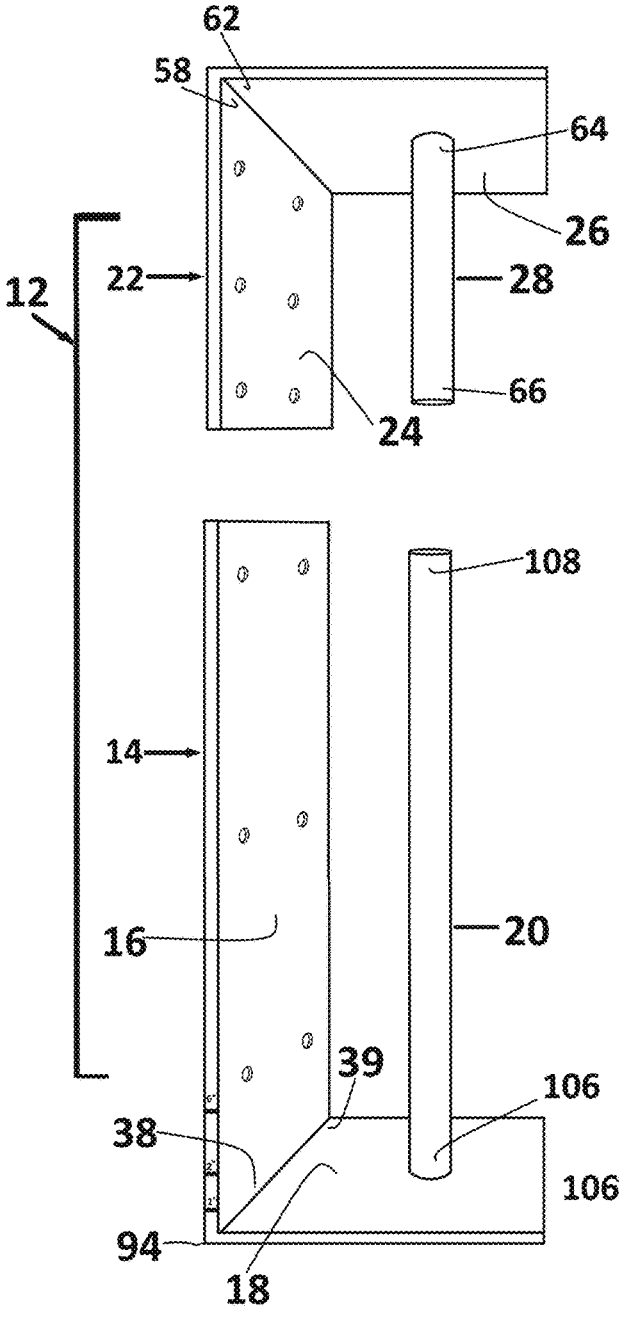
FIG. 2A is a perspective view of a right side of a house wrap dispenser of FIG. 1.
Figure 2B:
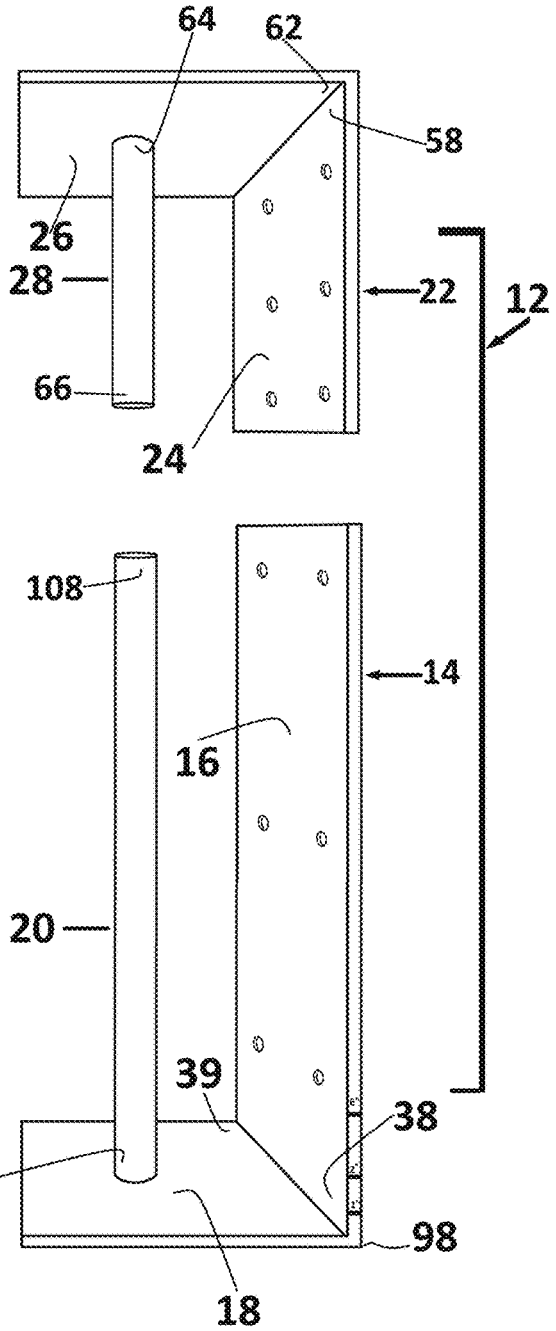
FIG. 2B is a perspective view of a left side of the house wrap dispenser of FIG. 1.
Figure 2D:
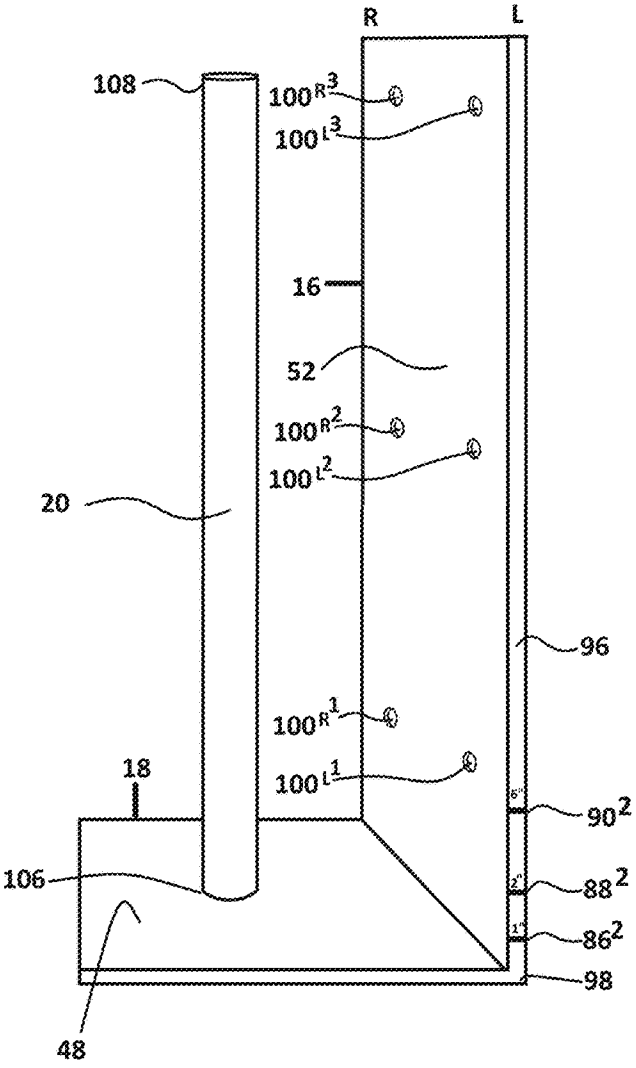
FIG. 2D is a perspective view of the left side of the lower house wrap bracket of the house wrap dispenser of FIG. 2C.

FIG. 2A illustrates a perspective view of a right side of the house wrap dispenser 12 of the house wrap dispenser apparatus 10 including the lower house wrap bracket 14, the upper house wrap bracket 22, and the lower non-rotative dowel 20. FIG. 2B illustrates a perspective view of a left side of the house wrap dispenser 12 of FIG. 2A including the lower house wrap bracket 14, the upper house wrap bracket 22, and the upper non-rotative dowel 28. As depicted in FIGS. 1-2D, the lower house wrap bracket 14 includes the lower wall plate 16 which is configured having a first elongated rectangular plane having a lower wall plate 16 length, a lower wall plate 16 width, and a lower wall plate 16 depth.

Figure 2C:
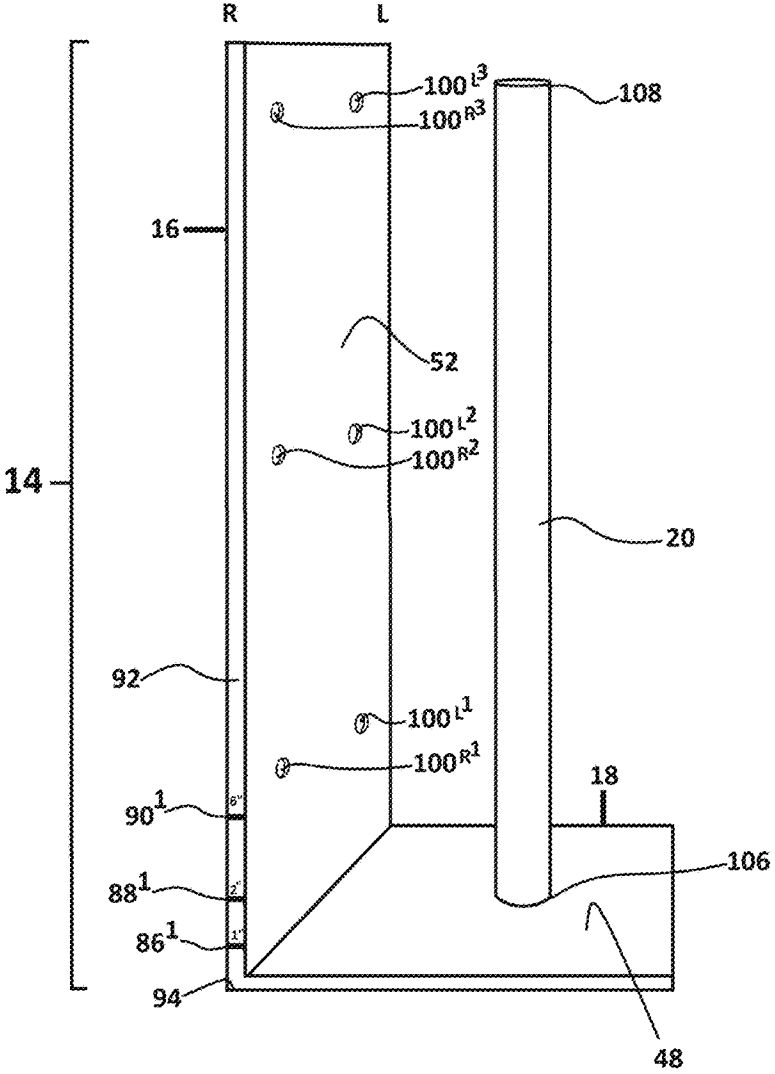
FIG. 2C is a perspective view of the right side of a lower house wrap bracket of the house wrap dispenser of FIG. 2A.
Figure 3:
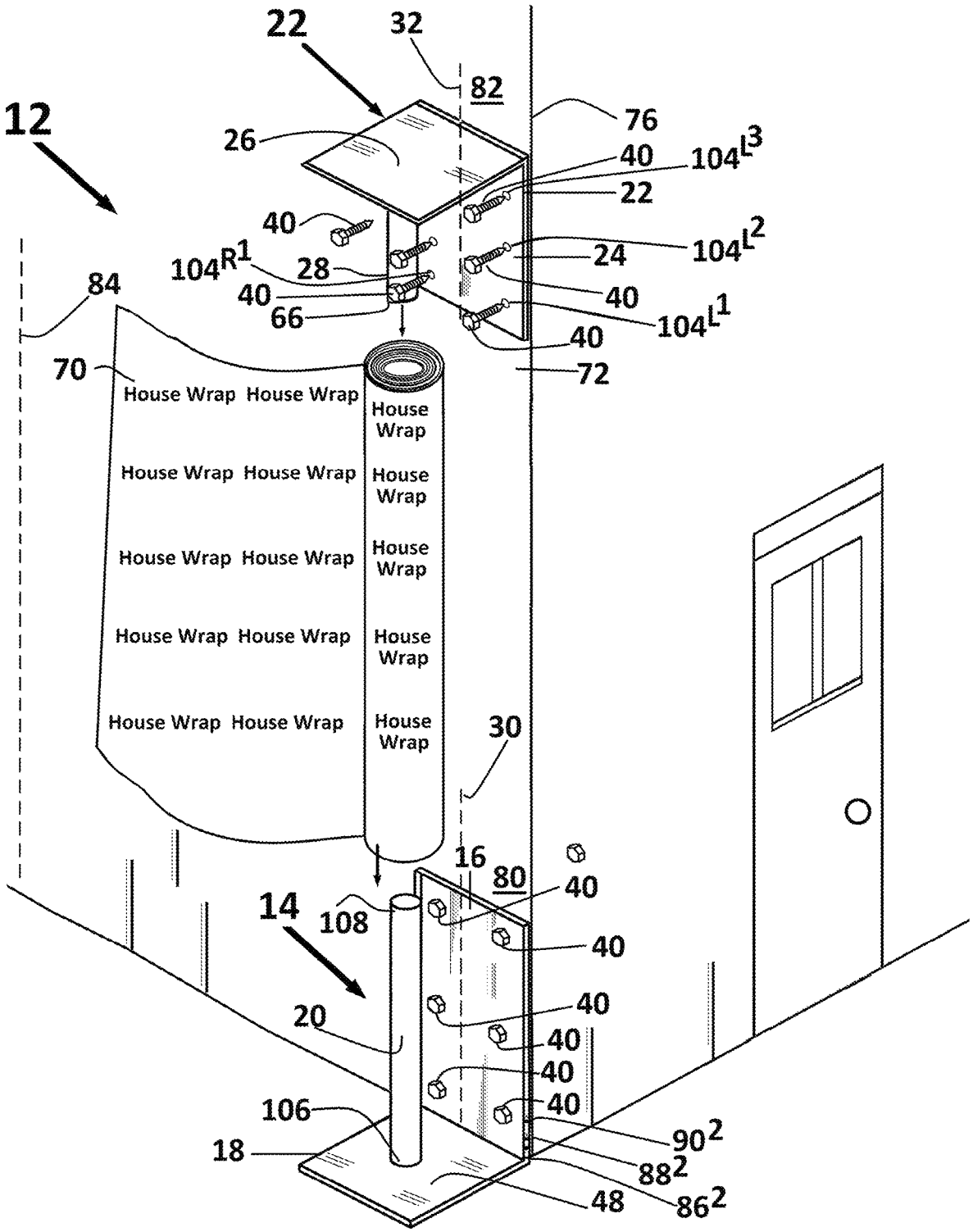
FIG. 3 is a perspective view of the house wrap dispenser of FIG. 1 in use.

As depicted in FIG. 2C, the lower wall plate 16 of the lower house wrap bracket 14 includes a first 1.0 inch measuring notch 86 etched on a first peripheral surface of a right side face 92 of the lower wall plate 16 measured vertically upward from a right inferior edge 94 of the lower wall plate 16, a first 2.0 inch measuring notch 88 etched on a second peripheral surface of the right side face 92 of the lower wall plate 16 measured vertically upward from the right inferior edge 94 of the lower wall plate 16, a first 6.0 inch measuring notch 90 etched on a third peripheral surface of the right side face 92 of the lower wall plate 16 measured vertically upward from the right inferior edge 94 of the lower wall plate 94.

Further, as depicted in FIG. 2D, the lower wall plate 16 includes a second 1.0 inch measuring notch 86' etched on a first peripheral surface of a left side face 96 of the lower wall plate 16 measured vertically upward from a left inferior edge 98 of the lower wall plate 16, a second 2.0 inch measuring notch 88' etched on a second peripheral surface of the left side face 96 of the lower wall plate 16 measured vertically upward from the left inferior edge 98 of the lower wall plate 16, and a second 6.0 inch measuring notch 90' etched on a second peripheral surface of the left side face 96 of the lower wall plate 16 measured vertically upward from the left inferior edge 98 of the lower wall plate 16.

It is critical that the lower wall plate 16 includes one or more measuring notches including, particularly, the first and second 1.0 inch measuring notches 86 and 86', respectively, the first and second 2.0 inch measuring notches 88 and 88', respectively, and the first and second 6.0 inch measuring notches 90 and 90', respectively, etched on the peripheral surfaces of the right side face 92 and the left side face 96 of the lower wall plate 16, as described immediately, above, because, with reference to the International Residential Code (2015), and the Washington State Building Code (Chapter 51-51 WAC), other local jurisdictional building codes, commercial manufacturers of the house wrap or water-resistive barrier wrap, and what is known to a person of ordinary skill in the art, it is recommended that the user align the roll of house wrap 70 at a bottom corner of the exterior wall(s) 78 of the stable structure 76, residential building, or commercial building having the roll of house wrap 70 plumb, and whereby the user must extend the bottom edge of the bottom layer of the house wrap being installed over the sill plate of the exterior wall 78 of the stable structure 76, residential building, or commercial building, by at least 1.0 inch, or 2.0 inches.

In addition, it is critical that the lower wall plate 16 includes a first 6.0 inch measuring notch 90 and a second 6.0 inch measuring notch 90' on each of the right side face 92 and the left side face 96 of the lower wall plate 16, as discussed above, with reference to FIGS. 2A and 2B, because, with reference to International Residential Code (2015), and the Washington State Building Code (Chapter 51-51 WAC), other local jurisdictional building codes, commercial manufacturers of the rolls of house wrap and water-resistive barrier wrap and what is known to a person of ordinary skill in the art, it is recommended that the user install an upper layer of the house wrap which should overlap the bottom layer of house wrap bottom layer by a minimum of 6.0 inches, whereby the consecutive upper layers of house wrap or water-barrier resistive barrier wrap should continue to overlap the its adjacent bottom layer of the house wrap or water-resistive barrier wrap by another 6.0 inches to prevent water and moisture from entering and seeping between the exterior wall, sheathing and the house wrap or the water-resistive barrier wrap.

It is important to note that the user consult the International Residential Code (2015) and to consult the building codes of their specific jurisdiction of the situs of the stable structure 76, residential building, or commercial building to insure compliance with the local building codes.

As particularly depicted in FIGS. 1, 2C-2D and 3-5B, the lower wall plate 16 of the lower house wrap bracket 14, also, includes a first number of lower unthreaded anchor holes $\mathbf{100}^{1+n}$ integrally formed therethrough the front face 52 of the lower wall plate 16 extending therethrough a rear face 102 of the lower wall plate 16, disposed in a first series of one or more lower rows aligned in widthwise rows along the lower wall plate 16 length. As shown in FIGS. 1, 3-5B the lower wall plate 16 includes one or more pairs of a right lower unthreaded anchor hole(s) $\mathbf{100}^{R1-R3}$ and a left lower unthreaded anchor hole(s) $\mathbf{100}^{L1-L3}$ which are disposed symmetrically parallel to each other spaced equidistant from the lower wall plate 16 medial axis 30. Each of the first number of the lower unthreaded anchor holes $\mathbf{100}^{1+n}$, including the right lower unthreaded anchor holes $\mathbf{100}^{R1+R3}$ and the left lower unthreaded anchor holes $\mathbf{100}^{L1-L3}$ includes an inner diameter and a depth, the depth equal to the lower wall plate 16 depth, configured to receive any one of the at least two removable fasteners $\mathbf{40}^{1+n}$, where each individual removable fastener is depicted by the numeral 40, to selectively attach, detach, and reattach the lower wall plate 16 of the lower house wrap bracket 14 to one or more exterior wall areas 80, 80', 82, 82' of the exterior wall 78 of the stable structure 76, residential building, or the commercial building. In this manner, the lower house wrap bracket 14 can be temporarily attached to a first location or exterior wall area of the stable structure 76, residential building, or commercial building, via the lower wall plate 16 and the at least two removable fasteners $\mathbf{40}^{1+n}$, and relocated and removably reattached to a second location or second exterior wall area(s) 80, 80', 82, 82' of the exterior wall(s) 78 of the stable structure 76, residential building, or commercial building, as the user proceeds in completing the process of installing the house wrap on the exterior wall(s) 78 of the stable structure 76, residential building, of commercial building. The first number of lower unthreaded anchor holes $\mathbf{100}^{1+n}$ can be equal to or greater than a second number of upper unthreaded anchor holes $\mathbf{104}^{1+n}$.

Each of the at least two removable fasteners $\mathbf{40}^{1+n}$ is compliant with each of the first number of the lower unthreaded anchor holes $\mathbf{100}^{1+n}$ whereby each of the any one of the at least two removable fasteners $\mathbf{40}^{1+n}$ includes an anchor head 42 having an anchor head 42 diameter greater than the inner diameter of each of the first number of the lower unthreaded anchor holes $\mathbf{100}^{1+n}$ and an anchor body 44 connected to and extending longitudinally from the anchor head 42 to a sharply tapered distal end 46 of the anchor body 44, the anchor body 44 having an anchor body 44 diameter less than each of the inner diameter of each of the first number of the lower unthreaded anchor holes $\mathbf{100}^{1+n}$, and a body length greater than the depth of each of the first number of the lower unthreadable anchor holes $\mathbf{100}^{1+n}$ such that the anchor body 44 is inset into the first exterior wall area 80 a wall distance being operable to uphold the lower house wrap bracket 14 stationary on the exterior wall 78 of the stable structure 76.

Figure 4:
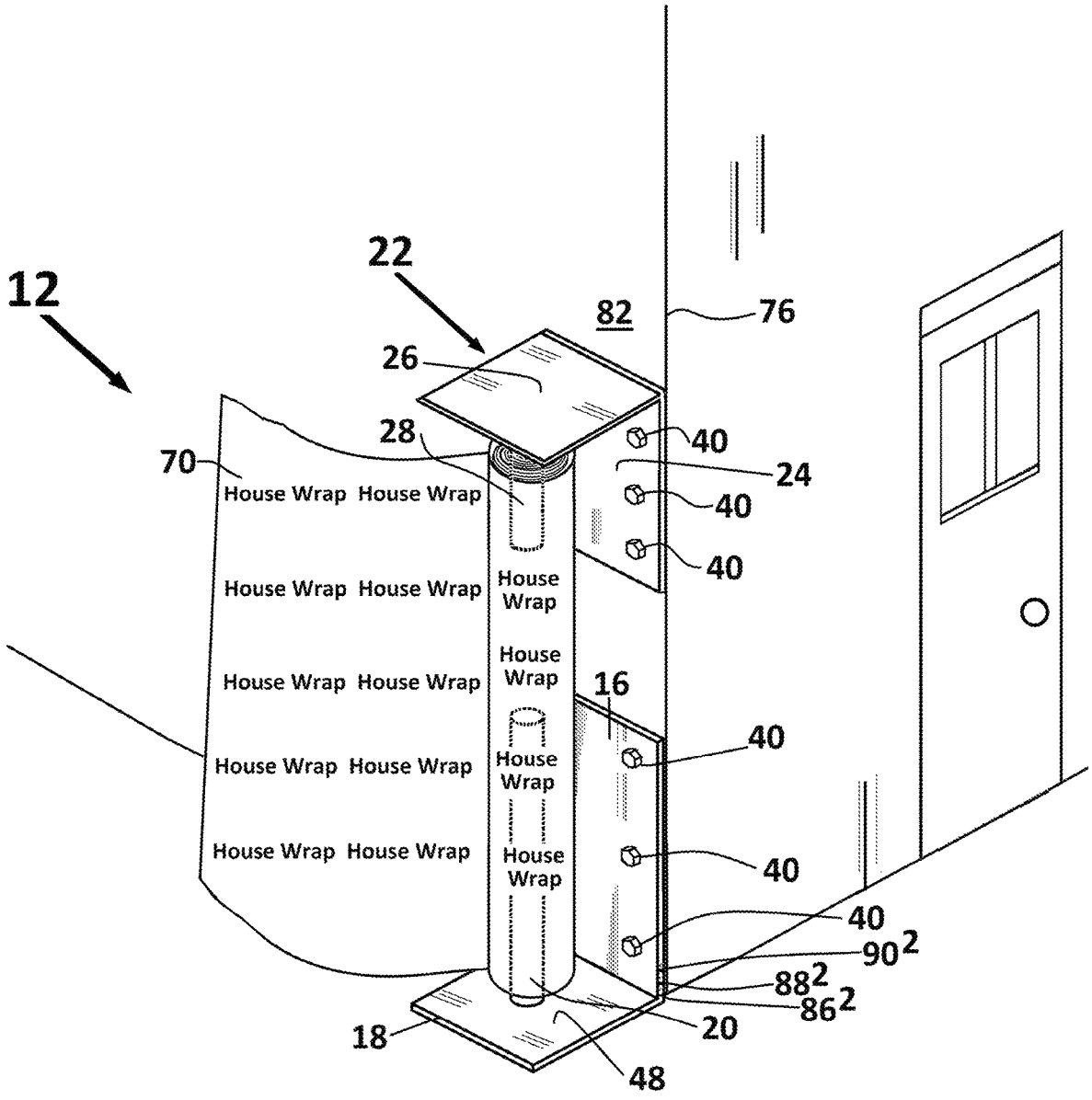
FIG. 4 is a perspective view of the house wrap dispenser of FIG. 1 assembled for use.

FIG. 3 illustrates a perspective view of the house wrap dispenser 12 in use. FIG. 4 is a perspective view of the house wrap dispenser 12 assembled with the roll of house wrap 70 mounted on the lower non-rotative dowel 20 of the lower house wrap bracket 14 being conjointly supported by the upper non-rotative dowel 28 of the upper house wrap bracket 22, further, showing the house wrap can be unrolled from the house wrap dispenser 12 in a horizontal direction. FIGS. 5A-5B are a perspective view of the house wrap dispenser 12 showing the house wrap dispenser 12 in use being removably attached, detached, and reattached to the exterior wall 78 of the stable structure 76 wherein a first roll of house wrap 70 is replaced with a second roll of house wrap $\mathbf{70}^2$.

As illustrated in FIGS. 3-5B, the anchor body 44 of the any one of the at least two removable fasteners $\mathbf{40}^{1+n}$, wherein a single removable fastener of the at least two removable fasteners $\mathbf{40}^{1+n}$ is designated by the numeral 40, is configured to be received through any one of the lower unthreaded anchor holes $\mathbf{100}^{1+n}$ and the upper unthreaded anchor holes $\mathbf{104}^{1+n}$, as described below, wherewith the anchor head 42 is captured by an exterior surface on the front face 52 of the lower wall plate 16 as the anchor body 44 of the removable fastener 40 is screwed into the first location or the first exterior wall area 80 and reattached to the third location or exterior wall area 80', as depicted in FIGS. 5A-5B, of the exterior wall 78 of the stable structure 76, residential building, or commercial building. As shown, each of the number of lower unthreaded anchor holes $\mathbf{100}^{1+n}$, particularly the pairs of lower right anchor holes $\mathbf{100}^{R1-R3}$ and left lower anchor holes $\mathbf{100}^{L1-L3}$ receives any one of the at least two removable fasteners $\mathbf{40}^{1+n}$.

The house wrap dispenser apparatus 10 includes the at least two removable fasteners $\mathbf{40}^{1+n}$, as shown in FIG. 1, that is greater in number than the first number of lower unthreaded anchor holes $\mathbf{100}^{1+n}$ and the second number of upper unthreaded anchor holes $\mathbf{104}^{1+n}$ such that the user or installer has an ample supply of at least two removable fasteners $\mathbf{40}^{1+n}$ where it is foreseeable that any number of the at least two removable fasteners $\mathbf{40}^{1+n}$ may be misplaced or lost in the process of installing the house wrap to the exterior wall(s) 78 of the stable structure 76, the residential building or the commercial building.

As disclosed above, FIGS. 2A and 2C depicts a perspective view of the right side of the house wrap dispenser 12, including a right side perspective view of the lower house wrap bracket 14 and a right side perspective view of the upper house wrap bracket 22. In addition, FIG. 2B depicts a left side perspective view of the house wrap dispenser 12, including a left side perspective of the lower house wrap bracket 14 and the upper house wrap bracket 22. FIG. 2D depicts a perspective view of the left side of the lower house wrap bracket 14. As illustrated in FIGS. 1-5B, particularly with particularity to FIGS. 2A-2B, the lower base plate 18 is cojoined to the lower wall plate 16 at a right angle along a frontal inferior marginal edge 38 of the lower wall plate 16 and a transversal marginal edge 39 of the lower base plate 18. The lower base plate 18 includes a first horizontal plane with a geometric shape to support the lower non-rotative dowel 20 where, as shown in FIGS. 1-2D, the lower non-rotative dowel 20 is orientated in a vertical upward position, whereby, in use, the lower non-rotative dowel 20 can receive a bottom portion of the roll of house wrap 70, as depicted in FIGS. 3-5B. The lower wall plate 16 and the lower base plate 18 can be configured having any geometric shape.

As illustrated in FIG. 2B, the upper base plate 26 of the upper wall bracket 22 is cojoined to the upper wall plate 24 at a right angle along a superior frontal marginal edge 58 of the upper wall plate 24 and a superior transversal marginal edge 62 of the upper base plate 26. The upper base plate 26 includes a second horizontal plane with a geometric shape, more particularly, a rectangular shape, to support the upper non-rotative dowel 28 where, as shown in FIGS. 1, 2A-2B and 3-5B, the upper non-rotative dowel 28 is orientated in a vertical downward position, whereby, in use, the upper non-rotative dowel 28 can receive a top portion of the roll of house wrap 70, as depicted in FIGS. 3-5B. The upper wall plate 24 and the upper base plate 26 can be configured having any geometric shape.

The lower non-rotative dowel 20 includes a lower non-rotative dowel 20 proximal end 106 and a lower non-rotative dowel 20 distal end 108, as illustrated in FIGS. 1 and 2C-3, a lower non-rotative dowel 20 diameter which is less than the cylindrical core diameter of the roll of house wrap 70 of the one or more rolls of house wrap 70, a lower non-rotative dowel 20 length which is less than the given length of the roll of house wrap 70, less than the length of the lower wall plate 16, and greater than an upper non-rotative dowel 28 length. The lower non-rotative dowel 20 is affixed to a central portion of the lower base plate 18 via welding or the lower house wall bracket 14 can be manufactured as a complete seamless single unit including the lower wall plate 16 having the first number of lower unthreaded anchor holes $\mathbf{100}^{1+n}$ dispose therethrough, lower base plate 18, and lower non-rotative dowel 20.

Referring to FIGS. 1, 2A-2B, and 3, the lower non-rotative dowel 20 includes a lower non-rotative dowel 20 length that is greater than the upper non-rotative dowel 28 length wherein when the lower non-rotative dowel 20 is inserted into the bottom open end 74 of a selected roll of house wrap 70 the lower non-rotative dowel 20 supports the majority of the length of the selected roll of house wrap 70. In this manner, the upper non-rotative dowel 28 wherein when the upper non-rotative dowel 28 is inserted into the top open end 72 of the selected roll of house wrap 70 will support a lesser length of the selected roll of house wrap 70 where the upper non-rotative dowel 28 provides additional stability and support to the roll of house wrap 70 conjointly with the lower non-rotative dowel 20 allowing the user to easily unroll the house wrap 70 or horizontally from the house wrap dispenser 12, as depicted in FIGS. 3-5B. And of equal importance, it is an advantage that the upper house wrap bracket 22 can be removably attached a variety of distances from the lower house wrap bracket 14 where with such an embodiment a variety of lengths of rolls of house wrap 70 can be accommodated.

It is critical that the house wrap dispenser 12 unroll the house wrap from the roll of house wrap 70 in a horizontal orientation because the building codes and commercial house wrap manufacturers directions call for the house wrap to be unrolled in a horizontal direction from the roll of house wrap 70 so that a lower layer of house wrap is installed horizontally along the exterior wall 78 of the stable structure 76, residential building, or commercial building whereby an upper layer of house wrap 70 can be installed overlapping the lower layer by a recommended 6.0 inches.

FIG. 3 illustrates a perspective view of the house wrap dispenser 12 of FIG. 1 in use. Further, FIG. 3 shows the lower non-rotative dowel 20 proximal end 106 is integrally affixed to a central portion of a top face 48 of the lower base plate 18 whereby the lower non-rotative dowel 20 is affixed in an upright vertical orientation, wherein a peripheral circumferential surface of the lower non-rotative dowel 20 is spaced a predetermined distance from a peripheral flat surface of the front face 52 of the lower wall plate 16, the predetermined distance being at least greater than a radius of the roll of the house wrap 70 such that a roll of selected house wrap 70 can easily be mounted on the lower non-rotative dowel 20 when in use.

FIGS. 1-2A-2B, and FIGS. 3-5B, in particular, illustrate the upper wall plate 24 includes a second upper elongated rectangular plane having an upper wall plate 24 length which is less than the lower wall plate 16 length, an upper wall plate 24 width and an upper wall plate 24 depth, the upper wall plate 24 width and the upper wall plate 24 depth which is equal to the lower wall plate 16 width and lower wall plate 16 depth, respectively. In this manner, the lower wall plate 16 and the upper wall plate 24 being equal in lower wall plate 16 depth and width and upper wall plate 24 length and width allow for symmetrical placement of the lower house wrap bracket 14 and the upper house wrap bracket 22 on the exterior wall 78 and for a uniform distance of each of the rear face 102 of the lower wall plate 16 and a rear face 110 of the upper wall plate 24 from a first exterior wall area 80 and second exterior wall area 82, respectively, for the placement of the lower house wrap bracket 14 and the upper house wrap bracket 22 which prevents against wobbling of the house wrap dispenser 12 in use and a stationary and stable removable attachment of the house wrap bracket 12 to the exterior wall 78.

FIGS. 1 and 3, illustrate the upper wall plate 24 including a second number of upper unthreaded anchor holes $\mathbf{104}^{1+n}$ integrally formed therethrough a front face 112 of the upper wall plate 24 extending therethrough the rear face 110 of the upper wall plate 24 disposed in a second series of one or more upper rows aligned in widthwise rows along the upper wall plate 24 length whereby a pair of one or more pairs of a right upper unthreaded anchor hole $\mathbf{104}^{R1-R3}$ and a left upper unthreaded anchor hole $\mathbf{104}^{L1-L3}$ are disposed symmetrically parallel to each other spaced equidistant from the upper wall plate 24 medial axis (the upper wall medial axis being an invisible line shown as the dotted line with the numeral 32).

Each of the second number of upper unthreaded anchor holes $\mathbf{104}^{1+n}$ including the right upper unthreaded anchor hole $\mathbf{104}^{R1-R3}$ and the left upper unthreaded anchor holes $\mathbf{104}^{L1-L3}$ includes an inner diameter and a depth equal to the inner diameter and the depth of each of the first number of the lower unthreaded anchor holes $\mathbf{100}^{1+n}$ including the right lower unthreaded anchor holes $\mathbf{100}^{L1-L3}$ and the left lower unthreaded anchor holes $\mathbf{100}^{L1-L3}$, configured to receive any one of the at least two removable fasteners $\mathbf{40}^{1+n}$ to selectively attach, detach, and reattach the upper wall plate 24 of the upper house wrap bracket 22 to one or more exterior wall areas 82, 82" of the exterior wall 78 of the stable structure 76, the residential building, or the commercial building.

As illustrated in FIGS. 3-5B, the anchor body 44 of the removable fastener $\mathbf{40}^{1+n}$ is configured to be received through each of the number of upper unthreaded anchor holes $\mathbf{104}^{1+n}$ including the right upper unthreaded anchor holes $\mathbf{104}^{R1-R3}$ and the left upper unthreaded anchor holes $\mathbf{104}^{L1-L3}$, and the anchor head 42 is captured by an exterior surface on the front face 112 of the upper wall plate 24 as the anchor body 44 of each of the at least two removable fasteners $\mathbf{40}^{1+n}$ is screwed into the second location or second exterior wall area 82 of the exterior wall 78 of the stable structure 76, residential building or commercial building. As shown, each of the number of the upper unthreaded anchor holes 104 receives the removable fastener 40 of the at least two removable fasteners $\mathbf{40}^{1+n}$.

Each of the any one of the at least two removable fasteners $\mathbf{40}^{1+n}$ is compliant with each of the second number of upper unthreaded anchor holes $\mathbf{104}^{1+n}$ whereby each of the at least two removable fasteners $\mathbf{40}^{1+n}$ includes the anchor head 42 having the anchor head 42 diameter greater than the inner diameter of each of the upper unthreaded anchor holes 104 and the anchor body 44 connected to and extending longitudinally from the anchor head 42 to a sharply tapered distal end 46 of the anchor body 44, and where the anchor body 44 includes the anchor body 44 diameter less than the inner diameter of each of the right upper unthreaded anchor holes $\mathbf{104}^{R1-R3}$ and the left upper unthreaded anchor holes $\mathbf{104}^{L1-L3}$ and the anchor body 44 length greater than the depth of the right upper unthreadable anchor holes 104' and the left upper unthreaded anchor holes $\mathbf{104}^{L1-L3}$ such that the anchor body 44 is inset into the second exterior wall area 82 the wall distance being operable to uphold the upper house wrap bracket 22 stationary on the exterior wall 78 of the stable structure 76. It is critical that the lower house wrap bracket 14 and the upper house wrap brackets 22 are stationary wherein when each are removably attached to their prospective exterior wall areas 80 and 82 or prospective locations the roll of house wrap 70 cannot sway, wobble or swing between the lower non-rotatable dowel 20 and the upper non-rotatable dowel 28 of the lower house wrap bracket 14 and the upper house wrap bracket 22, respectively, and thus the roll of house wrap 70 can be unrolled from the conjoint supporting lower non-rotatable dowel 20 and the upper non-rotatable dowel 28 in an even wrapping plane as the roll of house wrap 70 is affixed to the exterior wall 78 of the stable structure 76 by the user.

FIGS. 1-2B illustrates the upper base plate 26 of the upper house wrap bracket 22 is conjoined to the upper wall plate 24 at a right angle along a frontal superior marginal edge 58 of the upper wall plate 24 and a transversal marginal edge 62 of the upper base plate 26. The upper base plate 26 includes a horizontal plane in a geometric shape to support the upper non-rotative dowel 28 having the upper non-rotative dowel 28 orientated in a vertically downward direction. The upper base plate 26 and the upper wall plate 24 can be configured in any geometric shape. As illustrated in FIGS. 1-2B, and FIG. 3, the upper non-rotative dowel 28 includes an upper non-rotative dowel 28 proximal end 64, an upper non-rotative dowel 28 distal end 66, an upper non-rotative dowel 28 diameter which is equal to the lower non-rotative dowel 20 diameter that is less than the cylindrical core diameter of the hollow cylindrical core 70' of the roll of the house wrap 70, an upper non-rotative dowel 28 length which is less than the length of the roll of house wrap 70, less than the length of the upper wall plate 24, and less than the length of the lower non-rotative dowel 20 length. The upper non-rotative dowel 28 is affixed to a central portion of the upper base plate 26 via welding, or the upper house wall bracket 22 can be manufactured as a complete seamless single unit including the upper wall plate 24 having the second number of upper unthreaded anchor holes $\mathbf{104}^{1+n}$ disposed therethrough, upper base plate 26, and lower non-rotative dowel 20.

FIGS. 1-2B illustrates the upper non-rotative dowel 28 proximal end 64 is integrally affixed to a central portion of a bottom face 48 of the upper base plate 26 such that the upper non-rotative dowel 28 is affixed in a vertically downward orientation at a second predetermined distance measured from the front face 112 of the upper wall plate 24 to a peripheral circumferential surface of the upper non-rotative dowel 28, the second predetermined distance is equal to the first predetermined distance being at least greater than a radius of the roll of the house wrap 70 whereby the upper non-rotative dowel 28 is aligned coaxial with the lower non-rotative dowel 20.

In addition, in use, as illustrated in FIGS. 3-5B, the upper wall plate 24 of the upper house wrap bracket 22 is positioned at the second location or the second exterior wall area 82 of the exterior wall 78 which is separated vertically a distance from the lower wall plate 16 of the lower house wrap bracket 14 having the upper plate medial axis 32 coaxial with the lower plate medial axis 30, as depicted in FIG. 3, and the upper plate medial axis 32 and the lower plate medial axis 30 parallel with the longitudinal axis 84 of the exterior wall 78 of the stable structure 76, residential building, or commercial building. In use, the single user first removably attaches the lower house wrap bracket 14 to the exterior wall area 80 of the stable structure 76, residential building or commercial building, wherein the lower wall plate 16 is removably attached to the exterior wall area 80 via the at least two removable fasteners $\mathbf{40}^{1+n}$ wherein any one of the at least two removable fasteners $\mathbf{40}^{1+n}$ is inserted into each of the corresponding one of the first number of anchor holes $\mathbf{100}^{1+n}$ to engage with the first location or exterior wall area 80 on the exterior wall 78, and, subsequently, mounts the selected roll of the house wrap 70 onto the lower non-rotative dowel 20 by inserting the distal end 108 of the lower non-rotative dowel 20 into the bottom open end 74 of the selected roll of house wrap 70 such that the selected roll of house wrap 70 is supported by the length of the lower non-rotative dowel 20 from its proximal end 106 to its distal end 108. Subsequently, the distal end 66 of the upper non-rotative dowel 28 is inserted into the top open end 72 of the roll of house wrap 70 such that an upper portion of the roll of house wrap 70 is supported by the length of the upper non-rotative dowel 28.

It is critical that the upper non-rotative dowel 28 and the lower non-rotative dowel 20 diameters are equal and being a diameter that is less than the selected roll of house wrap 70 and that the second predetermined distance is equal to the first predetermined distance from each of the front face 52 of the lower wall plate 16 and the front face 112 of the upper wall plate 24, respectively, being at least greater than a radius of the roll of the house wrap 70 whereby the upper non-rotative dowel 28 is aligned coaxial with the lower non rotative dowel 20 so that the lower non-rotative dowel 20 can readily be inserted through the bottom open end 74 of the selected roll of house wrap 70, and the upper non-rotative dowel 28 can be readily inserted into the top open end 72 of the roll of house wrap 70 whereby the upper non-rotative dowel 28 and the lower non-rotative dowel 20 conjointly support the selected roll of house wrap 70 without any urging of the roll of house wrap 70 onto the lower non-rotative dowel 20 or the upper non-rotative dowel 28. Again, here the house wrap dispenser 12 provides the advantage where the upper house wrap bracket 22 can be removably attached a variety of distances from the lower house wrap bracket 14 to accommodate a variety of lengths of rolls of house wrap 70.

In the embodiment of the present invention, the lower non-rotative dowel 20 diameter, the lower non-rotative dowel 20 length, the upper non-rotative dowel 28 diameter and the upper non-rotative dowel 28 length, can be sized to receive any one of a variety of rolls of house wrap 70 having a variety of cylindrical core diameters and lengths. In addition, the at least two removable fasteners $\mathbf{40}^{1+n}$ can include any one of a group consisting of screws, full bearing screws, washer faced, double chamfered, square screws, knurled head, and lag screws.

As depicted in FIGS. 3-5B, the house wrap dispenser 12 including the lower house wrap bracket 14 is removably attached at the first exterior wall area 80 prior to removably attaching the upper house wrap bracket 22 to the second exterior wall area 82, so that the roll of house wrap 70 can readily be mounted onto the lower non-rotative dowel 20 of the lower house wrap bracket 14, and to accommodate a plurality of given lengths of rolls of house wrap 70, where it is an advantage of the invention that the upper house wrap bracket 22 can be removable attached a distance from the lower house wrap bracket 14 wherein the distance can vary to accommodate a variety of lengths of the roll of house wrap 70. Particularly, FIGS. 5A-5B shows the lower house wrap bracket 14 being removably attached to the first exterior wall area 80 and, subsequently, detached from the first exterior wall area 80 and relocated and reattached to the third exterior wall area 80', and the upper wall bracket 22 being removably attached to a second exterior wall area 82, then, subsequently, detached and relocated to a fourth exterior wall area 82' during the process of the single user stapling or nailing the house wrap to the exterior wall(s) of the stable structure 76. The ability to removably attach the lower house wrap bracket 14 and the upper house wrap bracket 22 facilitates mounting of a first roll of house wrap 70 and replacement of a second roll of house wrap $\mathbf{70}^2$ upon the lower non-rotative dowel 20 when the first roll of house wrap 70 is depleted, and consecutive rolls of house wrap 70 are depleted, during the process of installing the house wrap on the exterior walls of the stable structure 76.

In the embodiment of the present invention, the lower house wrap bracket 14 and the upper house wrap bracket 22 is manufactured from at least one of the materials selected from the group consisting of metal, steel, and aluminum. In another embodiment of the lower house wrap bracket 14 and the upper house wrap bracket 22 is manufactured from at least one of the materials selected from the group consisting of polymer resin, and plastic.

With this embodiment, and the following disclosed embodiments of the present invention, it is critical for the single user that the lower house wrap bracket 14 and the upper house wrap bracket 22 are each removably affixed to the one or more locations or exterior wall areas on the exterior wall(s) 78 of the stable structure 76, residential building or the commercial building because being removably affixed to the exterior wall(s) 78 provides that the lower house wrap bracket 14 and the upper house wrap bracket 22 can be spaced apart from each other any distance that shall accommodate any given length of a selected roll house wrap 70 of the one or more house wraps or water-resistive barrier wrap 140 having a given length that are commercially available from manufacturers, on the exterior wall 78 of the stable structure 76, residential building and the commercial building the user is installing the house wrap thereon. For example, TYVEC® provides rolls of house wrap 70 or rolls of water-resistive barrier wrap 140 having a variety of given lengths including 3 feet, 5 feet, 9 feet, 10 feet.

In addition, it is critical for the single user of the house wrap dispenser apparatus 10 that the lower house wrap bracket 14 and the upper house wrap bracket 22 of the house wrap dispenser 12 are removably affixed but being stationary to the exterior wall(s) 78 of the stable structure 76, residential building, or the commercial building because the exterior wall(s) 78 of the stable structure 76, the residential building, or the commercial building, maintains and supports the weight of the house wrap dispenser 12 and the roll of house wrap 70 or the roll of water-resistive barrier wrap 140 rather than the single user or installer maintaining the weight of the house wrap dispenser 12 mounted with the roll of house wrap 70 or water-resistive barrier wrap 140. The lower house wrap bracket 14 and the upper house wrap bracket 22 operating together provides for the roll of house wrap 70 to be installed on the lower house wrap bracket 14 and the upper house wrap bracket 22 whereby the lower house wrap bracket 14 and the upper house wrap bracket 22 are each stationary being removably attached temporarily to the location(s) on the exterior wall 78 of the stable structure 76, residential building, or commercial building, and thereby the roll of house wrap 70 is supported conjointly by the lower house wrap bracket 14 and the upper house wrap bracket 22 whereby the single user is enabled to unroll the house wrap from the roll of house wrap 70 horizontally in a continuous even stream without the risk of dropping the roll of house wrap 70 during the installation of the house wrap where the roll of house wrap 70 maybe damaged and lose its effectiveness to prevent the migration of moisture, water, or air into the exterior wall surfaces and exterior structures. In current house wrap installation systems or water-resistive barrier wrap systems, the weight of the roll of house wrap 70 is generally supported by the user or installer that is positioned on the ground during installation of the house wrap on the exterior wall(s) 78 of the stable structure 76, residential building or the commercial building. This can be fatiguing to the user and can result in various injuries or misapplication of the roll of house wrap 70. Misapplication of the roll of house wrap 70 reduces the house wrap's effectiveness in preventing moisture and air migrating into the exterior wall(s) 78 and exterior wall structures. The roll of house wrap 70 may be difficult to handle and is, on occasion, dropped and damaged resulting in loss of installation time and, in some cases, the loss of the roll of house wrap 70. In addition, the lower house wrap bracket 14 and the upper house wrap bracket 22 being removably affixed to the one or more locations on the exterior wall(s) 78 of the stable structure 76, residential building or commercial building allows for a single user or installer to wrap the house wrap thereby reducing the cost of employment and risk of injury; the elimination of the need of a second or third person at the bottom end of the roll of house wrap 70 to support the full weight of the roll of house wrap 70 or the water-resistive barrier wrap; and reducing the likelihood of dropped and damaged rolls of house wrap 70 because with the and the upper house bracket 22 and the exterior wall(s) 78 of the stable structure 76, the residential building or the commercial building.

The house wrap dispenser 12 provides an advantage by way of the two independent lower house wrap brackets, the lower house wrap bracket 14 operably configured with the upper house wrap bracket 22 by shifting the weight of the roll of the house wrap 70 from the single user to the lower house wrap bracket 14 and the upper house wrap bracket 22 as each are removably attached to the exterior wall area of the exterior wall 78 in a stationary position. Thereby, the roll of house wrap 70 cannot sway, wobble or swing any more between the lower non-rotatable dowel 20 and the upper non-rotatable dowel 28 and can thus be unrolled horizontally from the conjoint supporting lower non-rotatable dowel 20 and the upper non-rotatable dowel 28 in an even wrapping plane as the roll of house wrap 70 is affixed to the exterior wall 78 of the stable structure 76, residential building or commercial building by the user.

In addition, the two independent house wrap brackets, the lower house wrap bracket 14 and the upper house wrap bracket 22 provides another advantage whereby the lower house wrap bracket 14 and the upper house wrap bracket 22 can be removed from one location on the exterior surface of the exterior wall 78 of the stable structure 76, residential building or commercial building, and moved to another location of the exterior wall 78 of the stable structure 76, residential building or commercial building to continue the process of wrapping the exterior wall 78 of the stable structure 76, residential building or commercial building in an upper area of the exterior wall 78 of the stable structure 76, residential building or commercial building.

In addition, a second roll of house wrap $\mathbf{70}^2$, when needed, can be installed quickly and exactly on the lower non-rotative dowel 20 of the lower house bracket 14, and, subsequently, on the upper non-rotative dowel 28 of the upper house wrap bracket 22. Further, the lower house wrap bracket 14 together with the upper house wrap bracket 22 support the roll of house wrap 70 rather than the single user supporting the roll of house wrap 70 while wrapping the lower and upper portions of the exterior wall(s) 78 of the stable structure 76, residential building or commercial building which is a critical advantage provided by the embodiment of the invention.

The house wrap dispenser 12 including the lower house wrap bracket 14 and the lower wall plate 16, the lower base plate 18, and the lower non-rotative dowel 20, and the upper house wrap bracket 22 including the upper wall plate 24, the upper base plate 26, and upper non-rotative dowel 28 can be customized in size, shape, and configuration adapted to the dimensions of the variety of selected rolls of house wrap 70 that are commercially available through commercial manufacturers, as noted above.

The first number of symmetrically parallel lower unthreaded anchor holes $\mathbf{100}^{1+n}$ and the symmetrically parallel second number of upper unthreaded anchor holes $\mathbf{104}^{1+n}$ disposed in the lower wall plate 16 and the upper wall plate 24, respectively, together, with the installation of the at least two removable fasteners $\mathbf{40}^{1+n}$ to removably attach, detach, and reattach the lower house wrap bracket 14 and the upper house wrap bracket 22 of the house wrap dispenser 12 to the various locations or the exterior wall areas of the stable structure 76, residential building, or commercial building allows for the critical advantage of a releasable connection to the various locations, or exterior wall areas on the exterior wall(s) 78 allowing for the temporary placement of the house wrap dispenser 12, as needed during use, while the single user installs the house wrap from one location to the next, or one exterior wall area to the next, during the progression of the installment of the house wrap on the various wall locations or exterior wall area(s) without the assistance of a second user.

In addition, such an embodiment of the symmetrically parallel lower unthreaded anchor holes $\mathbf{100}^{1+n}$ and the symmetrically parallel upper unthreaded anchor holes $\mathbf{104}^{1+n}$ disposed in one or more rows with the installation of the at least two removable fasteners $\mathbf{40}^{1+n}$, provides for additional security by preventing unwanted movement of the lower wall plate 16 of the lower house wrap bracket 14 and the upper wall plate 24 of the upper house wrap bracket 22 and, thereby, preventing any swaying or uneven unrolling of the house wrap while the single user is unrolling the roll of house wrap 70 horizontally from the house wrap dispenser 12 to the various locations or exterior wall areas of the exterior wall 78 of the stable structure 76, residential building or commercial building. In addition, such an embodiment may allow for a secured connection under increased loads of house wrap by providing more points of contact between the lower wall plate 16 and the upper wall plate 24 and the various locations or exterior wall areas of the exterior wall 78 of the stable structure 76, residential buildings, and commercial buildings.

While the embodiment discloses, as illustrated in FIGS. 1-3, six lower unthreaded anchor holes $\mathbf{100}^{1+n}$ and six upper unthreaded anchor holes $\mathbf{104}^{1+n}$ removably attached with six removable fasteners 40 of the at least two removable fasteners $\mathbf{40}^{1+n}$ including the right lower unthreaded anchor holes $\mathbf{100}^{R1+R3}$ and left lower anchor holes $\mathbf{100}^{L1+Ln}$ and right upper anchor holes $\mathbf{104}^{R1+R3}$ and left upper anchor holes $\mathbf{104}^{L1+Ln}$, positioned equidistant from the lower wall plate 16 medial axis 30 and upper wall plate 24 medial axis 32, respectively, it should be appreciated that any other number of two or more lower unthreaded anchor holes $\mathbf{100}^{1+n}$ in a series of one or more rows and corresponding removable fasteners $\mathbf{40}^{1+n}$ of the at least two removable fasteners $\mathbf{40}^{1+n}$ may be employed in an embodiment. In another embodiment, the lower wall plate 16 and the upper wall plate 24 may incorporate eight or more unthreaded anchor holes symmetrically disposed within the lower wall plate 16 and the upper wall plate 24.

As can be appreciated by the one skilled in the art to which the invention pertains, many modifications to the embodiment of the house wrap dispenser apparatus 10 can be disclosed in other embodiments, including, the lower non-rotative dowel 20 diameter, the lower non-rotative dowel 20 length, the upper non-rotative dowel 28 diameter and the upper non-rotative dowel 28 length, can be sized to receive any one of a variety of rolls of house wrap 70 or water-resistive barrier-wrap having a variety of cylindrical core diameters, lengths and surface areas. Further, the lower wall plate 16 and the upper wall plate 24, can be sized to support a variety of lengths and diameters of lower non-rotative dowels 20 and upper non-rotative dowels 28.

In the embodiment of the invention, as disclosed above, the house wrap dispenser apparatus 10, for use by the single user, adapted to use with a selected roll of one or more rolls of house wrap 70 or a selected roll of one or more rolls of water-resistive barrier wrap 140 used to install on the exterior wall 78 of one or more exterior walls of the stable structure 76, residential building or a commercial building, the house wrap dispenser 12 includes the lower house wrap bracket 14 and the upper house wrap bracket 22 configured with particular dimensions for installation of the house wrap on stable structures 76, including residential buildings and commercial building that are easily handled by the single user.

In such an embodiment, the lower wall plate 16 of the lower house wrap bracket 14 can be configured to include a lower wall plate 16 length of 16.0 inches, a width of 6.0 inches, a depth of 5/16 inches. The lower base plate 18 of the lower house wrap bracket 14 can be configured to include a side length of 7½ inches, a width of 6.0 inches, a depth of 5/16 inch. The lower non-rotative dowel 20 can be include a length of 15½ inches measured from its proximal end 106 to its distal end 108. The lower non-rotative dowel 20 can be configured with a diameter of 1.0 inch which is less than the cylindrical core diameter of the roll of house wrap 70 or the water-resistive barrier wrap 140 whereby a variety of diameters of rolls of house wrap 70 or rolls of water-resistive barrier wrap 140 can be mounted thereon, however limited by the distance of the lower non-rotative dowel 20 from the front face 52 of the lower wall plate 16 wherein the lower non-rotative dowel 20 proximal end 106 is positioned at a distance of 3⅝ inches from a peripheral flat surface of the front face 52 of the lower wall plate 16 to a peripheral circumferential surface of the lower non-rotative dowel 20.

It is critical that the length of the lower non-rotative dowel 20 is less than the length of the roll of house wrap 70 so that the lower non-rotative dowel 20 is inserted into roll of house wrap 70 for a length of a lower portion of the roll of house wrap 70 allowing for the upper-non rotative dowel 28 to be inserted into an upper portion of the roll of house wrap 70, as illustrated in FIGS. 3-5B, whereby the lower-non rotative dowel 20 and the upper non-rotative dowel 28 conjointly support the roll of house wrap 70 in an upright position whereby the house wrap 70 is enabled to unroll in a horizontal direction which is required by building codes in a many jurisdictions, and recommended by manufacturers of house wrap.

Further, the upper non-rotative dowel 20 is positioned at a distance of 3⅝ inches from a peripheral flat surface of a front face 112 of the upper wall plate 24 of the upper house wrap bracket 22 to a peripheral circumferential surface of the upper non-rotative dowel 28 whereby the upper house wrap bracket 22 is plum with the lower house wrap bracket 14, whereby the upper non-rotative dowel can be inserted into the top portion of the roll of house wrap 70 and, thereby, conjointly support any one of the one or more rolls of house wrap 70 having a variety of diameters and radii wherein the radii is less than 3¾ inches.

The upper wall plate 24 can be configured to include a length of 8.0 inches, a width of 6.0 inches, a depth of 5/16 inches. The upper base plate 26 can be configured to include a side length of 7½ inches and a width of 6.0 inches, and a depth of 5/16 inch.

The upper non-rotative dowel 28 can be configured to include an upper non-rotative dowel 28 length of 7.50 inches measured from the upper non-rotative dowel 28 distal end 66 to the upper non-rotative dowel 28 proximal end 64 which is less than the length of the upper wall plate 24, less than length of the roll of house wrap 70 and less than the lower non-rotative dowel 20 length, where, as discussed above, the length of the upper non-rotative dowel 28 is less than the length of the roll of house wrap 70 so that the upper non-rotative dowel 28 can be inserted into a length of the upper portion of the roll of house wrap 70, as illustrated in FIGS. 3-5B, and allow for the lower non-rotative dowel 20 to be inserted into the length within the lower portion of the roll of the house wrap 70 whereby the lower-non rotative dowel 20 and the upper non-rotative dowel 28 conjointly support the roll of house wrap 70 or water-resistive barrier wrap 140 in an upright position whereby the roll of water-resistive barrier wrap 140 can unroll in a horizontal direction relative to the exterior wall 78 of the residential building or the commercial building.

The upper non-rotative dowel 28 can be configured to include a diameter of 1.0 inch that is less than the cylindrical core diameter of the hollow cylindrical core of the roll of house wrap 70 whereby a variety of diameters of rolls of house wrap 70 or rolls of water-resistive barrier wrap 140 can be mounted thereon, however limited by the distance of the upper non-rotative dowel 28 from the front face 112 of the upper wall plate 24 wherein the upper non-rotative dowel 28 proximal end 64 is positioned at a distance of 3⅝ inches from the peripheral flat front face 112 surface of the upper wall plate 24 to a peripheral circumferential surface of the upper non-rotative dowel 28. The distance of the upper non-rotative dowel 28 from the front face 112 of the upper wall plate 24 is equal to the distance of the lower non-rotative dowel 20 from the front face 52 of the lower wall plate 16 to provide that the lower non-rotative dowel 20 is coaxial to the upper non-rotative dowel 28 when the lower house wrap bracket 14 and the upper house wrap bracket 22 are installed on the exterior wall 78 of the stable structure 76, residential building or commercial building where the lower wall plate 16 medial axis 30 is aligned with the upper wall plate 24 medial axis 32 enabling the lower non-rotative dowel 20 and the upper non-rotative dowel 28 to conjointly support the roll of house wrap 70 in an upright orientation whereby the single user can unroll the house wrap or the water-resistive barrier wrap 140 in a horizontal direction relative to the exterior wall 78 of the residential building or the commercial building.

In another embodiment of the present invention is disclosed a house wrap dispenser apparatus kit 200, as illustrated in FIGS. 6-10D embodied with the house wrap dispenser apparatus 10, as described above, and illustrated in FIGS. 1-5B, such that the termed elements of the house wrap dispenser apparatus 10 with incorporation by reference to FIGS. 1-5B, of this Detailed Description/Specification, will retain their numerical identifiers for consistency and clarity.

Figure 6:
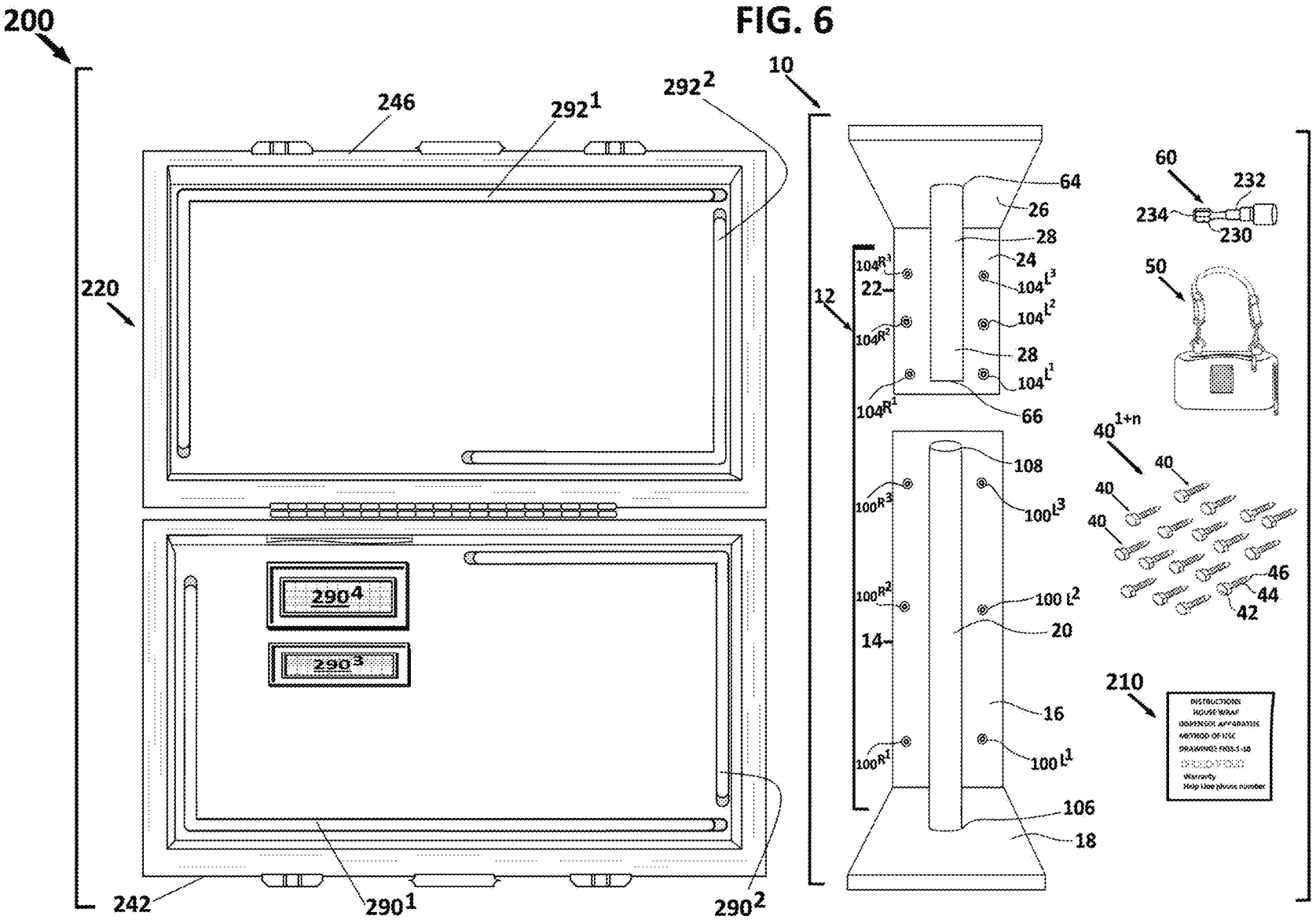
FIG. 6 is a perspective view of a house wrap dispenser apparatus kit.

The house wrap dispenser apparatus kit 200, as illustrated in FIG. 6, comprises, a house wrap dispenser apparatus 10, a house wrap dispenser 12; a bag 50; at least two removable fasteners $\mathbf{40}^{1+n}$, wherein each of the at least two removable fasteners $\mathbf{40}^{1+n}$ is designated with the numeral 40, a driver 60; a house wrap dispenser apparatus instruction sheet 210;

and a house wrap dispenser apparatus carrying case 220 for transporting and storing the house wrap dispenser apparatus 10 including the house wrap dispenser 12, the at least two removable fasteners $\mathbf{40}^{1+n}$, the bag 50 for containing the at least two removable fasteners $\mathbf{40}^{1+n}$, the driver 60, and the house wrap dispenser apparatus instruction sheet 210. The house wrap dispenser apparatus kit 200 provides a means to contain the house wrap dispenser apparatus 10 in one place whereby the house wrap dispenser 12 including the lower house wrap bracket 14 and the upper house wrap bracket 22, the bag 50, the at least two removable fasteners $\mathbf{40}^{1+n}$ contained in the bag 50, and the driver 60, of the house wrap dispenser apparatus kit 200 can be easily transportable, and, further, each of the house wrap dispenser 12, the bag 50 containing the at least two removable fasteners $\mathbf{40}^{1+n}$, and the driver 60 can be easily removed by the single user when installing the house wrap to the exterior wall(s) 78 of the stable structure 76.

The house wrap dispenser apparatus kit 200 includes the house wrap dispenser apparatus 10 for use by a single user, adapted to use with a roll of a house wrap 70 of one or more rolls of the house wrap 70 used to install on an exterior wall 78 of one or more exterior walls of the stable structure 76, the exterior wall 78 having a longitudinal axis 84, as illustrated in FIGS. 3-5B, the roll of the house wrap 70 having a given length, and a hollow cylindrical core 70' limited by a top open end 72, a bottom open end 74, and a cylindrical core diameter.

The house wrap dispenser apparatus kit 200, comprises the house wrap dispenser apparatus 10, as depicted in FIGS. 1 and 6, the disclosure of which is described above in detail, and repeated, here, for consistency, clarity, and particularity. The house wrap dispenser apparatus 10 comprises the house wrap dispenser 12 which comprises a set of two independent house wrap brackets 14 and 22 including a lower house wrap bracket 14 operatively associated with an upper house wrap bracket 22. The lower house wrap bracket 14 includes a lower wall plate 16, a lower base plate 18, and a lower non-rotative dowel 20. The upper house wrap bracket 22 includes an upper wall plate 24, an upper base plate 26, and an upper non-rotative dowel 28.

FIGS. 1-5B illustrates an embodiment of the present disclosure including the house wrap dispenser apparatus 10 for use by a single user, adapted to use with a roll of a house wrap 70 of one or more rolls of the house wrap 70 used to install on an exterior wall 78 of one or more exterior walls of a stable structure 76, residential building, or commercial building, the exterior wall 78 having a longitudinal axis (which is an invisible line indicated at numeral 84), the roll of the house wrap 70 having a given length, and a hollow cylindrical core 70' limited by a top open end 72, a bottom open end 74, and a cylindrical core diameter. A given length refers to the length of the roll of house wrap 70 or a selected roll of house wrap 70 or as a given length of water-resistive barrier wrap 140 with reference to FIGS. 12-15, disclosed in detail in an embodiment below, where the user can purchase the roll of house wrap 70 or water-resistive barrier wrap 140 in a given length or the user can take a commercially available roll of house wrap 70 or water-resistive barrier wrap 140 and cut the roll of house wrap 70 or the water-resistive barrier wrap to a given length that is required for a specific roll of house wrap 70 or water-resistive barrier wrap 140 for the installation on the particular stable structure 76, residential building, or commercial building that the user is installing the house wrap. For example, TYVEC® provides rolls of house wrap 70 or rolls of water-resistive barrier wrap 140 having a variety of given lengths including 3 feet, 5 feet, 9 feet, 10 feet. Here, the user can select any one of the given lengths of the rolls house wrap 70 or the water-resistive barrier wrap 140 and customize the rolls of house wrap 70 or water-resistive barrier wrap to a given length as needed for the particular exterior wall 78 of the stable structure 76, residential building, or commercial building. Thus, such embodiments of the present invention includes a plurality of given lengths of rolls of house wrap 70 and/or rolls of water-resistive barrier wrap 140.

As depicted in FIG. 1, the house wrap dispenser apparatus 10 comprises a house wrap dispenser 12 including a set of two independent house wrap brackets, 14 and 22, including a lower house wrap bracket 14 operatively associated with an upper house wrap bracket 22, at least two removable fasteners $\mathbf{40}^{1+n}$, wherein each removable fastener of the at least two removable fasteners $\mathbf{40}^{1+n}$ is designated with the numeral 40, a bag 50 to contain the at least two removable fasteners $\mathbf{40}^{1+n}$, and a driver 60 to implement the at least two removable fasteners $\mathbf{40}^{1+n}$ when the single user assembles the house wrap dispenser 12 for use and removably attaches, detaches, and reattaches, the house wrap dispenser 12 to the exterior wall 78 of the stable structure 76, residential building, or commercial building.

Further, as depicted in FIG. 1, the lower house wrap bracket 14 includes a lower wall plate 16, a lower base plate 18, and a lower non-rotative dowel 20. Similarly, the upper house wrap bracket 22 includes an upper wall plate 24, an upper base plate 26, and an upper non-rotative dowel 28. In use, as illustrated in FIGS. 3-5B, the lower house wrap bracket 14 is removably attached to the first exterior wall area 80 of the exterior wall 78 of the stable structure 76, the residential building, or the commercial building, the roll of house wrap 70 is installed onto the lower non-rotative dowel, by the single user, wherein the distal end 108 of the lower non-rotative dowel 20 is inserted into the bottom open end 74 of the roll of house wrap 70, and, subsequently, the upper house wrap bracket 22 is removable attached to a second exterior wall area 82 of the exterior wall 78 of the stable structure 76, wherein the distal end 66 of the upper-non-rotative dowel being inserted into the top open end 72 of the hollow cylindrical core 70' of the roll of house wrap 70. As illustrated in FIGS. 3-5B, and more particularly as illustrated in FIG. 3, the orientation of the upper house wrap bracket 22 and the lower house wrap bracket 14 being removably attached to the stable structure 76, the residential building, or the commercial building, with respect to each other, such that the lower non-rotative dowel 20 of the lower house wrap bracket 14 is oriented facing the upper non-rotative dowel 28 of the upper house wrap bracket 22 whereby a lower wall plate 16 medial axis 30 is aligned with an upper wall plate 24 medial axis 32 of the upper wall plate 24.

As shown in FIGS. 3-5B, the upper house wrap bracket 22 is spaced above from the lower house wrap bracket 14 a distance greater than the given length of the roll of the house wrap 70 whereby the bottom open end 74 of the roll of house wrap 70 can be readily received by the lower non-rotative dowel 20 and the top open end 72 of the roll of house wrap 70 can be readily received by the upper non-rotative dowel 28 such that the lower non-rotative dowel 20 and the upper non-rotative dowel 28 conjointly support the roll of house wrap 70 in an upright orientation for rotation of the roll of the house wrap 70 relative to the lower non-rotative dowel 20 and the upper non-rotative dowel 28 whereby the roll of house wrap 70 can unroll in a horizontal direction relative to the exterior wall 78 of the stable structure 76, residential building, or commercial building.

Further, as illustrated in FIGS. 5A-5B, the house wrap dispenser 12, can be attached, detached, and reattached from an exterior wall area 80 or location on the exterior wall 78 of the stable structure 76 and relocated to another exterior wall area 80' and 82' while the user installs the house wrap on the exterior wall 78 of the stable structure 76. Specifically, the lower house wrap bracket 14 is removably attached at the first exterior wall area 80, and the upper house wrap bracket is removably attached to the second exterior wall area 82 plum with the lower wall bracket 14. Further, upon completion of the installation of the house wrap onto a first lower area of the exterior wall(s) 78 and the depletion of the roll of house wrap 70, the single user can detach the lower house wrap bracket 14 and detach the upper house wrap bracket 22 and relocate the lower house wrap bracket 14 and the upper house wrap bracket 22 to the next location on the exterior wall 78, and continue with the process of nailing and stapling the house wrap on the to the next location of the exterior wall 78. The single user, can removably reattach the lower house wrap bracket 14 to a third exterior wall area 80', replace the remaining hollow cylindrical core 72 with a second roll of house wrap $\mathbf{70}^2$ and mounting the second roll of house wrap $\mathbf{70}^2$ onto the lower non-rotative dowel 20 of the lower house wrap bracket 14, as depicted in FIGS. 5A-5B, by inserting the distal end 108 of the lower-house wrap dowel 20 into the bottom open end 74 of the second roll of the house wrap $\mathbf{70}^2$. Subsequently, the single user can removably reattach the upper house wrap bracket 22 to a fourth exterior wall area 82' wherein the upper-non-rotative dowel 28 of the upper house wrap bracket 22 is inserted, by the single user, into the top open end 72 of the hollow cylindrical core 70' of the roll of house wrap 70 such that the lower non-rotative dowel 20 of lower house wrap bracket 14 and the upper non-rotative dowel 28 of the upper house wrap bracket 22 are coaxial whereby the lower non-rotative dowel 20 and the upper non-rotative dowel 28 conjointly support the second roll of house wrap 70' such that the house wrap can be pulled from the second roll of house wrap 70' in a horizontal direction. The process of the installation of the house wrap on the exterior wall(s) 78 of the stable structure 76, is repeated until the exterior walls 78 of the stable structure 76 are completely covered by the house wrap as required.

As illustrated in FIGS. 1-5B, the house wrap dispenser apparatus 10 is a useful solution to the installation of house wrap from the roll of house wrap 70 which can be affixed to exterior walls 78 of stable structures 76, or residential buildings or commercial buildings. In addition, the house wrap dispenser apparatus 10 can be used in the installation of house wrap from the roll of house wrap 70 that can be affixed to sheathing of the exterior walls 78 of the stable structures 76, or residential buildings or the commercial buildings. The stable structures 76, residential buildings and commercials building can include single family dwellings, multi-family apartment type buildings, commercial buildings, office buildings, a garage, a shed, and where more than one exterior walls 78 are installed in one stable structure 76, residential building or commercial building, as these multiple stable structures 76 have similar or substantially the same features, for example, at least four exterior walls. In another embodiment, the stable structure 76 can include a geodesic dome structure, geodesic dome residential building, a geodesic dome commercial building. The term stable structure 76, as recited in the disclosure of the embodiments of the present invention can be interpreted to mean a stable structure 76, residential building or a commercial building, as defined above.

The house wrap dispenser apparatus 10 seeks to assist and improve current methods for improved installation of house wrap from a roll(s) of house wrap 70 on exterior walls 78 of stable structures 76, residential buildings and commercial buildings, and to be compliant with the International Residential Code (2015), and the Washington State Building Code (Chapter 51-51 WAC), and building codes of the particular jurisdiction where the stable structure 76, residential building, or commercial building is located. The exterior wall(s) 78 of the stable structure 76, residential building or the commercial building may include sheathing. In the following embodiments, the plurality of roll(s) of house wrap, including the roll of house wrap 70 and 70', can include commercially available house wraps 70 and water-resistive barrier wraps 140, as shown in FIGS. 14-16B, and, therefore, can be substituted for one for the other in the embodiments, as disclosed. Such rolls of house wrap(s) 70 and/or water-resistive barrier wraps 140 for stable structures, residential buildings and commercial buildings can include, by way of example, Grade D building paper, asphalt-saturated kraft paper, building felt, polymeric house wrap. Known polymeric house wraps for use as weather-resistive barriers or house wraps include, spunbond polyethelene sheet available under the trade name DuPont TYVEK® HOMEWRAP® and TYVEK® STUCCOWRAP® from E.I. du Pont de Nemours & Co., Wilmington, Del.; BARRICADE® from Barricade Building Products, Doswell, Va.; polyolefin nonwoven sheet available under the trade name STYROFOAM™ WEATHERMATE™ PLUS from the Dow Chemical Company, Midland, Mich.; spunbonded polypropylene-microporous film laminate available under the trade woven polypropylene sheet with a perforated coating available under the trade name Pinkwrap® from Owens Corning, Corning, N.Y. The space between the two layers provides a drainage space for any liquid water that penetrates the outer layer, and Everbuilt a Home Depot Product Authority.

Referring, again, to FIG. 1, which illustrates a perspective view of the embodiment of the house wrap dispenser apparatus 10 including the house wrap dispenser 12, the bag 50, the at least two removable fasteners $\mathbf{40}^{1+n}$, where each removable fastener is depicted by the numeral 40, and the driver 60. In particular, FIG. 1 illustrates a perspective view of the house wrap dispenser 12 including the set of the two independent house wrap brackets 14 and 22 including the lower house wrap bracket 14 and the upper house wrap bracket 22 to be removably attached onto one or more locations or exterior wall areas of the exterior wall(s) 78 of the stable structure 76, or the residential buildings, or the commercial buildings. FIGS. 3-5B illustrate the house wrap dispenser 12 including the lower house wrap bracket 14 and the upper house wrap bracket 22 can be attached, detached, and reattached to one or more locations or exterior wall areas 80, 80' on the exterior wall(s) 78 of the house.

The house wrap dispenser 12 can be manufactured using a suitable polymer resin, plastic, metal, steel, aluminum, or other rigid material sufficiently strong to support the roll of house wrap 70 on the exterior wall(s) 78 of the stable structure 76, residential building or commercial building.

FIG. 2A illustrates a perspective view of a right side of the house wrap dispenser 12 of the house wrap dispenser apparatus 10 including the lower house wrap bracket 14, the upper house wrap bracket 22, and the lower non-rotative dowel 20. FIG. 2B illustrates a perspective view of the house wrap dispenser 12 as shown in FIG. 2A. including the lower house wrap bracket 14, the upper house wrap bracket 22, and the upper non-rotative dowel 28. As depicted in FIGS. 1-2, the lower house wrap bracket 14 includes the lower wall plate 16 which is configured having a first elongated rectangular plane having a lower wall plate 16 length, a lower wall plate 16 width, and a lower wall plate 16 depth. As depicted in FIG. 2A, the lower wall plate 16 of the lower house wrap bracket 14 includes a first 1.0 inch measuring notch 86 etched on a first peripheral surface of a right side face 92 of the lower wall plate 16 measured vertically upward from a right inferior edge 94 of the lower wall plate 16, a first 2.0 inch measuring notch 88 etched on a second peripheral surface of the right side face 92 of the lower wall plate 16 measured vertically upward from the right inferior edge 94 of the lower wall plate 16, a first 6.0 inch measuring notch 90 etched on a third peripheral surface of the right side face 92 of the lower wall plate 16 measured vertically upward from the right inferior edge 94 of the lower wall plate 94.

Further, as depicted in FIG. 2B, the lower wall plate 16 includes a second 1.0 inch measuring notch 86' etched on a first peripheral surface of a left side face 96 of the lower wall plate 16 measured vertically upward from a left inferior edge 98 of the lower wall plate 16, a second 2.0 inch measuring notch 88' etched on a second peripheral surface of the left side face 96 of the lower wall plate 16 measured vertically upward from the left inferior edge 98 of the lower wall plate 16, and a second 6.0 inch measuring notch 90' etched on a second peripheral surface of the left side face 96 of the lower wall plate 16 measured vertically upward from the left inferior edge 98 of the lower wall plate 16.

It is critical that the lower wall plate 16 includes one or more measuring notches including, particularly, the first and second 1.0 inch measuring notches 86 and 86', respectively, the first and second 2.0 inch measuring notches 88 and 88', respectively, and the first and second 6.0 inch measuring notches 90 and 90', respectively, etched on the peripheral surfaces of the right side face 92 and the left side face 96 of the lower wall plate 16, as described immediately, above, because, with reference to the International Residential Code (2015), and the Washington State Building Code (Chapter 51-51 WAC), other local jurisdictional building codes, commercial manufacturers of the house wrap or water-resistive barrier wrap, and what is known to a person of ordinary skill in the art, it is recommended that the user align the roll of house wrap 70 at a bottom corner of the exterior wall(s) 78 of the stable structure 76, residential building, or commercial building having the roll of house wrap 70 plumb, and whereby the user must extend the bottom edge of the bottom layer of the house wrap being installed over the sill plate of the exterior wall 78 of the stable structure 76, residential building, or commercial building, by at least 1.0 inch, or 2.0 inches.

In addition, it is critical that the lower wall plate 16 includes a first 6.0 inch measuring notch 90 and a second 6.0 inch measuring notch 90' on each of the right side face 92 and the left side face 96 of the lower wall plate 16, as discussed above, with reference to FIGS. 2A and 2B, because, with reference to International Residential Code (2015), and the Washington State Building Code (Chapter 51-51 WAC), other local jurisdictional building codes, commercial manufacturers of the rolls of house wrap and water-resistive barrier wrap and what is known to a person of ordinary skill in the art, it is recommended that the user install an upper layer of the house wrap which should overlap the bottom layer of house wrap bottom layer by a minimum of 6.0 inches, whereby the consecutive upper layers of house wrap or water-barrier resistive barrier wrap should continue to overlap the its adjacent bottom layer of the house wrap or water-resistive barrier wrap by another 6.0 inches to prevent water and moisture from entering and seeping between the exterior wall, sheathing and the house wrap or the water-resistive barrier wrap.

It is important to note that the user consult the International Residential Code (2015) and to consult the building codes of their specific jurisdiction of the situs of the stable structure 76, residential building, or commercial building to insure compliance with the local building codes.

As particularly depicted in FIGS. 1, 2C-2D and 3-5B, the lower wall plate 16 of the lower house wrap bracket 14, also, includes a first number of lower unthreaded anchor holes $\mathbf{100}^{1+n}$ integrally formed therethrough the front face 52 of the lower wall plate 16 extending therethrough a rear face 102 of the lower wall plate 16, disposed in a first series of one or more lower rows aligned in widthwise rows along the lower wall plate 16 length. As shown in FIGS. 1, 3-5 the lower wall plate 16 includes one or more pairs of a right lower unthreaded anchor hole(s) 100' and a left lower unthreaded anchor hole(s) 100' which are disposed symmetrically parallel to each other spaced equidistant from the lower wall plate 16 medial axis 30. Each of the first number of the lower unthreaded anchor holes $\mathbf{100}^{R1+R3}$ and $\mathbf{100}^{L1-L3}$ includes an inner diameter and a depth, the depth equal to the lower wall plate 16 depth, configured to receive any one of the at least two removable fasteners $\mathbf{40}^{1+n}$, where each individual removable fastener is depicted by the numeral 40, to selectively attach, detach, and reattach the lower wall plate 16 of the lower house wrap bracket 14 to one or more exterior wall areas 80, 80', 82, 82' of the exterior wall 78 of the stable structure 76, residential building, or the commercial building. In this manner, the lower house wrap bracket 14 can be temporarily attached to a first location or exterior wall area of the stable structure 76, residential building, or commercial building, via the lower wall plate 16 and the at least two removable fasteners $\mathbf{40}^{1+n}$, and relocated and removably reattached to a second location or second exterior wall area(s) 80, 80', 82, 82' of the exterior wall(s) 78 of the stable structure 76, residential building, or commercial building, as the user proceeds in completing the process of installing the house wrap on the exterior wall(s) 78 of the stable structure 76, residential building, of commercial building. The first number of lower unthreaded anchor holes $\mathbf{100}^{1+n}$ can be equal to or greater than a second number of upper unthreaded anchor holes $\mathbf{104}^{1+n}$.

Each of the any one of the at least two removable fasteners $\mathbf{40}^{1+n}$ is compliant with each of the first number of the lower unthreaded anchor holes $\mathbf{100}^{1+n}$ whereby each of the any one of the at least two removable fasteners $\mathbf{40}^{1+n}$ includes an anchor head 42 having an anchor head 42 diameter greater than the inner diameter of each of the first number of the lower unthreaded anchor holes $\mathbf{100}^{1+n}$ and an anchor body 44 connected to and extending longitudinally from the anchor head 42 to a sharply tapered distal end 46 of the anchor body 44, the anchor body 44 having an anchor body 44 diameter less than each of the inner diameter of each of the first number of the lower unthreaded anchor holes $\mathbf{100}^{1+n}$, and a body length greater than the depth of each of the first number of the lower unthreadable anchor holes $\mathbf{100}^{1+n}$ such that the anchor body 44 is inset into the first exterior wall area 80 a wall distance being operable to uphold the lower house wrap bracket 14 stationary on the exterior wall 78 of the stable structure 76.

FIG. 3 illustrates a perspective view of the house wrap dispenser 12 in use. FIG. 4 is a perspective view of the house wrap dispenser 12 assembled with the roll of house wrap 70 mounted on the lower non-rotative dowel 20 of the lower house wrap bracket 14 being conjointly supported by the upper non-rotative dowel 28 of the upper house wrap bracket 22. FIGS. 2A-5B is a perspective view of the house wrap dispenser 12 showing the house wrap dispenser 12 in use being removably attached, detached, and reattached to the exterior wall 78 of the stable structure 76.

As illustrated in FIGS. 3-5B the anchor body 44 of the any one of the at least two removable fasteners $\mathbf{40}^{1+n}$, wherein a single removable fastener of the at least two removable fasteners $\mathbf{40}^{1+n}$ is designated by the numeral 40, is configured to be received through any one of the lower unthreaded anchor holes $\mathbf{100}^{1+n}$ and the upper unthreaded anchor holes $\mathbf{104}^{1+n}$, as described below, wherewith the anchor head 42 is captured by an exterior surface on the front face 52 of the lower wall plate 16 as the anchor body 44 of the removable fastener 40 is screwed into the first location or the first exterior wall area 80 and reattached to the third location or exterior wall area 80', as depicted in FIGS. 5A-5B, of the exterior wall 78 of the stable structure 76, residential building, or commercial building. As shown, each of the number of lower unthreaded anchor holes $\mathbf{100}^{1+n}$, particularly the pairs of lower right anchor holes 100' and left lower anchor holes $\mathbf{100}^{L1-L3}$ receives any one of the at least two removable fasteners $\mathbf{40}^{1+n}$.

The house wrap dispenser apparatus 10 includes the at least two removable fasteners $\mathbf{40}^{1+n}$ that is greater in number than the first number of lower unthreaded anchor holes $\mathbf{100}^{1+n}$ and the second number of upper unthreaded anchor holes $\mathbf{104}^{1+n}$ such that the user or installer has an ample supply of the at least two removable fasteners $\mathbf{40}^{1+n}$ where it is foreseeable that any number of the at least two removable fasteners $\mathbf{40}^{1+n}$ may be misplaced or lost in the process of installing the house wrap to the exterior wall(s) 78 of the stable structure 76, the residential building or the commercial building.

As disclosed above, FIGS. 2A and 2C depicts a perspective view of the right side of the house wrap dispenser 10, including a right side perspective view of the lower house wrap bracket 14 and a right side perspective view of the upper house wrap bracket 22. In addition, FIG. 2B depicts a left side perspective view of the house wrap dispenser 10, including a left side perspective of the lower house wrap bracket 14 and the upper house wrap bracket 22. FIG. 2D depicts a perspective view of the left side of the lower house wrap bracket 14. As illustrated in FIGS. 1-5B, particularly with particularity to FIGS. 2A-2B, the lower base plate 18 is cojoined to the lower wall plate 16 at a right angle along a frontal inferior marginal edge 38 of the lower wall plate 16 and a transversal marginal edge 39 of the lower base plate 18. The lower base plate 18 includes a first horizontal plane with a geometric shape to support the lower non-rotative dowel 20 where, as shown in FIGS. 1-2D, the lower non-rotative dowel 20 is orientated in a vertical upward position, whereby, in use, the lower non-rotative dowel 20 can receive a bottom portion of the roll of house wrap 70, as depicted in FIGS. 3-5B. The lower wall plate 16 and the lower base plate 18 can be configured having any geometric shape.

As illustrated in FIG. 2B, the upper base plate 26 of the upper wall bracket 22 is cojoined to the upper wall plate 24 at a right angle along a frontal superior marginal edge 58 of the upper wall plate 24 and a transversal marginal edge 62 of the upper base plate 26. The upper base plate 26 includes a second horizontal plane with a geometric shape to support the upper non-rotative dowel 28 where, as shown in FIGS. 1, 2A-2B and 3-5B, the upper non-rotative dowel 28 is orientated in a vertical downward position, whereby, in use, the upper non-rotative dowel 28 can receive a top portion of the roll of house wrap 70, as depicted in FIGS. 3-5B. The upper wall plate 24 and the upper base plate 26 can be configured having any geometric shape.

The lower non-rotative dowel 20 includes a lower non-rotative dowel 20 proximal end 106 and a lower non-rotative dowel distal end 108, as illustrated in FIGS. 1 and 2C-3, a lower non-rotative dowel 20 diameter which is less than the cylindrical core diameter of the roll of house wrap 70 of the one or more rolls of house wrap 70, a lower non-rotative dowel 20 length which is less than the given length of the roll of house wrap 70, less than the length of the lower wall plate 16, and greater than an upper non-rotative dowel 28 length. The lower non-rotative dowel 20 is affixed to a central portion of the lower base plate 18 via welding or the lower house wall bracket 14 can be manufactured as a complete seamless single unit including the lower wall plate 16 having the first number of lower unthreaded anchor holes $\mathbf{100}^{1+n}$ dispose therethrough, lower base plate 18, and lower non-rotative dowel 20.

Referring to FIGS. 1, 2A-2B, and 3, the lower non-rotative dowel 20 includes a lower non-rotative dowel 20 length that is greater than the upper non-rotative dowel 28 length wherein when the lower non-rotative dowel 20 is inserted into the bottom open end 74 of a selected roll of house wrap 70 the lower non-rotative dowel 20 supports the majority of the length of the selected roll of house wrap 70. In this manner, the upper non-rotative dowel 28 wherein when the upper non-rotative dowel 28 is inserted into the top open end 72 of the selected roll of house wrap 70 will support a lesser length of the selected roll of house wrap 70 where the upper non-rotative dowel 28 provides additional stability and support to the roll of house wrap 70 conjointly with the lower non-rotative dowel 20 allowing the user to easily unroll the house wrap 70 or horizontally from the house wrap dispenser 12, as depicted in FIGS. 3-5B. And of equal importance, it is an advantage that the upper house wrap bracket 22 can be removably attached a variety of distances from the lower house wrap bracket 14 where with such an embodiment a variety of lengths of rolls of house wrap 70 can be accommodated.

It is critical that the house wrap dispenser 12 unroll the house wrap from the roll of house wrap 70 in a horizontal orientation because the building codes, as disclosed above, and commercial house wrap manufacturers directions call for the house wrap to be unrolled in a horizontal direction from the roll of house wrap 70 so that a lower layer of house wrap is installed horizontally along the exterior wall 78 of the stable structure 76, residential building, or commercial building whereby an upper layer of house wrap 70 can be installed overlapping the lower layer of house wrap by a recommended 6.0 inches.

FIG. 3 illustrates a perspective view of the house wrap dispenser 12 of FIG. 1 in use. Further, FIG. 3 shows the lower non-rotative dowel 20 proximal end 106 is integrally affixed to a central portion of a top face 48 of the lower base plate 18 whereby the lower non-rotative dowel 20 is affixed in an upright vertical orientation, wherein a peripheral circumferential surface of the lower non-rotative dowel 20 is spaced a predetermined distance from a peripheral flat surface of the front face 52 of the lower wall plate 16, the predetermined distance being at least greater than a radius of the roll of the house wrap 70 such that a roll of selected house wrap 70 can easily be mounted on the lower non-rotative dowel 20 when in use.

FIGS. 1-2A-2B, and FIGS. 3-5B, in particular, illustrate the upper wall plate 24 includes a second upper elongated rectangular plane having an upper wall plate 24 length which is less than the lower wall plate 16 length, an upper wall plate 24 width and an upper wall plate 24 depth, the upper wall plate 24 width and the upper wall plate 24 depth which is equal to the lower wall plate 16 width and lower wall plate 16 depth, respectively. In this manner, the lower wall plate 16 and the upper wall plate 24 being equal in lower wall plate 16 depth and width and upper wall plate 24 length and width allow for symmetrical placement of the lower house wrap bracket 14 and the upper house wrap bracket 22 on the exterior wall 78 and for a uniform distance of each of the rear face 102 of the lower wall plate 16 and a rear face 110 of the upper wall plate 24 from the first exterior wall area 80 and second exterior wall area 82, respectively, for the placement of the lower house wrap bracket 14 and the upper house wrap bracket 22 which prevents against wobbling of the house wrap dispenser 12 in use and a stationary and stable removable attachment of the house wrap bracket 12 to the exterior wall 78.

FIGS. 1 and 3, illustrate the upper wall plate 24 including a second number of upper unthreaded anchor holes $\mathbf{104}^{1+n}$ integrally formed therethrough a front face 112 of the upper wall plate 24 extending therethrough the rear face 110 of the upper wall plate 24 disposed in a second series of one or more upper rows aligned in widthwise rows along the upper wall plate 24 length whereby a pair of one or more pairs of a right upper unthreaded anchor hole $\mathbf{104}^{R1-R3}$ and a left upper unthreaded anchor hole $\mathbf{104}^{L1-L3}$ are disposed symmetrically parallel to each other spaced equidistant from the upper wall plate 24 medial axis (the upper wall medial axis being an invisible line shown as the dotted line with the numeral 32).

Each of the second number of upper unthreaded anchor holes $\mathbf{104}^{1+n}$ including the right upper unthreaded anchor hole $\mathbf{104}^{R1-R3}$ and the left upper unthreaded anchor holes $\mathbf{104}^{L1-L3}$ includes an inner diameter and a depth equal to the inner diameter and the depth of each of the first number of the lower unthreaded anchor holes $\mathbf{100}^{1+n}$ including the right lower unthreaded anchor holes $\mathbf{100}^{L1-L3}$ and the left lower unthreaded anchor holes $\mathbf{100}^{L1-L3}$, configured to receive any one of the at least two removable fasteners $\mathbf{40}^{1+n}$ to selectively attach, detach, and reattach the upper wall plate 24 of the upper house wrap bracket 22 to one or more exterior wall areas 82, 82" of the exterior wall 78 of the stable structure 76, the residential building, or the commercial building.

As illustrated in FIGS. 3-5B, the anchor body 44 of the removable fastener $\mathbf{40}^{1+n}$ is configured to be received through each of the number of upper unthreaded anchor holes $\mathbf{104}^{1+n}$ including the right upper unthreaded anchor holes $\mathbf{104}^{R1-R3}$ and the left upper unthreaded anchor holes $\mathbf{104}^{L1-L3}$, and the anchor head 42 is captured by an exterior surface on the front face 112 of the upper wall plate 24 as the anchor body 44 of each of the at least two removable fasteners $\mathbf{40}^{1+n}$ is screwed into the second location or second exterior wall area 82 of the exterior wall 78 of the stable structure 76, residential building or commercial building. As shown, each of the number of the upper unthreaded anchor holes 104 receives the removable fastener 40 of the at least two removable fasteners $\mathbf{40}^{1+n}$.

Each of the any one of the at least two removable fasteners $\mathbf{40}^{1+n}$ is compliant with each of the second number of upper unthreaded anchor holes $\mathbf{104}^{1+n}$ whereby each of the multiple at least two removable fasteners $\mathbf{40}^{1+n}$ includes the anchor head 42 having the anchor head 42 diameter greater than the inner diameter of each of the upper unthreaded anchor holes 104 and the anchor body 44 connected to and extending longitudinally from the anchor head 42 to a sharply tapered distal end 46 of the anchor body 44, and where the anchor body 44 includes the anchor body 44 diameter less than the inner diameter of each of the right upper unthreaded anchor holes $\mathbf{104}^{R1-R3}$ and the left upper unthreaded anchor holes $\mathbf{104}^{L1-L3}$ and the anchor body 44 length greater than the depth of the right upper unthreadable anchor holes $\mathbf{104}^{R1-R3}$ and the left upper unthreaded anchor holes $\mathbf{104}^{L1-L3}$ such that the anchor body 44 is inset into the second exterior wall area 82 the wall distance being operable to uphold the upper house wrap bracket 22 stationary on the exterior wall 78 of the stable structure 76. It is critical that the lower house wrap bracket 14 and the upper house wrap brackets 22 are stationary wherein when each are removably attached to their prospective exterior wall areas 80 and 82 or prospective locations the roll of house wrap 70 cannot sway, wobble or swing between the lower non-rotatable dowel 20 and the upper non-rotatable dowel 28 of the lower house wrap bracket 14 and the upper house wrap bracket 22, respectively, and thus the roll of house wrap 70 can be unrolled from the conjoint supporting lower non-rotatable dowel 20 and the upper non-rotatable dowel 28 in an even wrapping plane as the roll of house wrap 70 is affixed to the exterior wall 78 of the stable structure 76 by the user.

FIGS. 1-2B illustrates the upper base plate 26 of the upper house wrap bracket 22 is conjoined to the upper wall plate 24 at a right angle along a frontal superior marginal edge 58 of the upper wall plate 24 and a transversal marginal edge 62 of the upper base plate 26. The upper base plate 26 includes a horizontal plane in a geometric shape to support the upper non-rotative dowel 28 having the upper non-rotative dowel 28 orientated in a vertically downward direction. The upper base plate 26 and the upper wall plate 24 can be configured in any geometric shape. As illustrated in FIGS. 1-2B, and FIG. 3, the upper non-rotative dowel 28 includes an upper non-rotative dowel 28 proximal end 64, an upper non-rotative dowel 28 distal end 66, an upper non-rotative dowel 28 diameter which is equal to the lower non-rotative dowel 20 diameter that is less than the cylindrical core diameter of the hollow cylindrical core 70' of the roll of the house wrap 70, an upper non-rotative dowel 28 length which is less than the length of the roll of house wrap 70, less than the length of the upper wall plate 24, and less than the length of the lower non-rotative dowel 20 length. The upper non-rotative dowel 28 is affixed to a central portion of the upper base plate 26 via welding, or the upper house wall bracket 22 can be manufactured as a complete seamless single unit including the upper wall plate 24 having the second number of upper unthreaded anchor holes $\mathbf{104}^{1+n}$ disposed therethrough, upper base plate 26, and lower non-rotative dowel 20.

FIGS. 1-2B illustrates the upper non-rotative dowel 28 proximal end 64 is integrally affixed to a central portion of a bottom face 48 of the upper base plate 26 such that the upper non-rotative dowel 28 is affixed in a vertically downward orientation at a second predetermined distance measured from the front face 112 of the upper wall plate 24 to a peripheral circumferential surface of the upper non-rotative dowel 28, the second predetermined distance is equal to the first predetermined distance being at least greater than a radius of the roll of the house wrap 70 whereby the upper non-rotative dowel 28 is aligned coaxial with the lower non-rotative dowel 20.

In addition, in use, as illustrated in FIGS. 3-5B, the upper wall plate 24 of the upper house wrap bracket 22 is positioned at the second location or the second exterior wall area 82 of the exterior wall 78 which is separated vertically a distance from the lower wall plate 16 of the lower house wrap bracket 14 having the upper plate medial axis 32 coaxial with the lower plate medial axis 30, as depicted in FIG. 3, and the upper plate medial axis 32 and the lower plate medial axis 30 parallel with the longitudinal axis 84 of the exterior wall 78 of the stable structure 76, residential building, or commercial building. In use, the single user first removably attaches the lower house wrap bracket 14 to the exterior wall area 80 of the stable structure 76, residential building or commercial building, wherein the lower wall plate 16 is removably attached to the exterior wall area 80 via the at least two removable fasteners 40 inserted into each of the corresponding one of the first number of anchor holes $\mathbf{100}^{1+n}$ to engage with the first location or exterior wall area 80 on the exterior wall, and, subsequently, mounts the selected roll of the house wrap 70 onto the lower non-rotative dowel 20 by inserting the distal end 108 of the lower non-rotative dowel 20 into the bottom open end 74 of the selected roll of house wrap 70 such that the selected roll of house wrap 70 is supported by the length of the lower non-rotative dowel 20 from its proximal end 106 to its distal end 108. Subsequently, the distal end 66 of the upper non-rotative dowel 28 is inserted into the top open end 72 of the roll of house wrap 70 such that an upper portion of the roll of house wrap 70 is supported by the length of the upper non-rotative dowel 28.

It is critical that the upper non-rotative dowel 28 and the lower non-rotative dowel 20 diameters are equal and being a diameter that is less than the selected roll of house wrap 70 and that the second predetermined distance is equal to the first predetermined distance from each of the front face 52 of the lower wall plate 16 and the front face 112 of the upper wall plate 24, respectively, being at least greater than a radius of the roll of the house wrap 70 whereby the upper non-rotative dowel 28 is aligned coaxial with the lower non rotative dowel 20 so that the lower non-rotative dowel 20 can readily be inserted through the bottom open end 74 of the selected roll of house wrap 70, and the upper non-rotative dowel 28 can be readily inserted into the top open end 72 of the roll of house wrap 70 whereby the upper non-rotative dowel 28 and the lower non-rotative dowel 20 conjointly support the selected roll of house wrap 70 without any urging of the roll of house wrap 70 onto the lower non-rotative dowel 20 or the upper non-rotative dowel 28. Again, here the house wrap dispenser 12 provides the advantage where the upper house wrap bracket 22 can be removably attached a variety of distances from the lower house wrap bracket 14 to accommodate a variety of lengths of rolls of house wrap 70.

In the embodiment of the present invention, the lower non-rotative dowel 20 diameter, the lower non-rotative dowel 20 length, the upper non-rotative dowel 28 diameter and the upper non-rotative dowel 28 length, can be sized to receive any one of a variety of rolls of house wrap 70 having a variety of cylindrical core diameters and lengths. In addition, the at least two removable fasteners $\mathbf{40}^{1+n}$ can include any one of a group consisting of screws, full bearing screws, washer faced, double chamfered, square screws, knurled head, and lag screws.

As depicted in FIGS. 3-5B the house wrap dispenser 12 showing the lower house wrap bracket 14 is removably attached at the first exterior wall area 80 prior to removably attaching the upper house wrap bracket 22 to the second exterior wall area 82, and, particularly, in FIGS. 5A-5B, showing the lower house wrap bracket 14 being removably attached to the third exterior wall area 80' and the upper wall bracket 22 to the fourth exterior wall area 82', to facilitate mounting of a first roll of house wrap 70 and replacement of a second roll of house wrap $\mathbf{70}^2$ upon the lower non-rotative dowel 20 when the first roll of house wrap 70 is depleted, and consecutive rolls of house wrap 70 are depleted, and to accommodate a plurality of given lengths of rolls of house wrap 70.

In the embodiment of the present invention, the lower house wrap bracket 14 and the upper house wrap bracket 22 is manufactured from at least one of the materials selected from the group consisting of metal, steel, and aluminum. In another embodiment of the lower house wrap bracket 14 and the upper house wrap bracket 22 is manufactured from at least one of the materials selected from the group consisting of polymer resin, and plastic.

With this embodiment, and the following disclosed embodiments of the present invention, it is critical for the single user that the lower house wrap bracket 14 and the upper house wrap bracket 22 are each removably affixed to the one or more locations or exterior wall areas on the exterior wall(s) 78 of the stable structure 76, residential building or the commercial building because being removably affixed to the exterior wall(s) 76 provides that the lower house wrap bracket 14 and the upper house wrap bracket 22 can be spaced apart from each other any distance that shall accommodate any given length of a selected roll house wrap 70 of the one or more house wraps or water-resistive barrier wrap 140 having a given length that are commercially available from manufacturers, on the exterior wall 78 of the stable structure 76, residential building and the commercial building the user is installing the house wrap thereon. For example, TYVEC® provides rolls of house wrap 70 or rolls of water-resistive barrier wrap 140 having a variety of given lengths including 3 feet, 5 feet, 9 feet, 10 feet.

In addition, it is critical for the single user of the house wrap dispenser apparatus 10 that the lower house wrap bracket 14 and the upper house wrap bracket 22 of the house wrap dispenser 12 are removably affixed but being stationary to the exterior wall(s) 78 of the stable structure 76, residential building, or the commercial building because the exterior wall(s) 76 of the stable structure 76, the residential building, or the commercial building, maintains and supports the weight of the house wrap dispenser 12 and the roll of house wrap 70 or the roll of water-resistive barrier wrap 140 rather than the single user or installer maintaining the weight of the house wrap dispenser 12 mounted with the roll of house wrap 70 or water-resistive barrier wrap 140. The lower house wrap bracket 14 and the upper house wrap bracket 22 operating together provides for the roll of house wrap 70 to be installed on the lower house wrap bracket 14 and the upper house wrap bracket 22 whereby the lower house wrap bracket 14 and the upper house wrap bracket 22 are each stationary being removably attached temporarily to the location(s) on the exterior wall 78 of the stable structure 76, residential building, or commercial building, and thereby the roll of house wrap 70 is supported conjointly by the lower house wrap bracket 14 and the upper house wrap bracket 22 whereby the single user is enabled to unroll the house wrap from the roll of house wrap 70 horizontally in a continuous even stream without the risk of dropping the roll of house wrap 70 during the installation of the house wrap where the roll of house wrap 70 maybe damaged and lose its effectiveness to prevent the migration of moisture, water, or air into the exterior wall surfaces and exterior structures. In current house wrap installation systems or water-resistive barrier wrap systems, the weight of the roll of house wrap 70 is generally supported by the user or installer that is positioned on the ground during installation of the house wrap on the exterior wall(s) 78 of the stable structure 76, residential building or the commercial building. This can be fatiguing to the user and can result in various injuries or misapplication of the roll of house wrap 70. Misapplication of the roll of house wrap 70 reduces the house wrap's effectiveness in preventing moisture and air migrating into the exterior wall(s) 78 and exterior wall structures. The roll of house wrap 70 may be difficult to handle and is, on occasion, dropped and damaged resulting in loss of installation time and, in some cases, the loss of the roll of house wrap 70. In addition, the lower house wrap bracket 14 and the upper house wrap bracket 22 being removably affixed to the one or more locations on the exterior wall(s) 78 of the stable structure 76, residential building or commercial building allows for a single user or installer to wrap the house wrap thereby reducing the cost of employment and risk of injury; the elimination of the need of a second or third person at the bottom end of the roll of house wrap 70 to support the full weight of the roll of house wrap 70 or the water-resistive barrier wrap; and reducing the likelihood of dropped and damaged rolls of house wrap 70 because with the and the upper house bracket 22 and the exterior wall(s) 78 of the stable structure 76, the residential building or the commercial building.

The house wrap dispenser 12 provides an advantage by way of the two independent lower house wrap brackets, the lower house wrap bracket 14 operably configured with the upper house wrap bracket 22 by shifting the weight of the roll of the house wrap 70 from the single user to the lower house wrap bracket 14 and the upper house wrap bracket 22 as each are removably attached to the exterior wall area of the exterior wall 78 in a stationary position. Thereby, the roll of house wrap 70 cannot sway, wobble or swing any more between the lower non-rotatable dowel 20 and the upper non-rotatable dowel 28 and can thus be unrolled horizontally from the conjoint supporting lower non-rotatable dowel 20 and the upper non-rotatable dowel 28 in an even wrapping plane as the roll of house wrap 70 is affixed to the exterior wall 78 of the stable structure 76, residential building or commercial building by the user.

In addition, the two independent house wrap brackets, the lower house wrap bracket 14 and the upper house wrap bracket 22 provides another advantage whereby the lower house wrap bracket 14 and the upper house wrap bracket 22 can be removed from one location on the exterior surface of the exterior wall 78 of the stable structure 76, residential building or commercial building, and moved to another location of the exterior wall 78 of the stable structure 76, residential building or commercial building to continue the process of wrapping the exterior wall 78 of the stable structure 76, residential building or commercial building in an upper area of the exterior wall 78 of the stable structure 76, residential building or commercial building.

In addition, a second roll of house wrap $\mathbf{70}^2$, when needed, can be installed quickly and exactly on the lower non-rotative dowel 20 of the lower house bracket 14, and, subsequently, on the upper non-rotative dowel 28 of the upper house wrap bracket 22. Further, the lower house wrap bracket 14 together with the upper house wrap bracket 22 support the roll of house wrap 70 rather than the single user supporting the roll of house wrap 70 while wrapping the lower and upper portions of the exterior wall(s) 78 of the stable structure 76, residential building or commercial building which is a critical advantage provided by the embodiment of the invention.

The house wrap dispenser 12 including the lower house wrap bracket 14 and the lower wall plate 16, the lower base plate 18, and the lower non-rotative dowel 20, and the upper house wrap bracket 22 including the upper wall plate 24, the upper base plate 26, and upper non-rotative dowel 28 can be customized in size, shape, and configuration adapted to the dimensions of the variety of selected rolls of house wrap 70 that are commercially available through commercial manufacturers, as noted above.

The first number of symmetrically parallel lower unthreaded anchor holes $\mathbf{100}^{1+n}$ and the symmetrically parallel second number of upper unthreaded anchor holes $\mathbf{104}^{1+n}$ disposed in the lower wall plate 16 and the upper wall plate 24, respectively, together, with the installation of the at least two removable fasteners $\mathbf{40}^{1+n}$ to removably attach, detach, and reattach the lower house wrap bracket 14 and the upper house wrap bracket 22 of the house wrap dispenser 12 to the various locations or the exterior wall areas of the stable structure 76, residential building, or commercial building allows for the critical advantage of a releasable connection to the various locations, or exterior wall areas on the exterior wall(s) 78 allowing for the temporary placement of the house wrap dispenser 12, as needed during use, while the single user installs the house wrap from one location to the next, or one exterior wall area to the next, during the progression of the installment of the house wrap on the various wall locations or exterior wall area(s) without the assistance of a second user.

In addition, such an embodiment of the symmetrically parallel lower unthreaded anchor holes $\mathbf{100}^{1+n}$ and the symmetrically parallel upper unthreaded anchor holes $\mathbf{104}^{1+n}$ disposed in one or more rows with the installation of the at least two removable fasteners $\mathbf{40}^{1+n}$, provides for additional security by preventing unwanted movement of the lower wall plate 16 of the lower house wrap bracket 14 and the upper wall plate 24 of the upper house wrap bracket 22 and, thereby, preventing any swaying or uneven unrolling of the house wrap while the single user is unrolling the roll of house wrap 70 horizontally from the house wrap dispenser 12 to the various locations or exterior wall areas of the exterior wall 78 of the stable structure 76, residential building or commercial building. In addition, such an embodiment may allow for a secured connection under increased loads of house wrap by providing more points of contact between the lower wall plate 16 and the upper wall plate 24 and the various locations or exterior wall areas of the exterior wall 78 of the stable structure 76, residential buildings, and commercial buildings.

While the embodiment discloses, as illustrated in FIGS. 1-3, six lower unthreaded anchor holes $\mathbf{100}^{1+n}$ and six upper unthreaded anchor holes $\mathbf{104}^{1+n}$ removably attached with six removable fasteners 40 of the at least two removable fasteners $\mathbf{40}^{1+n}$ including the right lower unthreaded anchor holes $\mathbf{100}^{R1+R3}$ and left lower anchor holes $\mathbf{100}^{L1+Ln}$ and right upper anchor holes $\mathbf{104}^{R1+R3}$ and left upper anchor holes $\mathbf{104}^{L1+Ln}$, positioned equidistant from the lower wall plate 16 medial axis 30 and upper wall plate 24 medial axis 32, respectively, it should be appreciated that any other number of two or more lower unthreaded anchor holes $\mathbf{100}^{1+n}$ in a series of one or more rows and corresponding removable fasteners $\mathbf{40}^{1+n}$ of the at least two removable fasteners $\mathbf{40}^{1+n}$ may be employed in an embodiment. In another embodiment, the lower wall plate 16 and the upper wall plate 24 may incorporate eight or more unthreaded anchor holes symmetrically disposed within the lower wall plate 16 and the upper wall plate 24.

As can be appreciated by the one skilled in the art to which the invention pertains, many modifications to the embodiment of the house wrap dispenser apparatus 10 can be disclosed in other embodiments, including, the lower non-rotative dowel 20 diameter, the lower non-rotative dowel 20 length, the upper non-rotative dowel 28 diameter and the upper non-rotative dowel 28 length, can be sized to receive any one of a variety of rolls of house wrap 70 or water-resistive barrier-wrap having a variety of cylindrical core diameters, lengths and surface areas. Further, the lower wall plate 16 and the upper wall plate 24, can be sized to support a variety of lengths and diameters of lower non-rotative dowels 20 and upper non-rotative dowels 28.

Figure 10A:
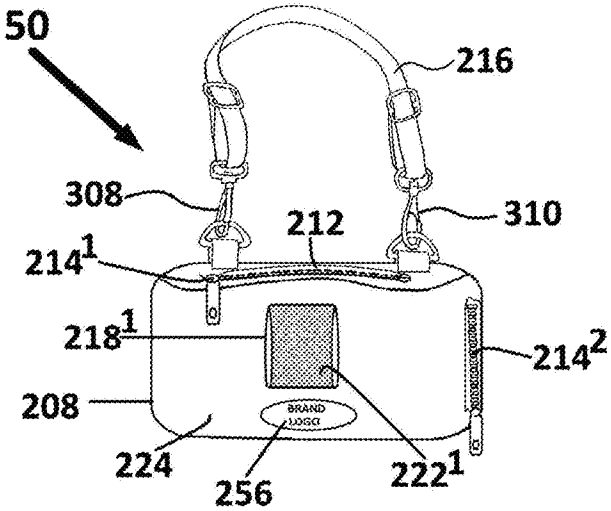
FIG. 10A is a perspective view towards a front face of a bag of the house wrap dispenser apparatus of FIG. 1.
Figure 10B:
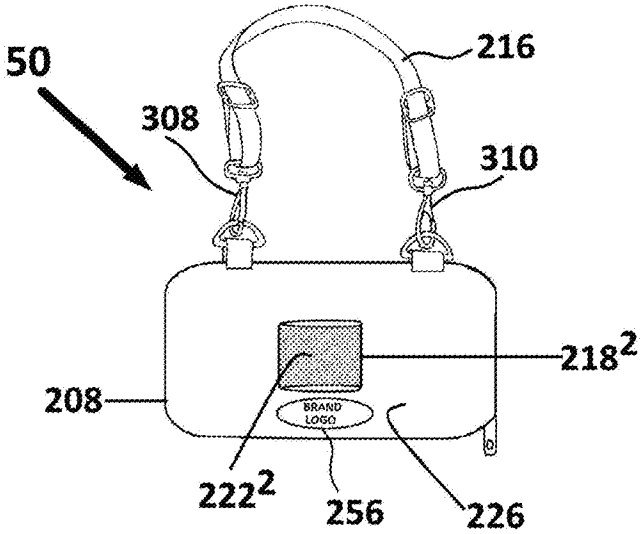
FIG. 10C is another embodiment of the bag of FIG. 10A.
FIG. 10D is a perspective view towards the bottom face of the bag of FIG. 10A.

The house wrap dispenser apparatus kit 200 further includes the bag 50, as illustrated in FIGS. 1 and 6 and FIGS. 10A-10D. FIG. 10 A illustrates a perspective view towards a front face 224 of the bag 50. FIG. 10B is a perspective view towards a rear face 226 of the bag 50 of FIG. 10A.

Figure 10C:
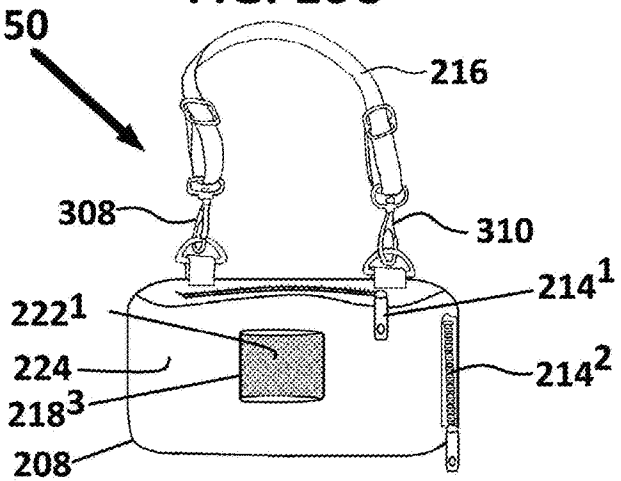
Figure 10D:
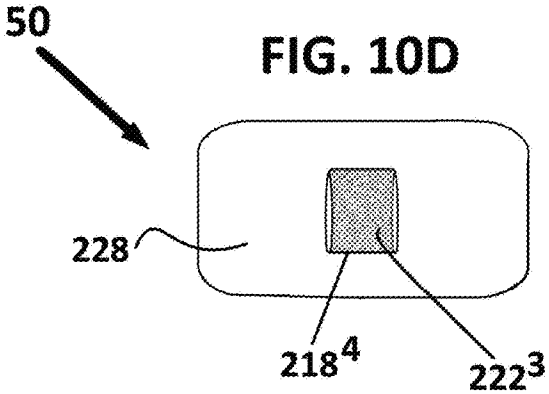

FIG. 10C is another embodiment of the bag of FIG. 10A. FIG. 10D is a perspective view towards the bottom face 228 of the bag of FIG. 10A.

As illustrated in FIG. 10A, the bag 50 comprises a flexible pouch 208 sized to enclose and contain the at least two removable fasteners $\mathbf{40}^{1+n}$ where each of the at least two removable fasteners $\mathbf{40}^{1+n}$ is depicted with the numeral 40. The flexible pouch 208 includes one or more fastenable openings 212 sized to allow each of the at least two removable fasteners $\mathbf{40}^{1+n}$ to pass through the one or more fastenable openings 212. The bag 50 includes one or more fasteners 214 adapted to close the one or more fastenable openings 212 of the flexible pouch 208 of the bag 50 wherein the one or more fasteners 214 of the fastenable openings 212 of the flexible pouch 208 of the bag 50 are selected from the group consisting of zippers, magnetic closure, hook and loop, and snaps.

The bag 50, also, includes a brand logo 256 disposed on one or more exterior surfaces of the bag 50.

The bag 50, further, includes an adjustable strap 216 where the single user can implement the bag 50 containing the at least two removable fasteners $\mathbf{40}^{1+n}$ having the bag 50 suspended around the user as in a cross-body fashion. The adjustable strap 216 includes two terminal tear drop push gate snap hook clasps, a first terminal tear drop push gate clasp 308 and a second terminal tear drop push gate clasp 310 whereby the adjustable strap 216 can be removed by the user such that the user can utilize one or more wrist bands $\mathbf{218}^{1+n}$ each of which are disposed on multiple faces of the bag 50, as detailed above.

Each of the wrist bands $\mathbf{218}^{1-4}$ of the one or more wrist bands $\mathbf{218}^{1+n}$ is formed stretchable for placing any one of the wrist bands $\mathbf{218}^{1-4}$ around the single user's wrist. Each of the wrist bands $\mathbf{218}^{1-4}$ is constructed having a magnetic member 222 disposed on a peripheral surface of the wrist band 218" operable to temporarily hold thereon one or more of the at least two removable fasteners $\mathbf{40}^{1+n}$ while the single user is installing the house wrap dispenser 12 to the exterior wall 78 of the stable structure 76. A first wrist band 218, as shown in FIG. 10A, is fixed to the bag 50 on the exterior surface of a front face 224 of the bag 50, wherein the first wrist band $\mathbf{218}^{1}$ is positioned in a vertical orientation, a second wrist band $\mathbf{218}^{2}$ is fixed to a rear face 226 of the bag 50, wherein the second wrist band $\mathbf{218}^{2}$ is positioned in a horizontal orientation, and a third wrist band $\mathbf{218}^{3}$ which is positioned on the front face 224 of the bag in a horizontal orientation, and fourth wrist band $\mathbf{218}^{4}$ which is fixed to a bottom face 228 of the bag 50, in a vertical orientation. Each of the wrists bands $\mathbf{218}^{1-4}$ can be fixed to an external surface of the bag 50 in a horizontal or a vertical orientation. In this manner, the single user being left handed or right handed may implement any one of the wrist bands $\mathbf{218}^{1+n}$ in lieu of the adjustable strap 216 to hold the bag 50 containing the at least two removable fasteners $\mathbf{40}^{1+n}$ in a comfortable position around the user's wrist and to temporarily hold one or more of the at least two removable fasteners $\mathbf{40}^{1+n}$ on the magnetic member 222 of the wrist band while the single user is installing the house wrap dispenser 12 on the exterior wall 78 of the stable structure 76.

The driver 60, as illustrated in FIG. 1, and in FIG. 6 in the house wrap dispenser apparatus kit 200 comprises a driver head 230 and a driver body 232, the driver head 230 operatively configured with a magnetic portion 234 disposed therein a peripheral surface of the driver head 230. The magnetic portion 234 is magnetically attracted to the one or more of the at least two removable fasteners $\mathbf{40}^{1+n}$.

The house wrap dispenser apparatus kit 200, further, includes the house wrap dispenser apparatus instruction sheet 210 for the single user. The house wrap dispenser apparatus instruction sheet 210 including diagrams and figures of drawings of a method of use $\mathbf{600}^{601-608}$ by a single user when installing the roll of house wrap 70 on the exterior wall 78 of the stable structure 76, a warranty 238, and a help line phone number 240, a warranty; and a help line phone number.

Figure 11:
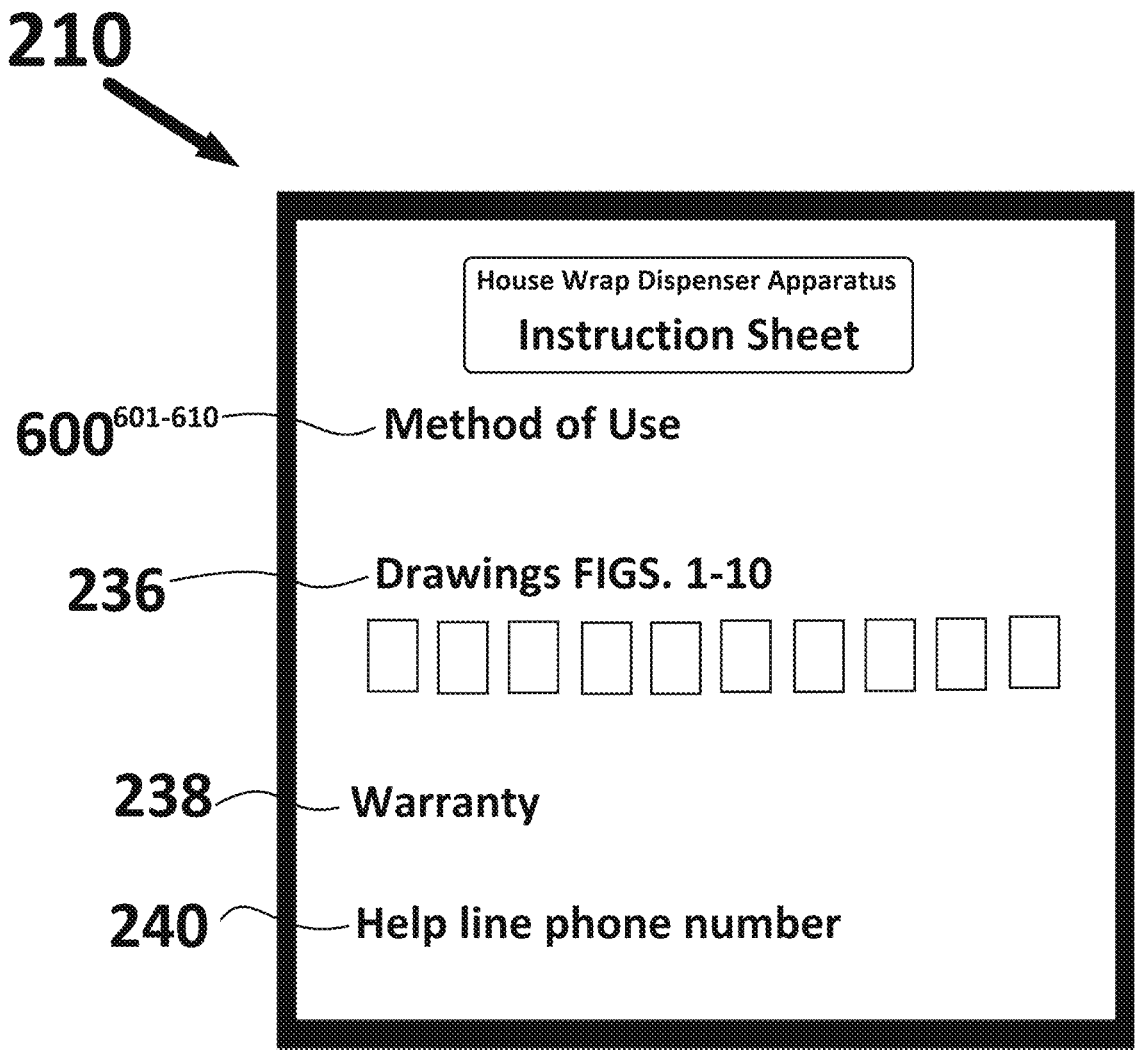
FIG. 11 is an illustration of the house wrap dispenser apparatus instruction sheet of the house wrap dispenser apparatus kit of FIG. 6.

The house wrap dispenser apparatus instruction sheet 210, as illustrated in FIG. 11, with reference to FIGS. 3-5B, includes the method of use $\mathbf{600}^{601-610}$ of the house wrap dispenser apparatus 10 along with copies of the drawings of the FIGS. 1-10, as indicated at 236, a warranty 238, and a help line phone number 240. The process of the method of use $\mathbf{600}^{601-610}$ of the house wrap dispenser apparatus 10 comprising providing the stable structure 76 including the exterior wall(s) 78, at step 601, providing the roll(s) of house wrap 70 at step 602, providing the house wrap dispenser kit 200 including the house wrap dispenser 12, the bag 50 containing the at least two removable fasteners $\mathbf{40}^{1+n}$, the driver 60, the house wrap dispenser apparatus instruction sheet 210, and the house wrap dispenser carrying case 220, at step 603; removably attaching the lower house wrap bracket 14 to the first exterior wall area 80 of the exterior wall 78 of the stable structure 76 by means of the at least two removable fasteners $\mathbf{40}^{1+n}$ inserted therethrough each of the lower unthreaded anchor holes $\mathbf{100}^{1+n}$, and actuated by the driver 60 to engage with the first exterior wall area 80, at step 604, mounting the roll of house wrap 70 onto the lower non-rotative dowel 20 by inserting the distal end 106 of the lower non-rotative dowel 20 into the bottom open end 74 of the hollow cylindrical core 70" of the roll of house wrap 70 whereby the lower non-rotative dowel 20 occupies a lower portion of the roll of house wrap 70 at step 605; mounting the roll of house wrap 70 onto the upper non-rotative 28 by inserting the distal end 66 of the upper non-rotative dowel 28 into top open end 72 of the roll of house wrap 70, at step 606; removably affixing the upper wall bracket 22 to the second exterior wall area 82 of the exterior wall 78 of the stable structure 76 by means of the of the at least two removable fasteners $\mathbf{40}^{1+n}$ inserted therethrough each of the upper unthreaded anchor holes $\mathbf{104}^{1+n}$, and actuated by the driver 60 to engage with the second exterior wall area 82, whereby the upper non-rotative dowel 28 is coaxial with the lower non-rotative dowel 20 at step 607 whereby the lower non-rotative dowel 20 and the upper non-rotative dowel 28 are conjointly supporting the roll of house wrap 70 in an upright orientation; unrolling the house wrap in an horizontal direction and affixing the house wrap via stapling and/or nailing to the exterior wall 78 of the stable structure 76, until the house wrap roll 70 is depleted of house wrap, at step 608; detaching the lower house wrap bracket 14 and detaching the upper house wrap bracket 22 from the exterior wall 78, at step 609; dismounting the hollow cylindrical core 70' of the depleted roll of house wrap 70 from the lower non-rotative dowel 20 and the upper non-rotative dowel 28, at step 610; repeating method process $\mathbf{600}^{601-610}$ to a second location on the exterior wall(s) 78 of the stable structure 76, wherein providing a second roll of house wrap $\mathbf{70}^2$, and repeating the process until completion of the user nailing or stapling the house wrap on the exterior walls 78 of the stable structure 76.

The house wrap dispenser apparatus kit 200, also, includes, the house wrap dispenser apparatus carrying case 220, as illustrated in FIGS. 6-9B for transporting and storing the house wrap dispenser 12, including the lower house wrap bracket 14, the upper house wrap bracket 22, the bag 50 containing the at least two removable fasteners $\mathbf{40}^{1+n}$, the driver 60, and the house wrap dispenser apparatus instruction sheet 210 for the single user.

Figure 7:
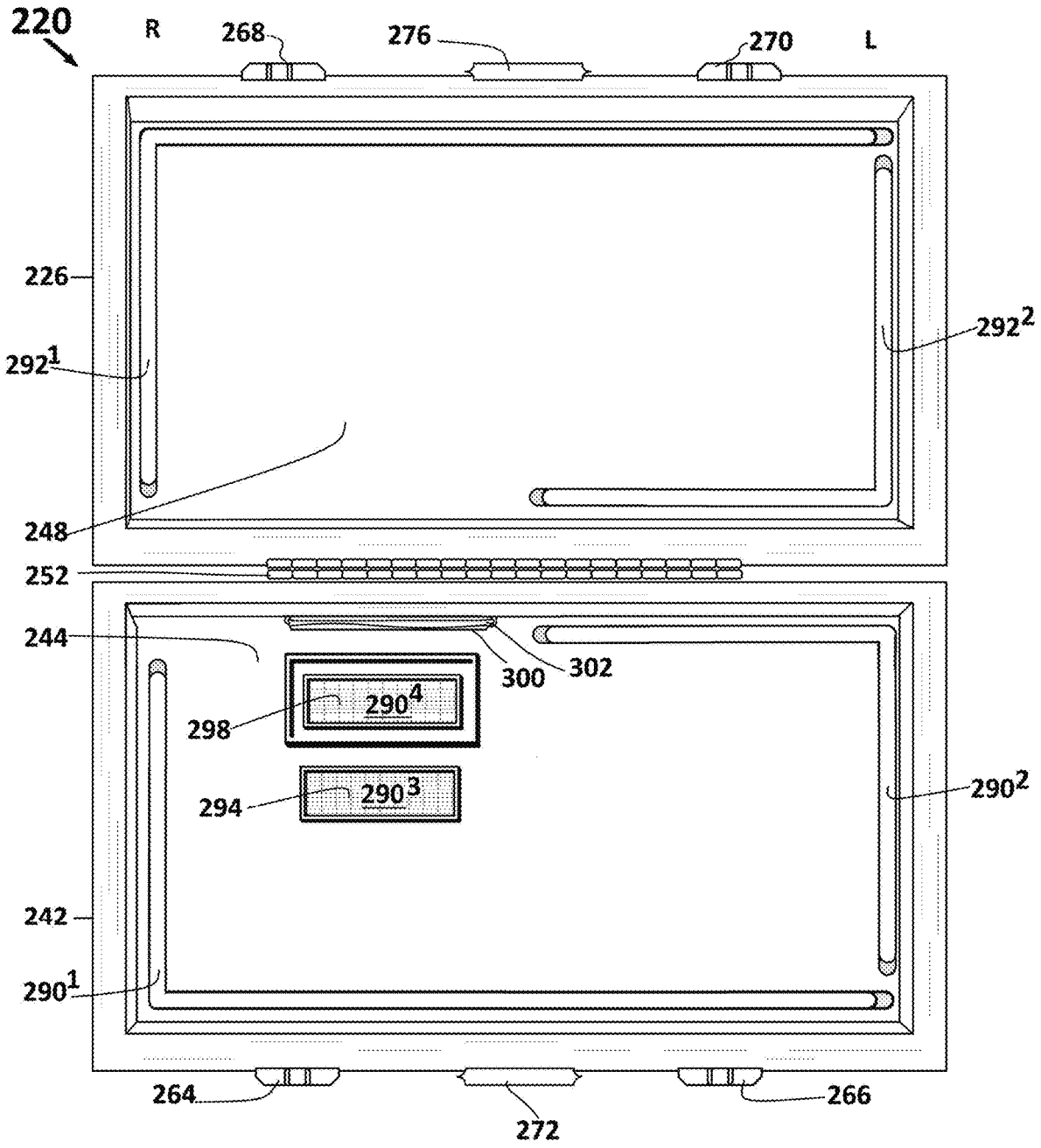
FIG. 7 is a perspective view of an interior of a house wrap dispenser apparatus carrying case.
Figure 8:
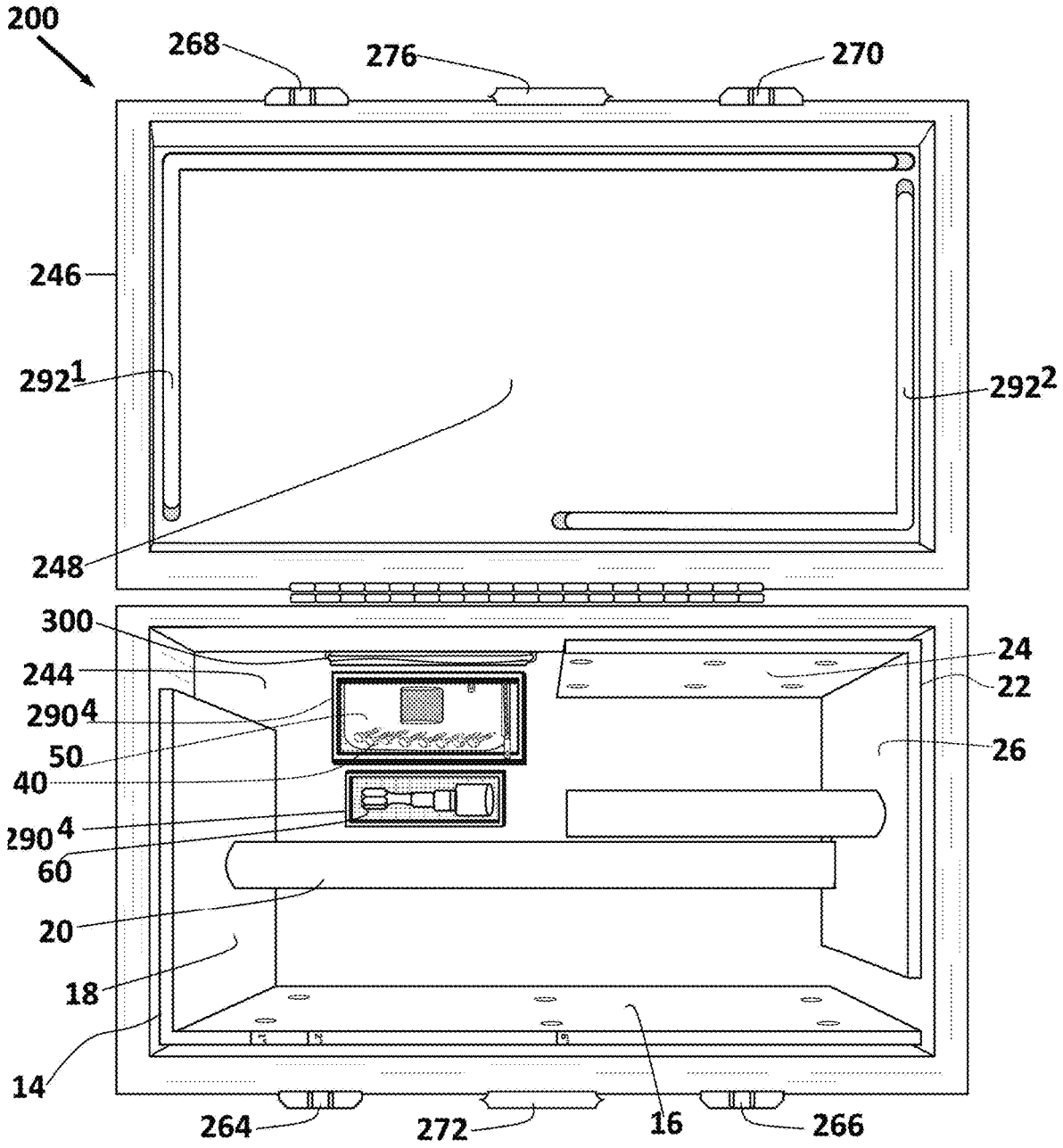
FIG. 8 is a perspective view of the interior of the house wrap dispenser apparatus carrying case of FIG. 7, containing the house wrap dispenser apparatus of FIG. 6.

FIG. 6 illustrates a perspective view of the house wrap dispenser apparatus carrying case 220 of the house wrap dispenser apparatus kit 200. FIG. 7 illustrates a perspective view of an interior of the house wrap dispenser apparatus carrying case 220. FIG. 8 is a perspective view of the interior of the house wrap dispenser apparatus carrying case 220 containing the house wrap dispenser apparatus 10, including the house wrap dispenser 12 including the lower house wrap bracket 14, the upper house wrap bracket 22, the dowel 60, and the bag 50 containing the at least two removable fasteners $\mathbf{40}^{1+n}$.

In particular, as illustrated in FIGS. 6-8, the house wrap dispenser apparatus carrying case 220 includes a main body 242 having an elongated box shape, the main body 242 including a bottom interior storage portion 244 and a lid member 246 with an elongated box shape sized to correspond to the elongated box shape of the main body 242. The lid member 246 includes a top interior storage portion 248.

In this embodiment, the lid member 246 and the main body 242 of the house wrap dispenser apparatus carrying case 220 are made with substrates selected from the group of substrates consisting of molded polymer resin and plastic. In another embodiment the house wrap dispenser apparatus carrying case 220 lid member 246 and the main body 242 of the comprise a hard wood. In another embodiment the lid member 246 and the main body 242 of the house wrap dispenser apparatus carrying case 220 are made with substrates selected from the group of substrates consisting of metal, steel and aluminum. In another embodiment the house wrap dispenser apparatus carrying case 220 is made with a flexible material.

Figure 9B:
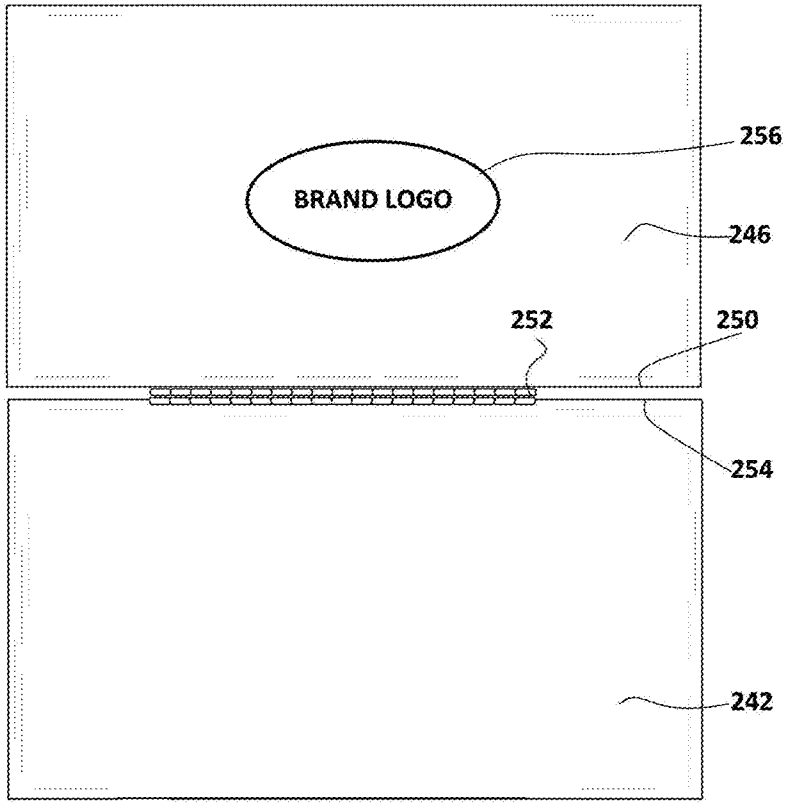
FIG. 9B is a perspective view towards a rear face of the house wrap dispenser apparatus carrying case of FIG. 9A.

The lid member 246 includes a rear edge 250, as illustrated in FIG. 9B, which is hingedly connected by at least one shaft 252 to a rear edge 254 of the main body 242 at corresponding portions of a first peripheral rear surface of the lid member 246 and a second peripheral rear surface of the main body 242 whereby the lid member 246 and the main body 242 are operable for movement between a closed position and an open position. The lid member 246 includes an outer surface which includes a brand logo 256 placed thereon facing outward when the bottom interior storage portion 244 of the main body 242 is closed by the lid member 246.

Figure 9A:
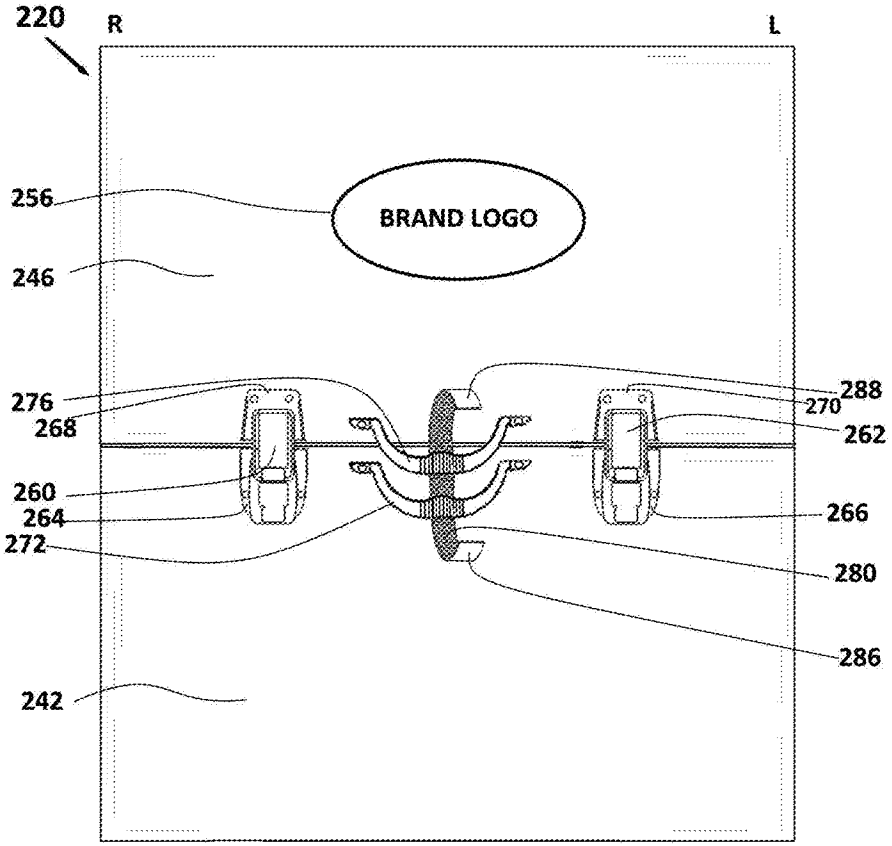
FIG. 9A is a perspective view towards a front face of the house wrap dispenser apparatus carrying case of FIGS. 6 and 7 showing a lid member and a main body.

FIG. 9A illustrates the house wrap dispenser apparatus carrying case 220 includes a locking mechanism 258 having two latches including a right latch 260 and a left latch 262, wherein the main body 242 is provided with a right latch body portion 264 and a left latch body portion 266 positioned on a right peripheral surface of the main body 242 and at a left peripheral surface of the main body 242, respectively, configured to be engageable with a right latch lid portion 268 and a left latch lid portion 270 positioned on a corresponding right peripheral surface and a left peripheral surface of the lid member 246, respectively, and wherein when being engaged the lid member 246 is locked in a position that the open bottom interior storage portion of the main body 242 is closed by the lid member 246, as shown in FIGS. 9A-9B.

Further, as illustrated in FIGS. 9A-9B, the house wrap dispenser apparatus carrying case 220 includes a first handle 272, having a first opening 274, affixed to a peripheral front surface of the lid member 246, by means of a fastener means including nails or screws, centered between the right latch lid portion 268 and the left latch lid portion 270, and a second handle 276, affixed to a peripheral front surface of the main body 242 by means of a fastener means including nails or screws, having a second opening 278, centered between the right latch body portion 264 and the left latch body portion 266.

A strap 280, as illustrated in FIG. 9A, is implemented to facilitate maintaining the first handle 272 and the second handle 276 together during transport of the house wrap dispenser apparatus carrying case 220 to ensure the lid member 246 does not separate from the main body 242 in the event the right latch 260 and the left latch 262 are not secured. The strap 280 includes two ends and a length therebetween, a first end 282 and a second end 284, the strap 280 fixedly fastened to the first handle 272 and the second handle 276 whereby the strap 280 is deployable between the first opening 274 of the first handle 272 and therethrough the second opening 278 of the second handle 276 to fixedly secure the first handle 272 and the second handle 276 contiguous to each other during transportation and storage, wherein the first end 282 includes an incipient magnetic element 286 having a first polarity and the second end 284 includes a terminal magnetic element 288 having a second polarity opposite to the first polarity whereby the first end 282 of the strap 280 is attracted to the second end 284 of the strap 280.

The bottom interior storage portion 244, as illustrated in FIGS. 6-8, of the main body 242 of the house wrap dispenser apparatus carrying case 220 includes a bottom interior recessed stage fabricated with a number of bottom sunken seated areas $\mathbf{290}^{1+n}$, and the top interior storage portion 248 of the lid member 246 includes a top interior recessed stage fabricated with a number of top sunken seated areas $\mathbf{292}^{1+n}$ The number of bottom sunken seated areas $\mathbf{290}^{1+n}$ includes a first bottom sunken seated area $\mathbf{290}^1$ having a first L-shape integrally sculpted and sized to receive and urge a peripheral right side edge of the lower house wrap bracket 14 into the first bottom sunken seated area $\mathbf{290}^1$, and the top interior storage portion 248 of the lid member 246 includes a corresponding first top sunken seated area $\mathbf{292}^1$ having a second L-shape integrally sculpted and sized in a mirror image of the first L-shape of the first bottom sunken seated area $\mathbf{290}^1$ to receive and urge a peripheral left side edge of the lower house wrap bracket 14 into the first top sunken seated area $\mathbf{292}^1$ wherein when the main body 242 is closed by the lid member 246.

The bottom interior storage portion 244 of the main body 242 of the house wrap dispenser apparatus carrying case 220, further includes, a second bottom sunken seated area $\mathbf{290}^2$ having a first inverted L-shape, as illustrated in FIGS. 6-8, integrally sculpted and sized to receive and urge a peripheral right side edge of the upper house bracket 22 into the second bottom sunken seated area $\mathbf{290}^2$, and the top interior storage portion 248 of the lid member 246 includes a corresponding second top sunken seated area $\mathbf{292}^2$ having a second inverted L-shape integrally sculpted and sized in a mirror image of the first inverted L-shape of the second bottom sunken seated area 290$^2$ to receive and urge a left peripheral side edge of the upper house wrap bracket 22 into the second top sunken seated area 292$^2$ whereby the lower house wrap bracket 14 and the upper house wrap bracket 22 are removably seated within the house wrap dispenser apparatus carrying case 220 having the lower non-rotative dowel 20 congruent with the upper non-rotative dowel 28 wherein when the main body 242 is closed by the lid member 246.

The bottom interior storage portion 244 of the main body 242 and the top interior storage portion of the lid member 246 of the house wrap dispenser apparatus carrying case 220 can be sized and configured with a variety of bottom sunken seated areas 290$^{1+n}$ and top sunken seated areas 292$^{1+n}$ to seat a variety of house wrap dispensers 12, bags 50, at least two removable fasteners 40$^{1+n}$, drivers 60, and house wrap dispenser apparatus instruction sheets 210 of varying sizes.

The bottom interior storage portion 244 of the main body 242 of the house wrap dispenser apparatus carrying case 220, further, includes a third bottom sunken seated area 290$^3$, as illustrated in FIGS. 6-8, having an elongated rectangular shape integrally sculpted and sized to urge the driver 60 therein, the third bottom sunken seated area 290$^3$ having a floor and side walls layered with a first magnetic membrane 294 whereby the magnetic portion 234 of the driver head 230 is magnetically attracted to the magnetic membrane 294.

The bottom interior storage portion 244 of the main body 242 of the house wrap dispenser apparatus carrying case 220, further includes a fourth bottom sunken seated area 290$^4$, as illustrated in FIGS. 6-8, which is configured in a geometric shape integrally sculpted and sized to urge the bag 50 having the at least two removable fasteners 40$^{1+n}$ contained therein. The fourth bottom sunken seated area 290$^4$ includes a geometric shaped floor and geometric shaped side walls, wherein the geometric floor is layered with a second magnetic membrane 298 such that the bag 50 is orientated in an upright position and whereby the at least two removable fasteners contained therein 40$^{1+n}$ are pulled by the second magnetic membrane 298 to a bottom interior region of the bag 50. The at least two removable fasteners 40$^{1+n}$ includes a number of at least two removable fasteners 40$^{1+n}$ that is greater in number than the first number of lower unthreaded anchor holes 100$^{1+n}$ and the second number of upper unthreaded anchor holes 104$^{1+n}$ where it is foreseeable that any number of the at least two removable fasteners 40$^{1+n}$ may be misplaced or lost in the process of installing the house wrap to the exterior wall(s) 78 of the stable structure 76, the residential building or the commercial building.

The bottom interior storage portion 244 of the main body 242 of the house wrap dispenser apparatus carrying case 220 includes an expandable pocket 300 fabricated on an interior side edge of the main body 242. The expandable pocket 300 includes a top opening 302 having an elasticized top rim to provide access to an interior cavity, a front face surface having a transparent window 304. The interior cavity includes a volume capable of maintaining the house wrap dispenser apparatus instruction sheet 210 therein.

As can be appreciated by the one skilled in the art to which the invention pertains, many modifications to the embodiment of the house wrap dispenser apparatus kit 200 can be disclosed in other embodiments, including in the house wrap dispenser apparatus kit 200 a roll of house wrap tape, a cutting tool, face masks, work gloves, additional drivers, goggles, measuring tools, anti-septic lotion, bandaides. In addition, house wrap dispenser apparatus carrying case 220 can be customized and configured with the bottom interior storage portion 244 to include the bottom interior recessed stage fabricated with a variety of a sized bottom sunken seated areas 290$^{1+n}$ to accommodate various sizes of the lower house wrap bracket 14 and the upper house wrap bracket 22 and the top interior storage portion 248 of the lid member 246 to include top interior recessed stage fabricated with a number of top sunken seated areas 292$^{1+n}$ that correspond to the number of bottom sunken seated areas 290$^{1+n}$ to receive and store the various sized lower house wrap bracket 14 and the various sized corresponding upper house wrap brackets 22.

In another embodiment of the invention, as illustrated in FIGS. 12-16B there is disclosed a water-resistive barrier wrap dispenser apparatus 400 adapted to use with a selected roll of a water-resistive barrier wrap 140 of one or more rolls of the water-resistive barrier wrap 140 on the exterior wall 78 of one or more exterior walls of a stable structure 76, residential building or a commercial building, the exterior wall 78 having a longitudinal axis 84, the roll of the water-resistive barrier wrap 140 or the roll of house wrap 70 having a given length, and a hollow cylindrical core 70' limited by a top open end 72, a bottom open end 74, and a cylindrical core diameter.

Figure 12:
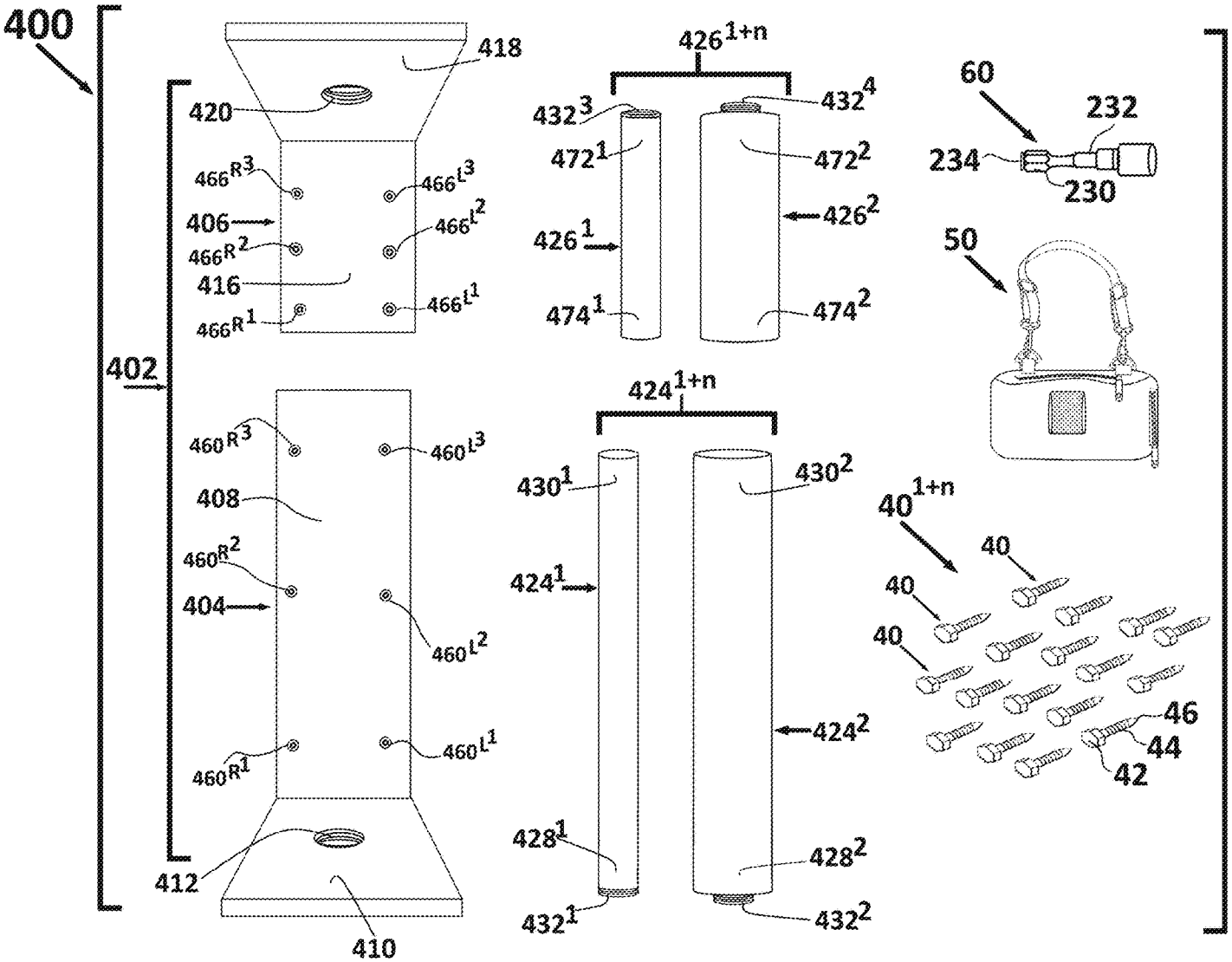
FIG. 12 is a perspective view of an embodiment of a water-resistive barrier wrap dispenser apparatus.

FIG. 12 illustrates a perspective view of the water-resistive barrier wrap apparatus 440. The water-resistive barrier wrap dispenser apparatus 400 includes a water-resistive barrier wrap dispenser 402, as illustrated in FIGS. 12-16B, comprising a set of two independent barrier wrap brackets including a lower barrier wrap bracket 404 operatively associated with an upper barrier wrap bracket 406, a multiplicity of threaded dowels 446$^{1+n}$, including a first set of lower threaded dowels 424$^{1+n}$, a second set of upper threaded dowels 426$^{1+n}$, at least two removable fasteners 40$^{1+n}$, wherein each individual removable fastener of the at least two removable fasteners 40$^{1+n}$ is designated with the numeral 40, a bag 50, and a driver 60.

With such an embodiment, the user is able to select a roll of water-resistive barrier wrap 140 or select a roll of house wrap 70 to install and affix to the exterior wall 78 of a particular stable structure 76, residential building, or commercial building, that the user is installing the water-resistive barrier wrap 140. Further, the user is able to select a lower threaded dowel 424 from the first set of lower threaded dowels 424$^{1+n}$, and select an upper threaded dowel 426 from the second set of upper threaded dowels 426$^{1+n}$ where each of the selected lower threaded dowel 424 and the upper selected dowel 426 includes a diameter that is fitting with the cylindrical core diameter of the selected roll of water-resistive barrier wrap 140 whereby the selected lower threaded dowel 424 can readily be inserted into a lower portion of the selected roll of water-resistive barrier wrap 140 and the selected upper threaded dowel 426 can readily be inserted into a top portion of the selected roll of water-resistive barrier wrap 140. Consistent in this manner, the embodiment embraces the following terms: a selected roll of water-resistive barrier wrap 140, a selected lower threaded dowel 424 selected from the multiplicity of threaded dowels 446$^{1+n}$ including a first set of lower threaded dowels 424$^{1+n}$, and a selected upper threaded dowel 426 selected from the second set of upper threaded dowels 426$^{1+n}$.

Further, such an embodiment, can include a variety of sizes of lower barrier wrap brackets 404 and a variety of sizes of upper barrier wrap brackets 406 wherein the lower barrier wrap bracket includes a lower wall plate 408 having a lower wall plate length, a lower wall plate width, and a lower wall plate depth, a lower base plate 410 having a lower base plate side length, a lower base plate width, an upper wall plate 416 having an upper wall plate length, an upper wall plate width, and an upper wall plate depth, an upper base plate 418 having a side edge length and front edge width that is fitting with any one of the multiplicity of threaded dowels $\mathbf{446}^{1+n}$. Further, the lower barrier wrap bracket 404 and the upper barrier wrap bracket 406 can be configured having the lower wall plate 408 and the upper wall plate 416 in a variety of sizes of lengths, widths, and depths, the lower base plate 410 and the upper base plate 418 can be configured having a variety of side lengths, widths, and depths, and a first threaded annular anchor hole 412 and a second threaded annual anchor hole 420 configured having a variety of sizes of diameters and threads.

The selected rolls of water-resistive barrier wrap 140 are available from commercial manufacturers, distributors and suppliers commercially where the selected rolls of water-resistive barrier wrap 140 and the selected rolls of house wrap 70 are used to install on the exterior wall 78 of one or more exterior walls of the stable structure 76, residential building or a commercial building. Such house wraps and/or water-resistive barrier wraps for residential buildings and commercial buildings can include, by way of example, Grade D building paper, asphalt-saturated kraft paper, building felt, polymeric house wrap. Known polymeric house wraps for use as weather-resistive barriers or house wraps include, spunbond polyethelene sheet available under the trade name DuPont TYVEK® HOMEWRAP® and TYVEK® STUCCOWRAP® from E.I. du Pont de Nemours & Co., Wilmington, Del.; BARRICADE® from Barricade Building Products, Doswell, Va.; polyolefin nonwoven sheet available under the trade name STYROFOAM™ WEATHERMATE™ PLUS from the Dow Chemical Company, Midland, Mich.; spunbonded polypropylene-microporous film laminate available under the trade woven polypropylene sheet with a perforated coating available under the trade name Pinkwrap® from Owens Corning, Corning, N.Y. The space between the two layers provides a drainage space for any liquid water that penetrates the outer layer, and Everbuilt a Home Depot Product Authority, by way of example, but not an exhaustive list.

The lower barrier wrap bracket 404 includes a lower wall plate 408 having a first elongated rectangular plane conjoined to a lower base plate 410 at a right angle having a first horizontal plane such that the lower barrier wrap bracket 404 is configured in a L-shape. The lower base plate 410 includes a first threaded annular anchor hole 412 sculpted therethrough a central portion of a top surface 414 of the lower base plate 410.

The upper barrier wrap bracket 406, as illustrated in FIGS. 12-16B, includes an upper wall plate 416 having a second elongated rectangular plane conjoined to an upper base plate 418 at a right angle having a second horizontal plane such that the upper barrier wrap bracket 406 is configured in an inverted L-shape. The upper base plate 418 includes a second threaded annular anchor hole 420 sculpted therethrough a central portion of a bottom surface 422 of the upper base plate 418.

The water-resistive barrier wrap dispenser 402 includes a multiplicity of threaded dowels $\mathbf{446}^{1+n}$, as illustrated in FIG. 12, including a first set of lower threaded dowels $\mathbf{424}^{1+n}$ and a second set of upper threaded dowels $\mathbf{426}^{1+n}$ wherein each of the lower threaded dowels $\mathbf{424}^{1+n}$ and the upper threaded dowels $\mathbf{426}^{1+n}$ includes an outer diameter which is less than the cylindrical core diameter of the selected roll of water-resistive barrier wrap 140 of the one or more rolls of the water-resistive barrier wrap.

As illustrated in FIGS. 12 and 14-16B, each of the first set of the lower threaded dowels $\mathbf{424}^{1+n}$ includes a proximal end $\mathbf{428}^{1+n}$ and a distal end $\mathbf{430}^{1+n}$; and each of the upper threaded dowels $\mathbf{426}^{1+n}$ includes a proximal end $\mathbf{472}^{1+n}$ and a distal end $\mathbf{474}^{1+n}$. Each of the proximal ends $\mathbf{428}^{1+n}$ of the lower threaded dowels $\mathbf{424}^{1+n}$ and each of the proximal ends $\mathbf{472}^{1+n}$ of the upper threaded dowels $\mathbf{426}^{1+n}$ includes a circumferential threaded flange $\mathbf{432}^{1+n}$ adapted to rotationally threadably engage with the first threaded annular anchor hole 412 of the lower base plate 410 and/or to rotationally threadably engage with the second threaded annular anchor hole 420 of the upper base plate 418 such that each of the lower threaded dowels $\mathbf{424}^{1+n}$ and each of the upper threaded dowels $\mathbf{426}^{1+n}$ are interchangeable with each other. Each of the lower threaded dowels $\mathbf{424}^{1+n}$ and the upper threaded dowels $\mathbf{426}^{1+n}$ can be firmly threadably connected to the first threaded annual anchor hole 412 of the lower base plate 410 and/or to the second threaded annual anchor hole 420 of the upper base plate 418 via each of the circumferential threaded flanges $\mathbf{432}^{1+n}$. Each of the circumferential threaded flanges $\mathbf{432}^{1+n}$ of the first set of the lower threaded dowels $\mathbf{424}^{1+n}$ and the second set of the upper threaded dowels $\mathbf{426}^{1+n}$ includes a ¾ inch circumferential threaded flange $\mathbf{432}^{1+n}$, and each of the first threaded annual anchor hole 412 of the lower base plate 410, and the second threaded annular anchor hole 420 of the upper base plate 418 includes a ¾ inch threaded annular anchor hole.

The multiplicity of threaded dowels $\mathbf{446}^{1+n}$ including the first set of lower threaded dowels $\mathbf{424}^{1+n}$ and the second set of upper threaded dowels $\mathbf{426}^{1+n}$ includes diameters consisting of the group of 1.0 inch diameter, 2.0 inch diameter, and 3.0 inch diameter. In another embodiment, the multiplicity of threaded dowels $\mathbf{446}^{1+n}$ including the first set of lower threaded dowels $\mathbf{424}^{1+n}$ and the second set of upper threaded dowels $\mathbf{426}^{1+n}$ can be configured and customized to accommodate a multiplicity of rolls of water-resistive barrier wrap 140 or rolls of house wrap 70 that are commercially available to builders, as discussed above. In another embodiment, the multiplicity of dowels $\mathbf{446}^{1+n}$ can be customized and configured including diameters in the range of 1.0 inch-3.5 inches or greater as configured to correspond to the selected roll of water-resistive barrier wrap 140 or the selected roll of house wrap 70. With such embodiments, the single user can selectively choose and customize a combination of sets of lower threaded dowels $\mathbf{424}^{1+n}$ and sets of upper threaded dowels $\mathbf{428}^{1+n}$ to be used with a selected roll of water-resistive barrier wrap 140.

A given length of the roll of the water-resistive barrier wrap 140 refers to the length of the selected roll of the water-resistive barrier wrap 140, where the user can purchase the roll of the water-resistive barrier wrap 140 in a commercially available given length or the user can take a commercially available roll of water-resistive barrier wrap 140 and cut the roll of the water-resistive barrier wrap 140 to a given length that is required for a specific roll of water-resistive barrier wrap 140 for the installation on the particular stable structure 76, residential building, or commercial building that the user is installing the house wrap. For example, TYVEC® provides rolls of house wrap 70 or rolls of water-resistive barrier wrap 140 having a variety of given lengths including 3 feet, 5 feet, 9 feet, 10 feet. Here, the user can select any one of the given lengths of the water-resistive barrier wrap 140 water-resistive barrier wrap 140 to a given length as needed for the particular exterior wall 78 of the stable structure 76, residential building, or commercial building. Thus, such embodiments of the present invention includes a plurality of given lengths selected rolls of water-resistive barrier wrap 140.

Figure 13A:
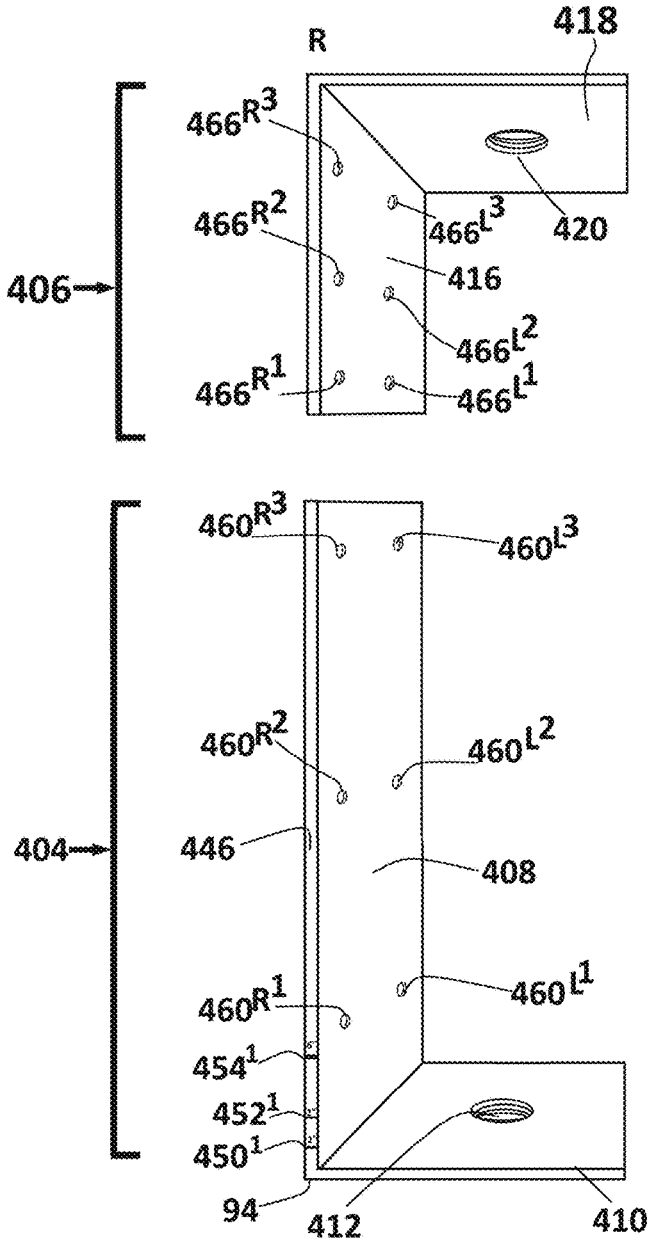
FIG. 13A is a perspective view of a right side of a water-resistive barrier wrap dispenser of FIG. 12.
Figure 13B:
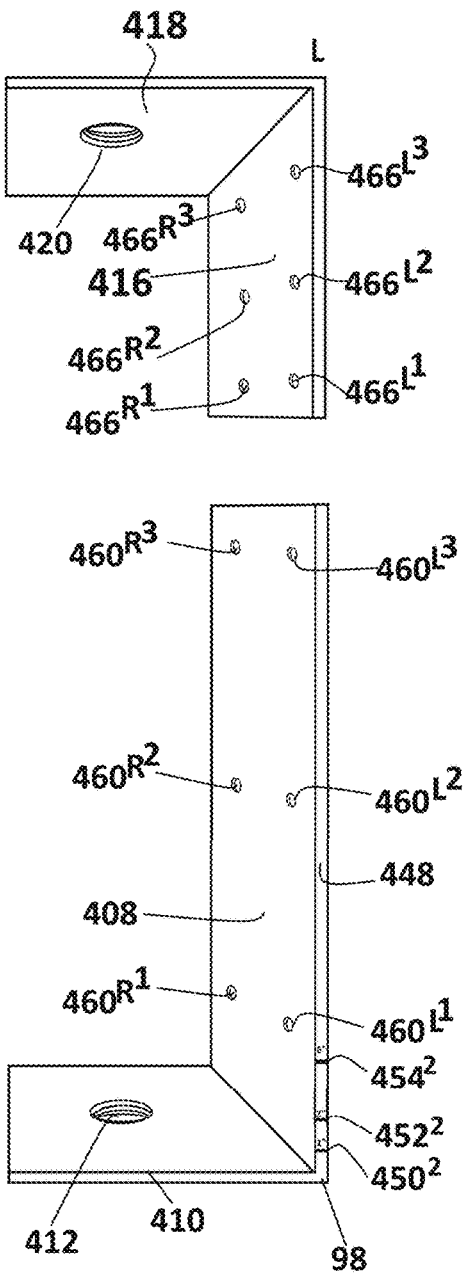
FIG. 13B is a perspective view of a left side of the water-resistive barrier wrap dispenser of FIG. 13A.

Referring back to FIGS. 12-16B, with particularity to FIGS. 12-13B, the lower base plate 410 of the lower barrier wrap bracket 404 is configured having a peripheral circumferential rim 434 of the first threaded annular anchor hole 412 spaced a first predetermined distance from a peripheral flat surface of a front face 436 of the lower wall plate 408, the predetermined distance being at least greater than a radius of the selected roll of the water-resistive barrier wrap 140. The upper wall plate 416 of the upper barrier wrap bracket 406 includes a peripheral circumferential rim 438 of the second threaded annular anchor hole 420 which is spaced a second predetermined distance from a peripheral flat surface of a front face 440 of the upper wall plate 416, the second predetermined distance being equal to the first predetermined distance whereby the selected lower threaded dowel 424 selected from the set of lower threaded dowels $\mathbf{424}^{1+n}$ and the selected upper threaded dowel 426 selected from the set of upper threaded dowels $\mathbf{426}^{1+n}$ corresponding in equal diameters are coaxial with each other wherein when the selected lower threaded dowel 424 and the selected upper threaded dowel 426 are threadably connected to the lower base plate 410 and the upper base plate 418, respectively.

Figure 14:
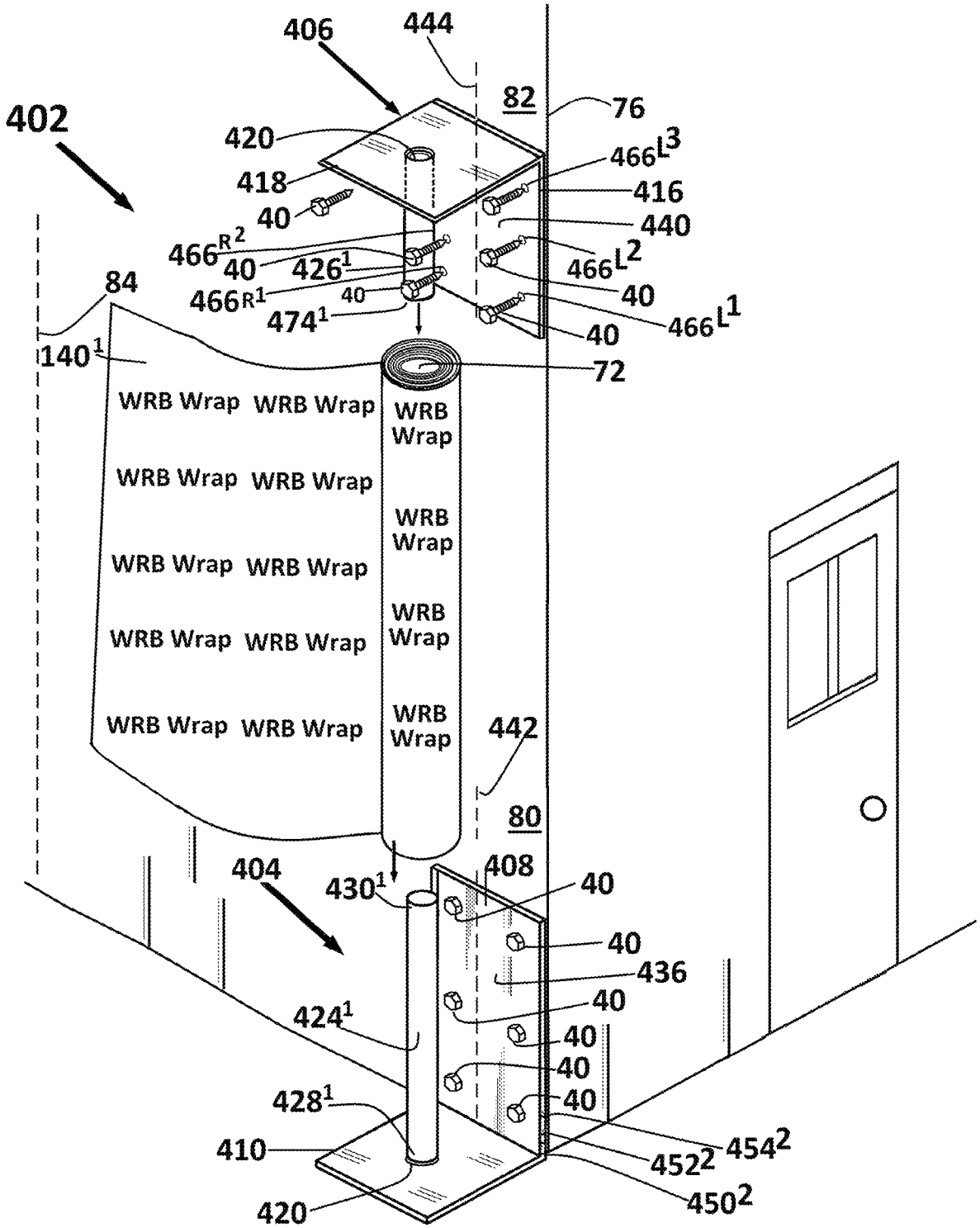
FIG. 14 is a perspective view of the water-resistive barrier wrap dispenser of FIG. 12 in use.
Figure 15:
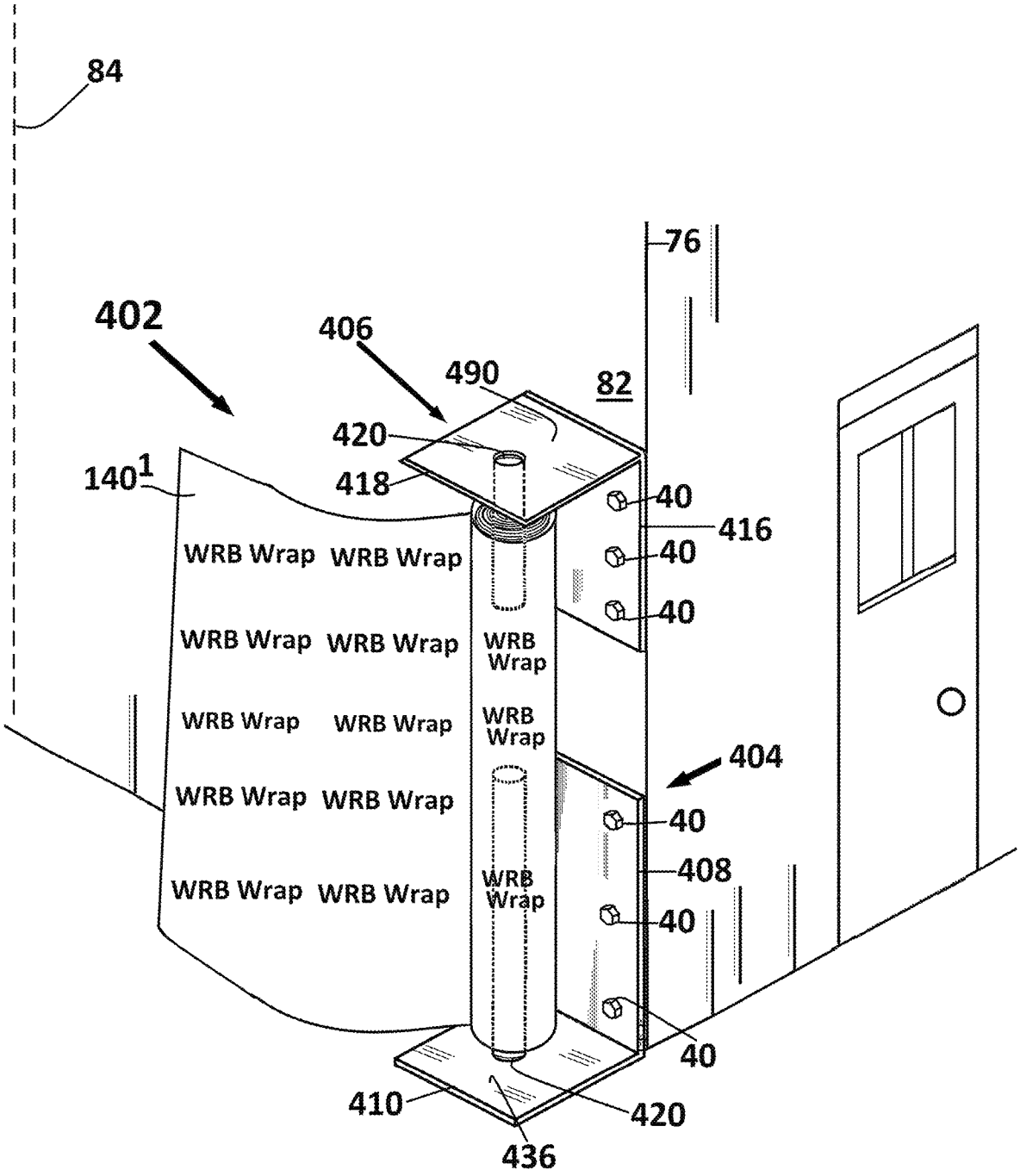
FIG. 15 is a perspective view of the water-resistive barrier wrap dispenser of FIG. 12 assembled for use.

Further, it is critical that the length of each of the selected lower threaded dowels $\mathbf{424}^{1+n}$ is less than the length of the roll of water-resistive barrier wrap 140 so that the selected lower threaded dowel 424, for example, in this embodiment, a first lower threaded dowel $\mathbf{424}^{1}$ is inserted into the selected roll of the water-resistive barrier wrap 140 for a length of a lower portion of the selected roll of water-resistive barrier wrap 140 allowing for the selected upper threaded dowel 426, for example, a first upper threaded dowel $\mathbf{426}^{1}$, to be inserted into an upper portion of the selected roll of water-resistive barrier wrap 140, as illustrated in FIGS. 14-15, whereby the selected lower threaded dowel $\mathbf{424}^{1}$ and the selected upper threaded dowel $\mathbf{426}^{1}$ conjointly support the selected water-resistive barrier wrap 140 in an upright position whereby the water-resistive barrier wrap can be pulled from the water-resistive barrier wrap dispenser 402 in a horizontal direction.

It is critical that the water-resistive barrier wrap dispenser 402 unroll the house wrap from the roll of water-resistive barrier wrap 140 in a horizontal orientation because the building codes, as disclosed above, and commercial water-resistive barrier wrap 140 manufacturers directions call for the water-resistive barrier wrap 140 to be unrolled in a horizontal direction from the roll of water-resistive barrier wrap 140 so that a lower layer of water-resistive barrier wrap 140 is installed horizontally along the exterior wall 78 of the stable structure 76, residential building, or commercial building whereby an upper layer of water-resistive barrier wrap 140 can be installed overlapping the lower layer of water-resistive barrier wrap by a recommended 6.0 inches.

The lower wall plate 408 of the lower barrier wrap bracket 404 includes a lower wall plate 408 length, a lower wall plate 408 width, a lower wall plate 408 depth, a lower wall plate 408 medial axis (which is an invisible line indicated at numeral 442), and the upper wall plate 416 of the upper barrier wrap bracket 406 includes an upper wall plate 416 length, an upper wall plate 416 width, an upper wall plate 416 depth, an upper wall plate 416 medial axis (which is an invisible line indicated at numeral 444), wherein the upper wall plate 416 length is less than the lower wall plate 408 length, the upper wall plate 416 width and the upper wall plate 416 depth is equal to the lower wall plate 408 width and the lower wall plate 408 depth, respectively. Each of the lower threaded dowels $\mathbf{424}^{1+n}$ of the first set of lower threaded dowels $\mathbf{424}^{1-n}$ includes a lower threaded dowel 424 length which is less than the lower wall plate 408 length and less than the given length of the selected roll of water-resistive barrier wrap 140. Each of the upper threaded dowels 426 of the second set of upper threaded dowels $\mathbf{426}^{1+n}$ includes an upper threaded dowel 426 length which is less than the upper wall plate 416 length and less than each of the lower threaded dowel $\mathbf{424}^{1+n}$ length.

The lower wall plate 408 includes a right side face 447 and a left side face 448. As illustrated in FIG. 13, the lower wall plate 408 includes a first 1.0 inch measuring notch $\mathbf{450}^{1}$ etched on a first peripheral surface of the right side face 447 of the lower wall plate 408 measured vertically upward from a right inferior edge 456 of the lower wall plate 408, a first 2.0 inch measuring notch $\mathbf{452}^{1}$ etched on a second peripheral surface of the right side face 447 of the lower wall plate 408 measured vertically upward from the right inferior edge 456 of the lower wall plate 408, a first 6.0 inch measuring notch $\mathbf{454}^{1}$ etched on a third peripheral surface of the right side face 447 of the lower wall plate 408 measured vertically upward from the right inferior edge 456 of the lower wall plate 408, and a corresponding second 1.0 inch measuring notch $\mathbf{450}^{2}$ etched on a first peripheral surface of the left side face 448 of the lower wall plate 408 measured vertically upward from a left inferior edge 458 of the lower wall plate 408, a second 2.0 inch measuring notch $\mathbf{452}^{2}$ etched on a second peripheral surface of the left side face 448 of the lower wall plate 408 measured vertically upward from the left inferior edge 458 of the lower wall plate 408, and a second 6.0 inch measuring notch $\mathbf{454}^{2}$ etched on a second peripheral surface of the left side face 448 of the lower wall plate 408 measured vertically upward from the left inferior edge 458 of the lower wall plate 408.

The lower wall plate 408 includes a first number of lower unthreaded anchor holes $\mathbf{460}^{1+n}$ integrally formed therethrough the lower wall plate 408 disposed in a first series of one or more lower rows aligned in widthwise rows along the lower wall plate 408 length whereby one or more pairs of a right lower unthreaded anchor hole $\mathbf{460}^{R1+Rn}$ and a left lower unthreaded anchor hole $\mathbf{460}^{L1+Ln}$ are disposed symmetrically parallel to each other spaced equidistant from the lower wall plate 408 medial axis 442, as illustrated in FIGS. 12-13.

Each of the first number of the lower unthreaded anchor holes $\mathbf{460}^{1+n}$, including the one or more pairs of a right lower unthreaded anchor hole $\mathbf{460}^{R1+Rn}$ and a left lower unthreaded anchor hole $\mathbf{460}^{L1+Ln}$, includes an inner diameter and a depth, the depth equal to the lower wall plate 408 depth, configured to receive any one of the at least two removable fasteners $\mathbf{40}^{1+n}$ to selectively attach, detach, and reattach the lower wall plate 408 of the lower barrier wrap bracket 404 to the first exterior wall area 80 of the exterior wall 78 of the stable structure 76, residential building, or commercial building. The at least two removable fasteners $\mathbf{40}^{1+n}$ include any one of the at least two removable fasteners $\mathbf{40}^{1+n}$ selected from the group of removable fasteners consisting of screws, full bearing screws, washer faced, double chamfered, square screws, knurled head, eyebolt screws, and lag screws.

In use, as illustrated in FIGS. 14-16B, including the lower barrier wrap bracket 404 attached to the first exterior wall area 80 of the exterior wall 78 of the stable structure 76, the residential building, the commercial building, the at least two removable fasteners $\mathbf{40}^{1+n}$ in cooperation with the lower wall plate 408 is operable to uphold the lower barrier wrap bracket 404 stationary on the first exterior wall area 80 wherein a selected lower threaded dowel 424 selected from the first set of the lower threaded dowels $\mathbf{424}^{1+n}$, as shown in FIGS. 13-15, a first lower threaded dowel $\mathbf{424}^{1}$ is firmly threadably connected to the first threaded annular anchor hole 412 of the lower base plate 410 in a vertically upright orientation. In this manner, in use, the single user first removably attaches the lower wall plate 408 to the first exterior wall area 80 or location on the exterior wall 78, and, subsequently, mounts the selected roll of the water-resistive barrier wrap 140 onto the first lower threaded dowel $\mathbf{424}^{1}$ by inserting the distal end 430 of the first lower threaded dowel $\mathbf{424}^{1}$ into the bottom open end 74 of the selected roll of water-resistive barrier wrap 140 such that the selected roll of water-resistive barrier wrap 140 is supported by the length of the selected lower threaded dowel 424 from its proximal end $\mathbf{428}^{1+n}$ to its distal end $\mathbf{430}^{1+n}$, as illustrated in FIGS. 14-15.

The upper wall plate 416 of the upper barrier wrap bracket 406 includes a second number of upper unthreaded anchor holes $\mathbf{466}^{1+n}$ integrally formed therethrough the upper wall plate 416 disposed in a second series of one or more upper rows aligned in widthwise rows along the upper wall plate 416 length whereby a pair of one or more pairs of a right upper unthreaded anchor hole $\mathbf{466}^{R1+R3}$ and a left upper unthreaded anchor hole $\mathbf{466}^{L1+L3}$ are disposed symmetrically parallel to each other spaced equidistant from the upper wall plate 416 medial axis 444, as illustrated in FIGS. 12-14.

The water-resistive barrier wrap dispenser 402 including the lower barrier wrap bracket 404, the upper barrier wrap bracket 406, and the multiplicity of threaded dowels $\mathbf{446}^{1+n}$, can be manufactured with metal, steel, aluminum. In another embodiment of the invention water-resistive barrier wrap dispenser 402 including the lower barrier wrap bracket 404, the upper barrier wrap bracket 406, the multiplicity of threaded dowels $\mathbf{446}^{1+n}$ can be manufactured with materials selected from the group of materials consisting of polymer resins, and plastic.

It can be appreciated by a person of ordinary skill in the art that the lower wall plate 408 and the upper wall plate 416, can be sized to support a variety of lengths and diameters of threaded dowels $\mathbf{446}^{1+n}$, including lower threaded dowels $\mathbf{424}^{1+n}$ and upper threaded dowels $\mathbf{426}^{1+n}$, and consequentially, lengths and widths of commercially available rolls of water-resistive barrier wrap 140 or rolls of house wrap 70.

Each of the first number of the upper unthreaded anchor holes $\mathbf{466}^{1+n}$ includes an inner diameter and a depth, the depth equal to the upper wall plate 416 depth, configured to receive any one of the at least two removable fasteners $\mathbf{40}^{1+n}$ In this manner the upper wall plate 416 of the upper barrier wrap bracket 406 can be selectively attached, detached, and reattached to a second exterior wall area 82 or ensuing location on the exterior wall 78 of the stable structure 76 as the user proceeds through the process of stapling or nailing the water-resistive barrier wrap to the exterior wall 78. Here, it is imperative that the upper wall plate 416 medial axis 444 is aligned with the lower wall plate 408 medial axis 442 whereby the first lower threaded dowel $\mathbf{424}^{1}$ is coaxial with a first upper threaded dowel $\mathbf{426}^{1}$. The upper barrier wrap bracket 406 is attached to the second exterior wall area 82 or location wherein the at least two removable fasteners $\mathbf{40}^{1+n}$ in cooperation with the upper wall plate 416 is operable to uphold the upper barrier wrap bracket 406 stationary on the second exterior wall area 82 or location, wherein a selected upper threaded dowel 426 selected from the set of the upper threaded dowels $\mathbf{426}^{1+n}$, for example, the first upper threaded dowel $\mathbf{426}^{1}$, is firmly threadably connected to the second threaded annular anchor hole 420 of the upper base plate 418 in a vertically downward orientation such that the selected lower threaded dowel 424 is coaxial with the selected upper threaded dowel 426, with reference to FIGS. 13-15. Subsequently, the top open end 72 of the selected roll of water-resistive barrier wrap 140 is received by the selected upper threaded dowel 426 such that the selected lower threaded dowel 424 and the selected upper threaded dowel 426 conjointly support the selected roll of water-resistive barrier wrap 140 in an upright orientation for rotation of the selected roll of the water-resistive barrier wrap 140 relative to the selected lower threaded dowel 424, for example the first lower threaded dowel $\mathbf{424}^{1}$, and the selected upper threaded dowel 426, for example, the first upper threaded dowel $\mathbf{426}^{1}$, as shown in FIGS. 14-15, whereby the selected roll of water-resistive barrier wrap 140 can unroll in a horizontal direction relative to the exterior wall 78 of the stable structure 76, residential building or the commercial building. It is critical that the roll of water-resistive barrier wrap unroll in a horizontal direction because, pursuant to Section R703.2 Water Resistant Barrier, one layer of a Mo.15 asphalt felt, free from holes and breaks, complying with ASTM D226 for Type 1 felt or other approved water-resistive barrier shall be applied over studs or sheathing of all exterior walls. Such felt of material shall be applied horizontally, with the upper layer lapped over the lower layer not less than 2 inches (51 mm).

In yet another embodiment of the present invention is disclosed a water-resistive barrier wrap dispenser apparatus kit 500, as illustrated in FIGS. 16A-19, embodied with the water-resistive barrier wrap dispenser apparatus 400, as described in detail above, such that the termed elements of the water-resistive barrier wrap dispenser apparatus 400 with incorporation by reference to FIGS. 12-15 of this Detailed Description/Specification, will retain their numerical identifiers for consistency and clarity.

The water-resistive barrier wrap dispenser apparatus kit 500, comprises a water-resistive barrier wrap dispenser apparatus 400, comprising a water-resistive barrier wrap dispenser 402 including a lower barrier wrap bracket 404 operatively associated with an upper barrier wrap bracket 406, a multiplicity of threaded dowels $\mathbf{446}^{1+n}$ including a first set of lower threaded dowels $\mathbf{424}^{1+n}$ and a second set of upper threaded dowels $\mathbf{426}^{1+n}$, at least two removable fasteners $\mathbf{40}^{1+n}$, a bag 50 to contain the at least two removable fasteners $\mathbf{40}^{1+n}$, a driver 60, a water-resistive barrier wrap dispenser apparatus instruction sheet 510, and a water-resistive barrier wrap dispenser apparatus carrying case 520 for transporting and storing the water-resistive barrier wrap dispenser apparatus 400.

The water-resistive barrier wrap dispenser apparatus kit 500 provides a means to contain the water-resistive barrier wrap apparatus 400 in one place whereby the lower barrier wrap bracket 404 and the upper barrier wrap bracket 406, the multiplicity of threaded dowels $\mathbf{446}^{1+n}$, including the first set of lower threaded dowels $\mathbf{424}^{1+n}$ and the second set of upper threaded dowels $\mathbf{426}^{1+n}$, the at least two removable fasteners $\mathbf{40}^{1+n}$ contained in the bag 50, the driver 60, can be easily transportable, and, further, each of the lower barrier wrap bracket 404 and the upper barrier wrap bracket 406, the multiplicity of threaded dowels $\mathbf{446}^{1+n}$, including the first set of lower threaded dowels $\mathbf{424}^{1+n}$ and the second set of upper threaded dowels $\mathbf{426}^{1+n}$, the at least two removable fasteners $\mathbf{40}^{1+n}$ contained in the bag 50, the driver 60, can be easily removed by the single user when installing the house wrap to the exterior walls 78 of the stable structure 76.

In another embodiment of the invention, as illustrated in FIGS. 12-16B there is disclosed a water-resistive barrier wrap dispenser apparatus 400 adapted to use with a selected roll of a water-resistive barrier wrap 140 of one or more rolls of the water-resistive barrier wrap 140 or house wraps 70 on the exterior wall 78 of one or more exterior walls of a stable structure 76, residential building or a commercial building, the exterior wall 78 having a longitudinal axis 84, the roll of the water-resistive barrier wrap 140 or the roll of house wrap 70 having a given length, and a hollow cylindrical core 70' limited by a top open end 72, a bottom open end 74, and a cylindrical core diameter.

The water-resistive barrier wrap dispenser apparatus 400 includes a water-resistive barrier wrap dispenser 402, as illustrated in FIGS. 12-15, comprising a set of two independent barrier wrap brackets including a lower barrier wrap bracket 404 operatively associated with an upper barrier wrap bracket 406, a multiplicity of threaded dowels $\mathbf{446}^{1+n}$, including a first set of lower threaded dowels $\mathbf{424}^{1+n}$, a second set of upper threaded dowels $\mathbf{426}^{1+n}$, at least two removable fasteners $\mathbf{40}^{1+n}$, a bag 50, and a driver 60.

With such an embodiment, the user is able to select a roll of water-resistive barrier wrap 140 or select a roll of house wrap 70 to install and affix to the exterior wall 78 of a particular stable structure 76, residential building, or commercial building, that the user is installing the water-resistive barrier wrap 140 or the house wrap 70. Further, the user is able to select a lower threaded dowel 424 from the first set of lower threaded dowels $\mathbf{424}^{1+n}$, and select an upper threaded dowel 426 from the second set of upper threaded dowels $\mathbf{426}^{1+n}$ where each of the selected lower threaded dowel 424 and the upper selected dowel 426 includes a diameter that is fitting with the cylindrical core diameter of the selected roll of water-resistive barrier wrap 140 or the selected roll of house wrap 70 whereby the selected lower threaded dowel 424, for example, a first selected lower threaded dowel $\mathbf{424}^{1}$ can readily be inserted into a lower portion of the selected roll of water-resistive barrier wrap 140 or the selected roll of house wrap 70 and the selected upper threaded dowel 426, for example, a first upper threaded dowel $\mathbf{426}^{1}$ can readily be inserted into a top portion of the selected roll of water-resistive barrier wrap 140 or the selected roll of house wrap 70. Consistent in this manner, the embodiment embraces the following terms: a selected roll of water-resistive barrier wrap 140, a selected roll of house wrap 70, a selected lower threaded dowel 424 selected from the multiplicity of threaded dowels $\mathbf{446}^{1+n}$ including a first set of lower threaded dowels $\mathbf{424}^{1+n}$, and a selected upper threaded dowel 426 selected from the second set of upper threaded dowels $\mathbf{426}^{1+n}$.

Further, such an embodiment, can include a variety of sizes of lower barrier wrap brackets 404 and a variety of sizes of upper barrier wrap brackets 406 having a lower wall plate 408 length and depth, a lower base plate 410 side length and width, an upper wall plate 416 length and depth, an upper base plate 418 side length and width that is fitting with any one of the multiplicity of threaded dowels $\mathbf{446}^{1+n}$. Further, the lower barrier wrap bracket 404 and the upper barrier wrap bracket 406 can be configured having the lower wall plate 408 and the upper wall plate 416 in a variety of sizes of lengths, widths, and depths, the lower base plate 410 and the upper base plate 418 can be configured having a variety of side lengths, widths, and depths, and a first threaded annular anchor hole 412 and a second threaded annual anchor hole 420 configured having a variety of sizes of diameters and threads.

The selected rolls of water-resistive barrier wrap 140 and/or the selected rolls of house wrap 70 are available from commercial manufacturers, distributors and suppliers commercially where the selected rolls of water-resistive barrier wrap 140 and the selected rolls of house wrap 70 are used to install on the exterior wall 78 of one or more exterior walls of the stable structure 76, residential building or a commercial building. Such house wraps and/or water-resistive barrier wraps for residential buildings and commercial buildings can include, by way of example, Grade D building paper, asphalt-saturated kraft paper, building felt, polymeric house wrap. Known polymeric house wraps for use as weather-resistive barriers or house wraps include, spunbond polyethelene sheet available under the trade name DuPont TYVEK® HOMEWRAP® and TYVEK® STUCCOWRAP® from E.I. du Pont de Nemours & Co., Wilmington, Del.; BARRICADE® from Barricade Building Products, Doswell, Va.; polyolefin nonwoven sheet available under the trade name STYROFOAM™ WEATHERMATE™ PLUS from the Dow Chemical Company, Midland, Mich.; spunbonded polypropylene-microporous film laminate available under the trade woven polypropylene sheet with a perforated coating available under the trade name Pinkwrap® from Owens Corning, Corning, N.Y. The space between the two layers provides a drainage space for any liquid water that penetrates the outer layer, and Everbuilt a Home Depot Product Authority, by way of example, but not an exhaustive list.

The lower barrier wrap bracket 404 includes a lower wall plate 408 having a first elongated rectangular plane conjoined to a lower base plate 410 at a right angle having a first horizontal plane such that the lower barrier wrap bracket 404 is configured in a L-shape. The lower base plate 410 includes a first threaded annular anchor hole 412 sculpted therethrough a central portion of a top surface 414 of the lower base plate 410.

The upper barrier wrap bracket 406, as illustrated in FIGS. 12-16B includes an upper wall plate 416 having a second elongated rectangular plane conjoined to an upper base plate 418 at a right angle having a second horizontal plane such that the upper barrier wrap bracket 406 is configured in an inverted L-shape. The upper base plate 418 includes a second threaded annular anchor hole 420 sculpted therethrough a central portion of a bottom surface 422 of the upper base plate 418.

The water-resistive barrier wrap dispenser 402 includes a multiplicity of threaded dowels $\mathbf{446}^{1+n}$, as illustrated in FIG. 12, including a first set of lower threaded dowels $\mathbf{424}^{1+n}$ and a second set of upper threaded dowels $\mathbf{426}^{1+n}$ wherein each of the lower threaded dowels $\mathbf{424}^{1+n}$ and the upper threaded dowels $\mathbf{426}^{1+n}$ includes an outer diameter which is less than the cylindrical core diameter of the selected roll of water-resistive barrier wrap 140 of the one or more rolls of the water-resistive barrier wrap or the one or more rolls of house wrap 70.

As illustrated in FIGS. 12-16B each of the first set of the lower threaded dowels $\mathbf{424}^{1+n}$ and each of the second set of the upper threaded dowels $\mathbf{426}^{1+n}$ includes a proximal end $\mathbf{472}^{1+n}$ and a distal end $\mathbf{474}^{1+n}$. Each of the proximal ends $\mathbf{428}^{1+n}$ of the lower threaded dowels 424 and each of the proximal ends $\mathbf{472}^{1+n}$ of the upper threaded dowels $\mathbf{426}^{1+n}$ includes a circumferential threaded flange $\mathbf{432}^{1+n}$ adapted to rotationally threadably engage with the first threaded annular anchor hole 412 of the lower base plate 410 and/or to rotationally threadably engage with the second threaded annular anchor hole 420 of the upper base plate 418 such that each of the lower threaded dowels $\mathbf{424}^{1+n}$ and each of the upper threaded dowels 426$^{1+n}$ are interchangeable with each other. Each of the lower threaded dowels 424$^{1+n}$ and the upper threaded dowels 426$^{1+n}$ can be firmly threadably connected to the first threaded annual anchor hole 412 of the lower base plate 410 and/or to the second threaded annual anchor hole 420 of the upper base plate 418 via each of the circumferential threaded flange 432$^{1+n}$. Each of the circumferential threaded flanges 432$^{1+n}$ of the first set of the lower threaded dowels 424$^{1+n}$ and the second set of the upper threaded dowels 426$^{1+n}$ includes a % inch circumferential threaded flange 432$^{1+n}$, and each of the first threaded annual anchor hole 412 of the lower base plate 410, and the second threaded annular anchor hole 420 of the upper base plate 418 includes a % inch threaded annular anchor hole.

The multiplicity of threaded dowels 446$^{1+n}$ including the first set of lower threaded dowels 424$^{1+n}$ and the second set of upper threaded dowels 426$^{1+n}$ includes diameters consisting of the group of 1.0 inch diameter, 2.0 inch diameter, and 3.0 inch diameter. In another embodiment, the multiplicity of threaded dowels 446$^{1+n}$ including the first set of lower threaded dowels 424$^{1+n}$ and the second set of upper threaded dowels 426$^{1+n}$ can be configured and customized to accommodate a multiplicity of rolls of water-resistive barrier wrap 140 or rolls of house wrap 70 that are commercially available to builders, as discussed above. In another embodiment, the multiplicity of dowels 446$^{1+n}$ can be customized and configured including diameters in the range of 1.0 inch-3.5 inches or greater as configured to correspond to the selected roll of water-resistive barrier wrap 140 or the selected roll of house wrap 70. With such embodiments, the single user can selectively choose and customize a combination of sets of lower threaded dowels 424$^{1+n}$ and sets of upper threaded dowels 428$^{1+n}$ to be used with a selected roll of water-resistive barrier wrap 140 and/or the selected roll of house wrap 70.

The lower base plate 410 of the lower barrier wrap bracket 404 is configured having a peripheral circumferential rim 434 of the first threaded annular anchor hole 412 spaced a first predetermined distance from a peripheral flat surface of a front face 436 of the lower wall plate 408, as shown in FIG. 12, the predetermined distance being at least greater than a radius of the selected roll of the water-resistive barrier wrap 140 or the selected roll of house wrap 70. The upper wall plate 416 of the upper barrier wrap bracket 406 includes a peripheral circumferential rim 438 of the second threaded annular anchor hole 420 which is spaced a second predetermined distance from a peripheral flat surface of a front face 440 of the upper wall plate 416, the second predetermined distance being equal to the first predetermined distance whereby the selected lower threaded dowel 424 selected from the set of lower threaded dowels 424$^{1+n}$ and the selected upper threaded dowel 426 selected from the set of upper threaded dowels 426$^{1+n}$ corresponding in equal diameters are coaxial with each other wherein when the selected lower threaded dowel 424 and the selected upper threaded dowel 426 are threadably connected to the lower base plate 410 and the upper base plate 418, respectively. It is critical that the upper wall plate 416 includes the upper wall plate 416 that is less than the lower wall plate 408 to minimized the weight of the water-resistive barrier wrap dispenser 402 wherein when the water-resistive barrier wrap dispenser 402 is removably attached to the exterior wall 78 of the stable structure 76, residential building, or commercial building wherein in the selected roll of water-resistive barrier wrap 140 or the selected roll of house wrap 70 is installed thereon, whereby the water-resistive barrier wrap dispenser 402 can be maintained stationary on the exterior wall 78 being held thereon temporarily by means of the cooperation of the lower wall plate 408 and the upper wall plate 416 and the at least two removable fasteners 40$^{1+n}$ removably fastened therein.

Further, it is critical that the length of each of the selected lower threaded dowels 424 is less than the length of the roll of water-resistive barrier wrap 140 or the roll of house wrap 70 so that the selected lower threaded dowel 424 is inserted into the selected roll of the water-resistive barrier wrap 140 or the selected roll of house wrap 70 for a length of a lower portion of the selected roll of water-resistive barrier wrap 140 or the selected roll of house wrap 70 allowing for the selected upper threaded dowel 426$^{1}$ to be inserted into an upper portion of the selected roll of water-resistive barrier wrap 140 or the selected roll of house wrap 70, as illustrated in FIGS. 14-15, whereby the selected lower threaded dowel 424$^{1}$ and the selected upper threaded dowel 426 conjointly support the selected water-resistive barrier wrap 140 or the selected roll of house wrap 70 in an upright position.

The lower wall plate 408 of the lower barrier wrap bracket 404 includes a lower wall plate 408 length, a lower wall plate 408 width, a lower wall plate 408 depth, a lower wall plate 408 medial axis (which is an invisible line indicated at numeral 442), and the upper wall plate 416 of the upper barrier wrap bracket 406 includes an upper wall plate 416 length, an upper wall plate 416 width, an upper wall plate 416 depth, an upper wall plate 416 medial axis (which is an invisible line indicated at numeral 444), wherein the upper wall plate 416 length is less than the lower wall plate 408 length, the upper wall plate 416 width and the upper wall plate 416 depth is equal to the lower wall plate 408 width and the lower wall plate 408 depth, respectively. Each of the lower threaded dowels 424 of the first set of lower threaded dowels 424$^{1-n}$ includes a lower threaded dowel 424 length which is less than the lower wall plate 408 length and less than the given length of the selected roll of water-resistive barrier wrap 140 or the selected roll of house wrap 70, and each of the upper threaded dowels 426 of the second set of upper threaded dowels 426$^{1+n}$ includes an upper threaded dowel 426 length which is less than the upper wall plate 416 length and less than the lower threaded dowel 424 length.

The lower wall plate 408 includes a right side face 447 and a left side face 448. As illustrated in FIG. 13, the lower wall plate 408 includes a first 1.0 inch measuring notch 450$^{1}$ etched on a first peripheral surface of the right side face 447 of the lower wall plate 408 measured vertically upward from a right inferior edge 456 of the lower wall plate 408, a first 2.0 inch measuring notch 452$^{1}$ etched on a second peripheral surface of the right side face 447 of the lower wall plate 408 measured vertically upward from the right inferior edge 456 of the lower wall plate 408, a first 6.0 inch measuring notch 454$^{1}$ etched on a third peripheral surface of the right side face 447 of the lower wall plate 408 measured vertically upward from the right inferior edge 456 of the lower wall plate 408, and a corresponding second 1.0 inch measuring notch 450$^{2}$ etched on a first peripheral surface of the left side face 448 of the lower wall plate 408 measured vertically upward from a left inferior edge 458 of the lower wall plate 408, a second 2.0 inch measuring notch 452$^{2}$ etched on a second peripheral surface of the left side face 448 of the lower wall plate 408 measured vertically upward from the left inferior edge 458 of the lower wall plate 408, and a second 6.0 inch measuring notch 454$^{2}$ etched on a second peripheral surface of the left side face 448 of the lower wall plate 408 measured vertically upward from the left inferior edge 458 of the lower wall plate 408.

It is critical that the lower wall plate 408 includes one or more measuring notches including, particularly, the first and second 1.0 inch measuring notches $\mathbf{450}^1$ and $450^2$, respectively, the first and second 2.0 inch measuring notches $\mathbf{452}^2$ and $452^2$, respectively, and the first and second 6.0 inch measuring notches $\mathbf{454}^1$ and $454^2$, respectively, etched on the peripheral surfaces of the right side face 447 and the left side face 448 of the lower wall plate 408, as described immediately, above, because, with reference to the International Residential Code (2015), and the Washington State Building Code (Chapter 51-51 WAC), other local jurisdictional building codes, commercial manufacturers of the water-resistive barrier wrap 140, and what is known to a person of ordinary skill in the art, it is recommended that the user align the roll of water-resistive barrier wrap 140 at a bottom corner of the exterior wall(s) 78 of the stable structure 76, residential building, or commercial building having the roll of water-resistive barrier wrap 140 plumb, and whereby the user must extend the bottom edge of the bottom layer of the water-resistive-barrier wrap being installed over the sill plate of the exterior wall 78 of the stable structure 76, residential building, or commercial building, by at least 1.0 inch, or 2.0 inches.

In addition, it is critical that the lower wall plate 408 includes a first 6.0 inch measuring notch 454 and a second 6.0 inch measuring notch 454' on each of the right side face 447 and the left side face 448 of the lower wall plate 408, as discussed above, with reference to FIGS. 13A-14, because, with reference to International Residential Code (2015), and the Washington State Building Code (Chapter 51-51 WAC), other local jurisdictional building codes, commercial manufacturers of the rolls of water-resistive barrier wrap 140 and what is known to a person of ordinary skill in the art, it is recommended that the user install an upper layer of the water resistive wrap which should overlap the bottom layer of water-resistive wrap bottom layer by a minimum of 6.0 inches, whereby the consecutive upper layers of the water-barrier resistive barrier wrap should continue to overlap the its adjacent bottom layer of the water-resistive barrier wrap by another 6.0 inches to prevent water and moisture from entering and seeping between the exterior wall, sheathing and the water-resistive barrier wrap.

It is important to note that the user consult the International Residential Code (2015) and to consult the building codes of their specific jurisdiction of the situs of the stable structure 76, residential building, or commercial building to insure compliance with the local building codes.

The lower wall plate 408 includes a first number of lower unthreaded anchor holes $\mathbf{460}^{1+n}$ integrally formed therethrough the lower wall plate 408 disposed in a first series of one or more lower rows aligned in widthwise rows along the lower wall plate 408 length whereby one or more pairs of a right lower unthreaded anchor hole $\mathbf{460}^{R1+Rn}$ and a left lower unthreaded anchor hole $\mathbf{460}^{L1+Ln}$ are disposed symmetrically parallel to each other spaced equidistant from the lower wall plate 408 medial axis 442, as illustrated in FIGS. 12-13.

Each of the first number of the lower unthreaded anchor holes $\mathbf{460}^{1+n}$ includes an inner diameter and a depth, the depth equal to the lower wall plate 408 depth, configured to receive any one of the at least two removable fasteners $\mathbf{40}^{1+n}$ to selectively attach, detach, and reattach the lower wall plate 408 of the lower barrier wrap bracket 404 to the first exterior wall area 80 of the exterior wall 78. The at least two removable fasteners $\mathbf{40}^{1+n}$ include any one of the at least two removable fasteners $\mathbf{40}^{1+n}$ selected from the group of removable fasteners consisting of screws, full bearing screws, washer faced, double chamfered, square screws, knurled head, eyebolt screws, and lag screws.

In use, when the lower barrier wrap bracket 404 is attached to the first exterior wall area 80 of the exterior wall 78 of the stable structure 76, the residential building, the commercial building, the at least two removable fasteners $\mathbf{40}^{1+n}$ in cooperation with the lower wall plate 408 is operable to uphold the lower barrier wrap bracket 404 stationary on the first exterior wall area 80 wherein a selected lower threaded dowel 424 selected from the first set of the lower threaded dowels $\mathbf{424}^{1+n}$, for example, as shown in FIGS. 13-15, a first lower threaded dowel $\mathbf{424}^1$, is firmly threadably connected to the first threaded annular anchor hole 412 of the lower base plate 410 in a vertically upright orientation. In this manner, in use, the single user first removably attaches the lower wall plate 408 to the first exterior wall area 80 or location on the exterior wall 78, and, subsequently, mounts the selected roll of the water-resistive barrier wrap 140 onto the first lower threaded dowel $\mathbf{424}^1$ by inserting the distal end $\mathbf{430}^1$ of the first lower threaded dowel $\mathbf{424}^1$ into the bottom open end 74 of the selected roll of water-resistive barrier wrap 140 such that the selected roll of water-resistive barrier wrap 140 is supported by the length of the first lower threaded dowel $\mathbf{424}^1$ from its proximal end $\mathbf{428}^1$ to its distal end $\mathbf{430}^1$, as illustrated in FIGS. 14-15.

The upper wall plate 416 of the upper barrier wrap bracket 406 includes a second number of upper unthreaded anchor holes $\mathbf{466}^{1+n}$ integrally formed therethrough the upper wall plate 416 disposed in a second series of one or more upper rows aligned in widthwise rows along the upper wall plate 416 length whereby a pair of one or more pairs of a right upper unthreaded anchor hole $\mathbf{466}^{R1-R3}$ and a left upper unthreaded anchor hole $\mathbf{466}^{L1-L3}$ are disposed symmetrically parallel to each other spaced equidistant from the upper wall plate 416 medial axis 444.

The water-resistive barrier wrap dispenser 402 including the lower barrier wrap bracket 404, the upper barrier wrap bracket 406, and the multiplicity of threaded dowels $\mathbf{446}^{1+n}$, can be manufactured with metal, steel, aluminum. In another embodiment of the invention the water-resistive barrier wrap dispenser 402 including the lower barrier wrap bracket 404, the upper barrier wrap bracket 406, the multiplicity of threaded dowels $\mathbf{446}^{1+n}$ can be manufactured with materials selected from the group of materials consisting of polymer resins, and plastic.

It can be appreciated by a person of ordinary skill in the art that the lower wall plate 408 and the upper wall plate 416, can be sized to support a variety of lengths and diameters of threaded dowels, and consequentially, lengths and widths of commercially available rolls of water-resistive barrier wrap 140. As mentioned above, TYVEC® provides rolls of house wrap 70 or rolls of water-resistive barrier wrap 140 having a variety of given lengths including 3 feet, 5 feet, 9 feet, 10 feet. It is noteworthy, any of the commercially available rolls of water-resistive barrier wraps can be cut by the user to accommodate a selected threaded dowel $\mathbf{424}^{1+n}$ and, similarly, any one of the multiplicity of threaded dowels $\mathbf{446}^{1+n}$ can be manufactured being configured having a length and width to accommodate the variety of lengths and widths of the commercially available rolls of water-resistive barrier wraps.

Each of the first number of the upper unthreaded anchor holes $\mathbf{466}^{1+n}$ includes an inner diameter and a depth, the depth equal to the upper wall plate 416 depth, configured to receive any one of the at least two removable fasteners $\mathbf{40}^{1+n}$. In this manner the upper wall plate 416 of the upper barrier wrap bracket 406 can be selectively attached, detached, and reattached to the second exterior wall area 82 or location on the exterior wall 78 of the stable structure 76 such that the upper wall plate 416 medial axis 444 is aligned with the lower wall plate 408 medial axis 442. The upper barrier wrap bracket 406 is attached to the second exterior wall area 82 or location wherein the at least two removable fasteners $\mathbf{40}^{1+n}$ in cooperation with the upper wall plate 416 is operable to uphold the upper barrier wrap bracket 406 stationary on the second exterior wall area 82 or location, wherein the selected upper threaded dowel 426, for example, a first upper threaded dowel $\mathbf{426}^{1}$ selected from the set of the upper threaded dowels $\mathbf{426}^{1+n}$ is firmly threadably connected to the second threaded annular anchor hole 420 of the upper base plate 418 in a vertically downward orientation such that the selected lower threaded dowel 424, for example, the first lower threaded dowel $\mathbf{424}^{1}$ is coaxial with the first upper threaded dowel $\mathbf{426}^{1}$. Subsequently, the top open end 72 of the selected roll of water-resistive barrier wrap 140 or the selected roll of house wrap $\mathbf{40}^{1+n}$ is received by the first upper threaded dowel $\mathbf{426}^{1}$ such that the first lower threaded dowel $\mathbf{424}^{1}$ and the first upper threaded dowel $\mathbf{426}^{1}$ conjointly support the selected roll of water-resistive barrier wrap 140 in an upright orientation for rotation of the selected roll of the water-resistive barrier wrap 140 relative to the first lower threaded dowel $\mathbf{424}^{1}$ and the first upper threaded dowel $\mathbf{426}^{1}$ whereby the selected roll of water-resistive barrier wrap 140 can unroll in a horizontal direction relative to the exterior wall 78 of the stable structure 76, residential building or the commercial building.

Further, as illustrated in FIGS. 16 A-16B, the water-resistive barrier wrap dispenser 402, can be attached, detached, and reattached from exterior wall areas 80 and 82' or locations on the exterior wall 78 of the stable structure 76, as needed, and relocated to another exterior wall area 80' and 82' while the user installs the water-resistive barrier wrap on the exterior wall 78 of the stable structure 76. Specifically, the lower barrier wrap bracket 404 is removably attached at the first exterior wall area 80, and the upper barrier wrap bracket 406 is removably attached to the second exterior wall area 82 plum with the lower barrier wrap bracket 404. Further, upon completion of the installation of the water-resistive barrier wrap onto a first lower area of the exterior wall(s) 78 and the depletion of the roll of water-resistive barrier wrap 140, the single user can detach the lower barrier wrap bracket 404 and detach the upper barrier wrap bracket 406 and relocate the lower barrier wrap bracket 404 and the upper barrier wrap bracket 406 to the next location on the exterior wall 78, and continue with the process of nailing and stapling the water-resistive barrier wrap on to the next location of the exterior wall 78 with a second roll of water-resistive barrier wrap $\mathbf{140}^{2}$ to replace the depleted first roll of water-resistive barrier wrap 140.

Figure 16A:
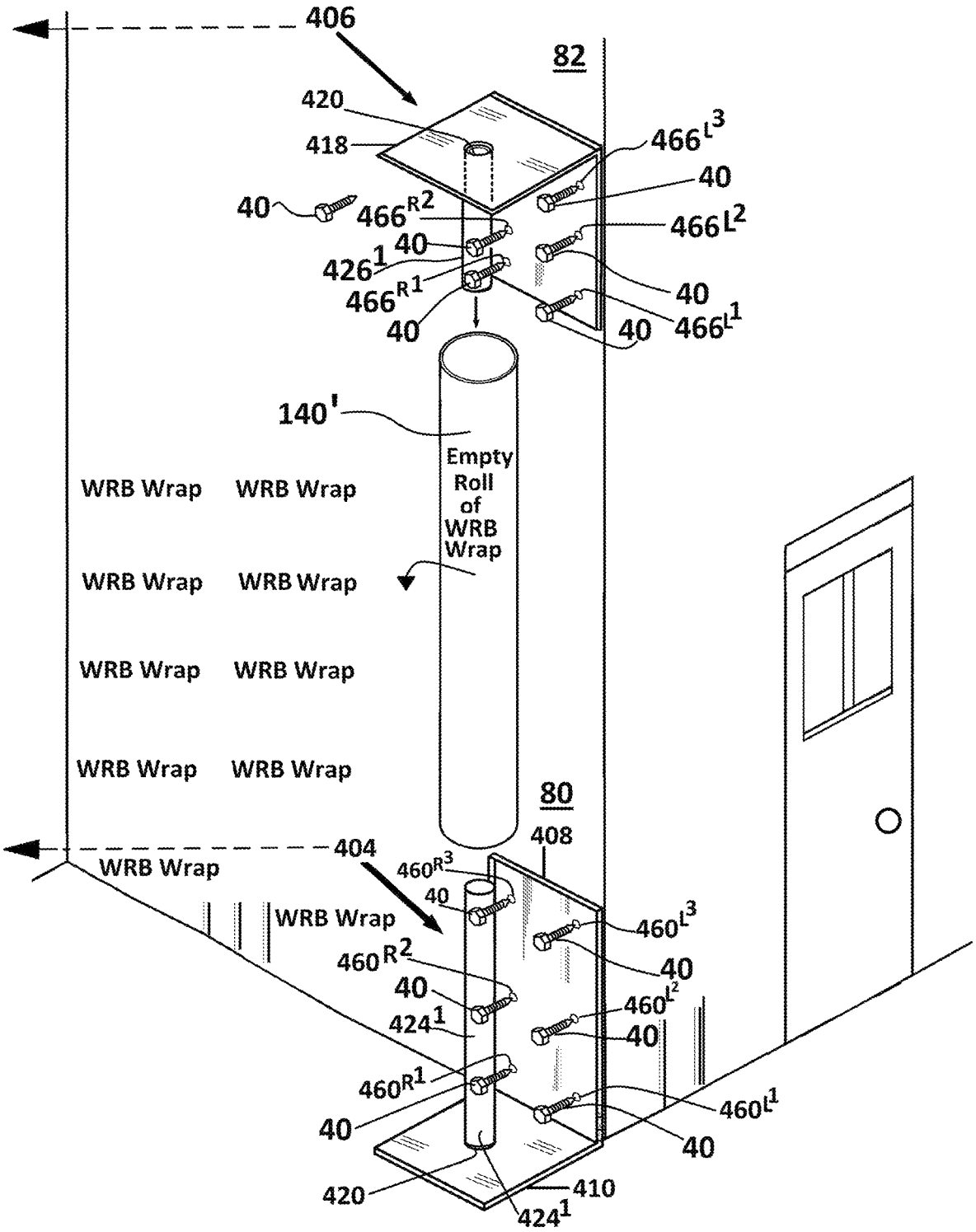
FIG. 16A is a perspective view of the water-resistive barrier wrap dispenser of FIG. 12 showing the water-resistive barrier wrap dispenser, in use, removably detached an from a first exterior wall area and showing a depleted roll of water-resistive barrier wrap.
Figure 16B:
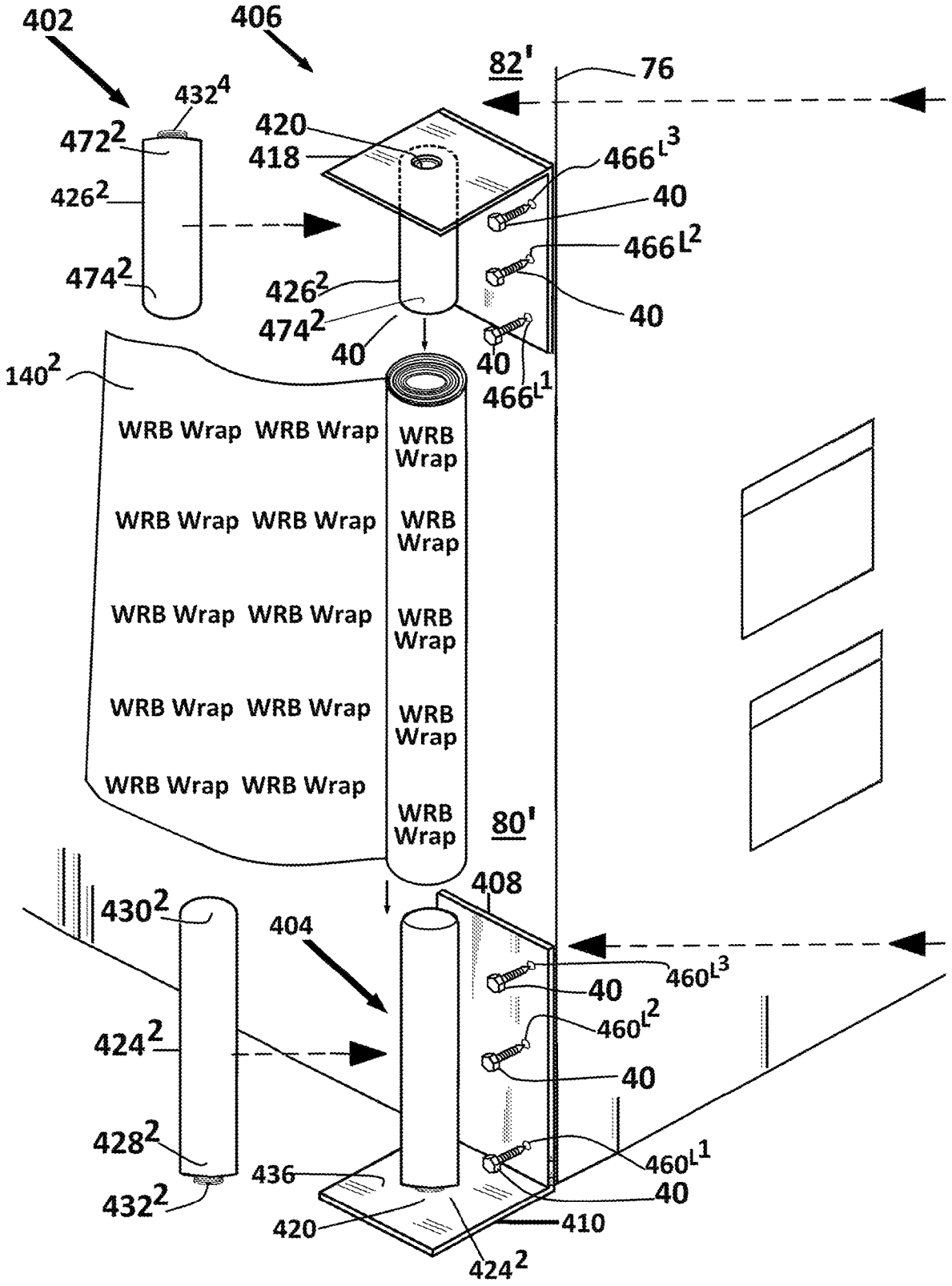
FIG. 16B is perspective view of the water-resistive barrier wrap dispenser continued from FIG. 5A, in use, being removably reattached on a second exterior wall area showing a second roll of water-resistive barrier wrap.

With this embodiment, the single user, can removably reattach the lower barrier wrap bracket 404 to a third exterior wall area 80', and replace the first lower threaded dowel $\mathbf{424}^{1}$ with a second lower threaded dowel $\mathbf{424}^{2}$ and replace the first upper threaded dowel $\mathbf{426}^{1}$ with a second upper threaded dowel $\mathbf{426}^{2}$ where each of the second lower threaded dowel $\mathbf{424}^{2}$ and the second upper threaded dowel $\mathbf{426}^{2}$ includes a diameter that is greater than each of the first lower threaded dowel $\mathbf{424}^{1}$ and the first upper threaded dowel $\mathbf{426}^{1}$, respectively, whereby each of the second lower threaded dowel $\mathbf{424}^{2}$ and the second upper threaded dowel $\mathbf{426}^{2}$ can support the second roll of water-resistive barrier wrap $\mathbf{140}^{2}$ that includes a cylindrical core diameter that is greater than the cylindrical core diameter of the first roll of the water-resistive barrier wrap 140. The second lower threaded dowel $\mathbf{424}^{2}$ is threadably connected to the first threaded annual anchor hole 412 of the lower base plate 410 via a second circumferential threaded flange $\mathbf{432}^{2}$ disposed at the proximal end $\mathbf{428}^{2}$ of the second lower threaded dowel $\mathbf{428}^{2}$. The second lower threaded dowel $\mathbf{424}^{2}$ includes a second lower threaded dowel $\mathbf{424}^{2}$ diameter that is greater than the first lower threaded dowel diameter $\mathbf{424}^{1}$ whereby the second lower threaded dowel $\mathbf{424}^{2}$ can support a replacement second roll of water-resistive barrier wrap $\mathbf{140}^{2}$ which includes a greater cylindrical core diameter than the cylindrical core diameter of the first roll of water-resistive barrier wrap 140. The single user can mount the second roll of water-resistive barrier wrap $\mathbf{140}^{2}$ onto the second lower threaded dowel $\mathbf{424}^{2}$, as depicted in FIGS. 16A-16B. The single user can mount the roll of second water-resistive barrier wrap $\mathbf{140}^{2}$ onto the second lower threaded dowel $\mathbf{424}^{2}$ by inserting the distal end $\mathbf{430}^{2}$ of the second lower threaded dowel $\mathbf{424}^{2}$ into the bottom open end 74 of the second roll of the water-resistive barrier wrap $\mathbf{140}^{2}$.

Subsequently, the single user can removably reattach the upper barrier wrap bracket 406 to a fourth exterior wall area 82'. The upper barrier bracket wrap bracket 406 includes the second upper threaded dowel $\mathbf{426}^{2}$ threadably connected to the second threaded annular anchor hole 420 of the upper base plate 418 via a fourth circumferential threaded flange $\mathbf{432}^{4}$ disposed on the proximal end $\mathbf{472}^{2}$ of the second upper threaded dowel $\mathbf{426}^{2}$. The second upper threaded dowel $\mathbf{426}^{2}$ starting from the distal end $\mathbf{474}^{2}$ of the second upper threaded dowel $\mathbf{426}^{2}$ is inserted, by the single user, into the top open end 72 of the hollow cylindrical core 70' of the second roll of water-resistive barrier wrap 140 such that the second lower threaded dowel $\mathbf{424}^{2}$ of the lower barrier wrap bracket 404 and the second upper threaded dowel $\mathbf{426}^{2}$ of the upper barrier wrap bracket 406 are coaxial whereby the second lower threaded dowel $\mathbf{424}^{2}$ and the second upper threaded dowel $\mathbf{426}^{2}$ conjointly support the second roll of water-resistive barrier wrap 140' such that the house wrap can be pulled from the second roll of the water-resistive barrier wrap 140' in a horizontal direction. These additional process steps of the method of use $\mathbf{700}^{701\text{-}712}$ installation of the water-resistive barrier wrap on the exterior wall(s) 78 of the stable structure 76, is repeated until the exterior walls 78 of the stable structure 76 are completely covered by the water-resistive barrier wrap as required by the building code of the jurisdiction of the situs of the residential building or the commercial building.

Figure 17A:
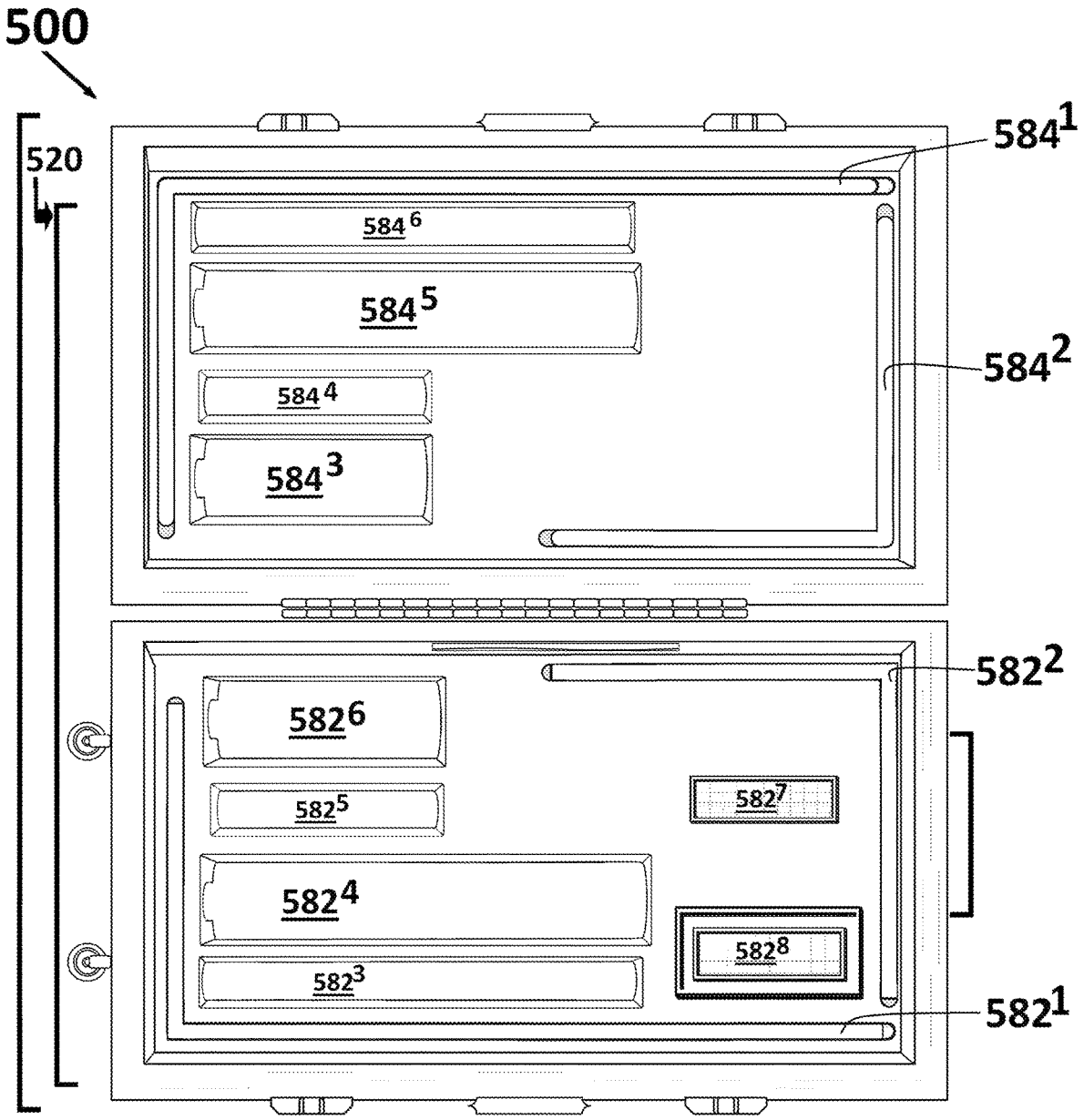
FIG. 17A is a perspective view of a part of a water-resistive barrier wrap dispenser apparatus kit showing the water-resistive barrier wrap dispenser apparatus carrying case.
Figure 17B:
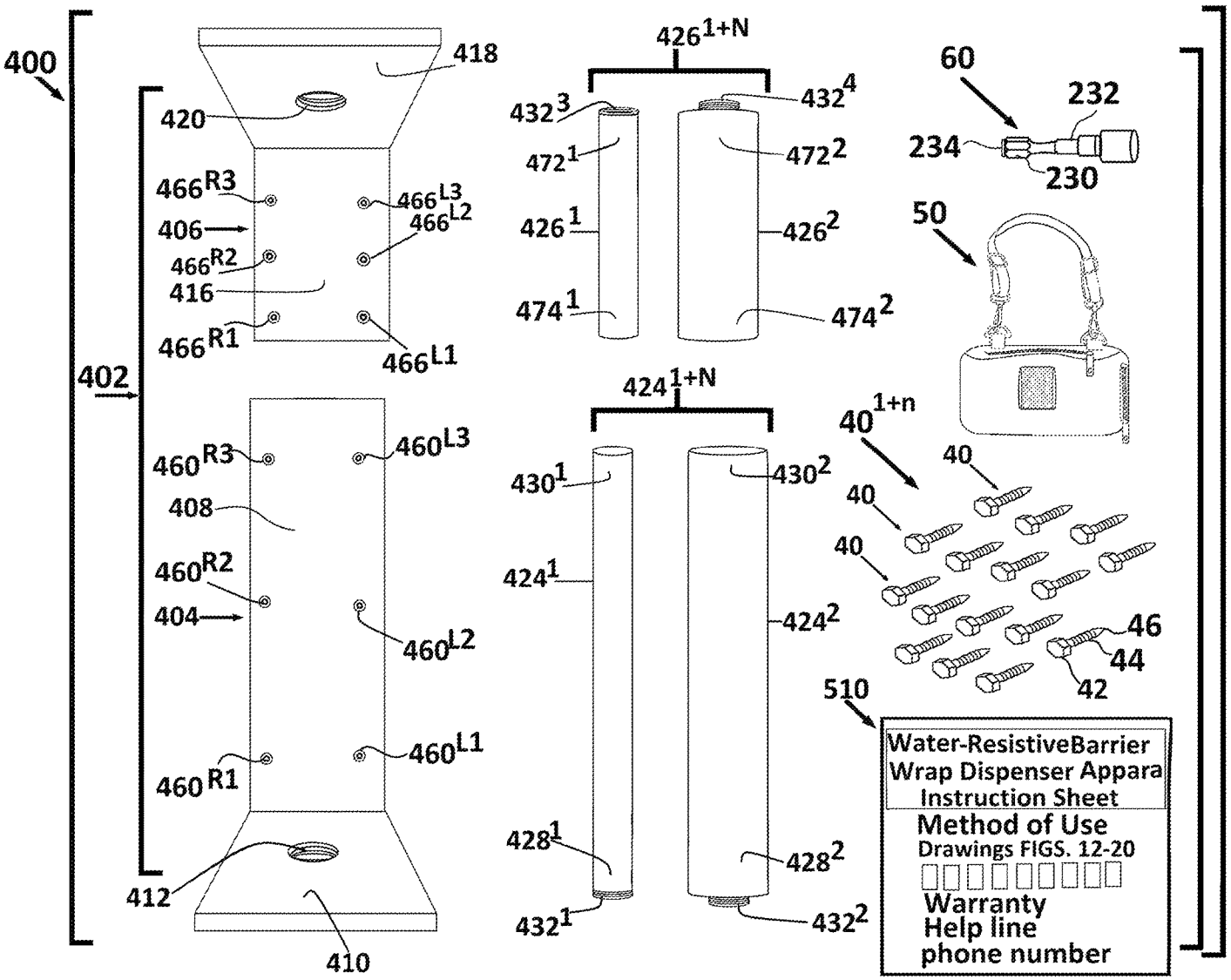
FIG. 17B is a perspective view of the remaining parts of the water-resistive barrier wrap dispenser apparatus kit, of FIG. 17A, including the water-resistive barrier wrap dispenser apparatus, threaded dowels, driver, at least two removable fasteners, and instruction sheet.

The water-resistive barrier wrap dispenser apparatus kit 500, also, includes the bag 50, as illustrated in FIGS. 12 and 17A-17B, with incorporation by reference to FIGS. 10A-10D as previously described. The bag 50 comprises a flexible pouch 208 sized to enclose and contain the at least two removable fasteners $\mathbf{40}^{1+n}$. The flexible pouch 208 includes one or more fastenable openings 212 sized to allow each of the at least two removable fasteners $\mathbf{40}^{1+n}$ to pass through the one or more fastenable openings 212. The bag 50 includes one or more fasteners 214 adapted to close the one or more fastenable openings 212 of the flexible pouch 208 of the bag 50 wherein the one or more fasteners 214 of the fastenable openings 212 of the flexible pouch 208 of the bag 50 are selected from the group consisting of zippers, magnetic closure, hook and loop, snaps.

The house wrap dispenser apparatus kit 200 further includes the bag 50, as illustrated in FIGS. 1 and 6 and FIGS. 10A-10D. FIG. 10 A illustrates a perspective view towards a front face 224 of the bag 50. FIG. 10B is a perspective view towards a rear face 226 of the bag of FIG. 10A. FIG.

10C is another embodiment of the bag of FIG. 10A. FIG. 10D is a perspective view towards the bottom face 228 of the bag of FIG. 10A.

As illustrated in FIG. 10A, the bag 50 comprises a flexible pouch 208 sized to enclose and contain the at least two removable fasteners $\mathbf{40}^{1+n}$ where each of the at least two removable fasteners $\mathbf{40}^{1+n}$ is depicted with the numeral 40. The flexible pouch 208 includes one or more fastenable openings 212 sized to allow each of the at least two removable fasteners $\mathbf{40}^{1+n}$ to pass through the one or more fastenable openings 212. The bag 50 includes one or more fasteners 214 adapted to close the one or more fastenable openings 212 wherein the one or more fasteners 214 of the fastenable openings 212 of the flexible pouch 208 of the bag 50 are selected from the group consisting of zippers, magnetic closure, hook and loop, and snaps.

The bag 50 includes a brand logo 256 disposed on one or more exterior surfaces of the bag 50.

The bag 50, further, includes an adjustable strap 216 where the single user can implement the bag 50 containing the at least two removable fasteners $\mathbf{40}^{1+n}$ having the bag 50 suspended around the user as in a cross-body fashion. The adjustable strap 216 includes two terminal tear drop push gate snap hook clasps, a first terminal tear drop push gate clasp 308 and a second terminal tear drop push gate clasp 310 whereby the adjustable strap 216 can be removed by the user such that the user can utilize one or more wrist bands $\mathbf{218}^{1-n}$ each of which are disposed on multiple faces of the bag 50, as detailed above.

Each of the wrist bands $\mathbf{218}^{1-4}$ of the one or more wrist bands $\mathbf{218}^{1-n}$ is formed stretchable for placing any one of the wrist bands $\mathbf{218}^{1-4}$ around the single user's wrist. Each of the wrist bands $\mathbf{218}^{1-4}$ is constructed having a magnetic member 222 disposed on a peripheral surface of the wrist band $\mathbf{218}^{1-4}$ operable to temporarily hold thereon one or more of the at least two removable fasteners $\mathbf{40}^{1+n}$ while the single user is installing the house wrap dispenser 12 to the exterior wall 78 of the stable structure 76. A first wrist band $\mathbf{218}^{1}$, as shown in FIG. 10A, is fixed to the bag 50 on the exterior surface of a front face 224 of the bag 50, wherein the wrist band is positioned in a vertical orientation, a second wrist band $\mathbf{218}^{2}$ is fixed to a rear face 226 of the bag 50, wherein the wrist band is positioned in a horizontal orientation, and a third wrist band $\mathbf{218}^{3}$ which is positioned on the front face 224 of the bag in a horizontal orientation, and fourth wrist band $\mathbf{218}^{4}$ which is fixed to a bottom face 228 of the bag 50, in a vertical orientation. Each of the wrists bands $\mathbf{218}^{1-4}$ can be fixed to an external surface of the bag 50 in a horizontal or a vertical orientation. In this manner, the single user being left handed or right handed may implement the wrist band 218 in lieu of the adjustable strap 216 to hold the bag 50 containing the at least two removable fasteners $\mathbf{40}^{1+n}$ in a comfortable position around the user's wrist and to temporarily hold one or more of the at least two removable fasteners $\mathbf{40}^{1+n}$ on the magnetic member 222 of the wrist band while the single user is installing the house wrap dispenser 12 on the exterior wall 78 of the stable structure 76.

As illustrated in FIGS. 12, 16A-16B and 18 and in the house wrap dispenser apparatus kit 200 the driver 60 includes a driver head 230 and a driver body 232, the driver head 230 operatively configured with a magnetic portion 234 disposed therein a peripheral surface of the driver head 230. The magnetic portion 234 is magnetically attracted to the one or more of the at least two removable fasteners $\mathbf{40}^{1+n}$.

The water-resistive barrier wrap dispenser apparatus kit 500, further, includes the water-resistive barrier wrap dispenser apparatus instruction sheet 510 for the single user. The house wrap dispenser apparatus instruction sheet 510 includes water-resistive barrier wrap dispenser apparatus instruction sheet 510 including diagrams and drawings of the FIGS. 12-20B, as indicated at 551, of the water-resistive barrier wrap dispenser apparatus 400 and steps of the method of use $\mathbf{700}^{701-722}$ of the water-resistive barrier wrap dispenser apparatus 400 by a single user when installing the selected roll of water-resistive barrier wrap roll 140 on the exterior wall 78 of the stable structure 76, a warranty 550, and a help line phone number 552, as illustrated in FIG. 21.

Figure 19:
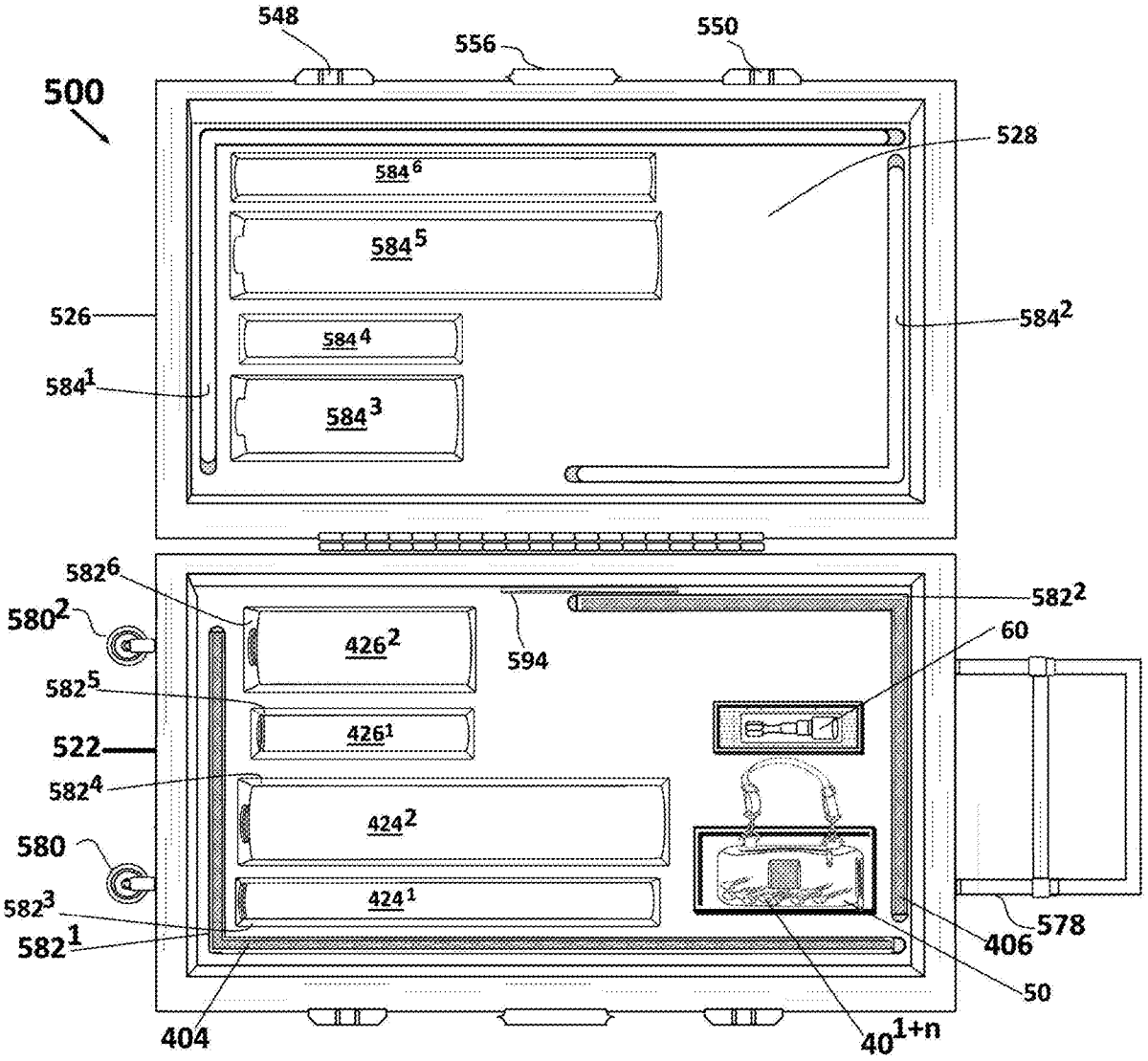
FIG. 19 is a perspective view of the interior of the water-resistive barrier wrap dispenser apparatus carrying case of FIG. 18 containing the water-resistive barrier wrap dispenser apparatus of FIG. 17.
Figure 20B:
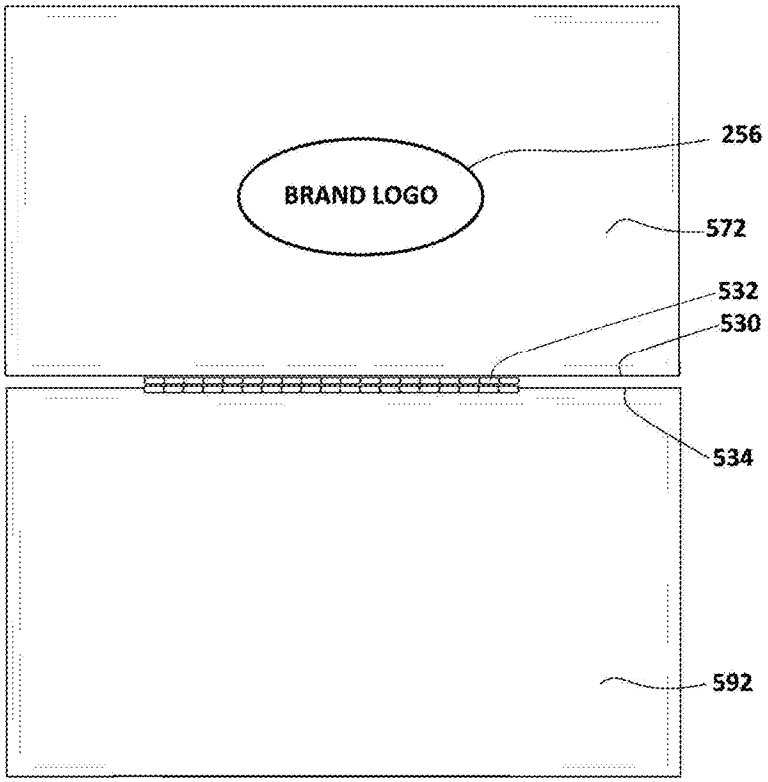
FIG. 20A is a perspective view towards a front face of the water-resistive barrier wrap dispenser apparatus carrying case of FIGS. 17A and 18.
FIG. 20 B is a perspective view towards a rear face of the water-resistive barrier wrap dispenser apparatus carrying case of FIG. 20A.
Figure 20A:
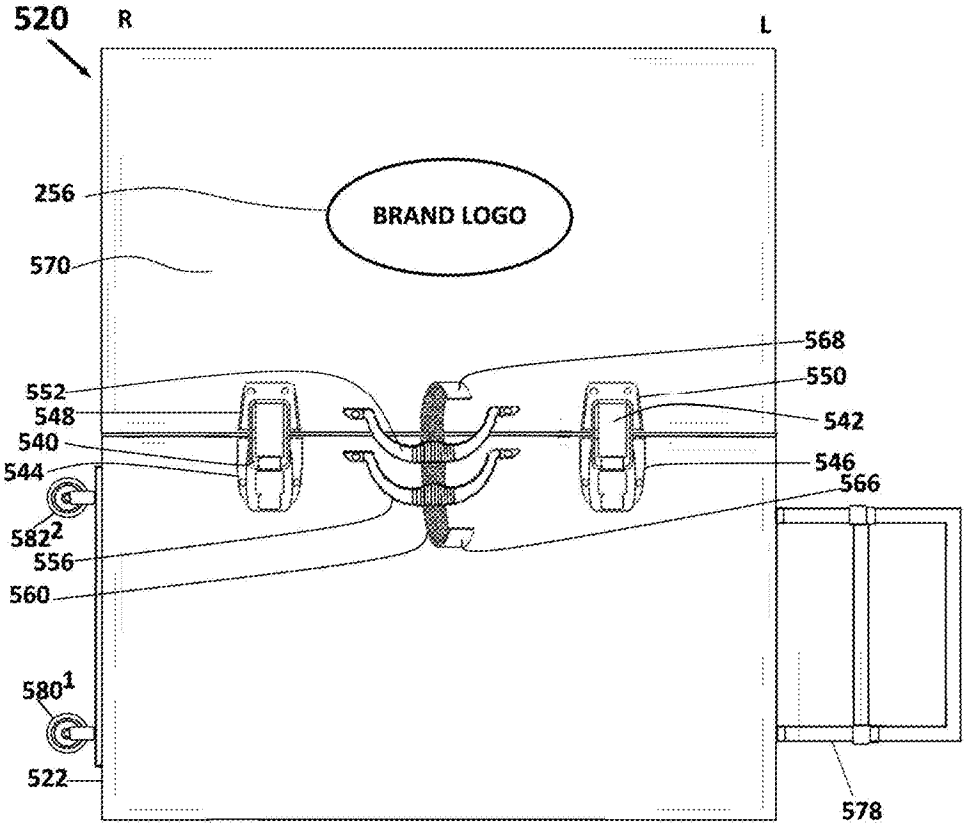
Figure 21:
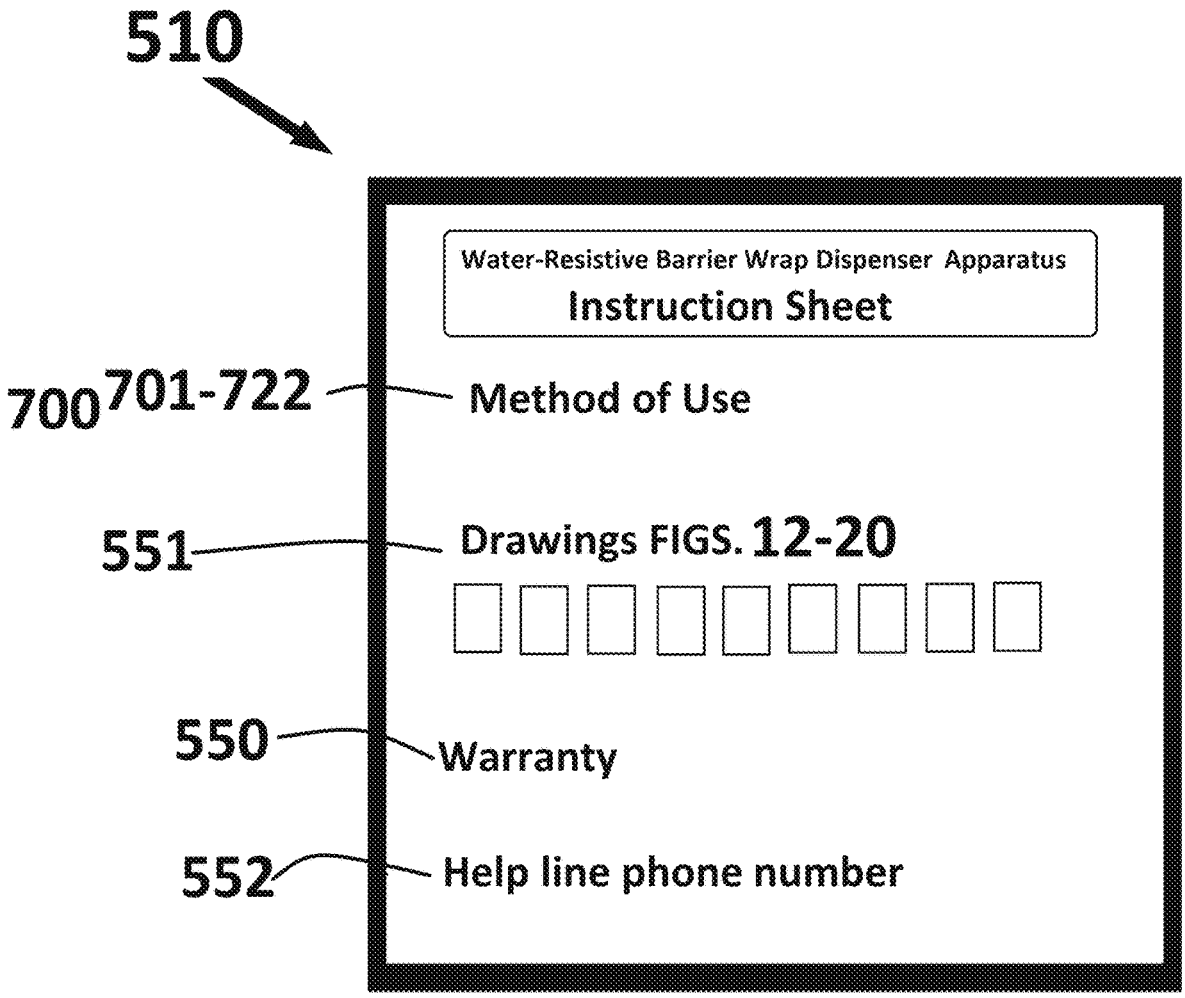
FIG. 21 is an illustration of a water-resistive barrier wrap dispenser apparatus instruction sheet of the water-resistive barrier wrap dispenser apparatus kit of FIGS. 17A-17B.

The water-resistive barrier wrap dispenser apparatus instruction sheet 510 as illustrated in FIG. 21, with reference to FIGS. 12-20B, includes the method of use $\mathbf{700}^{701-712}$ of the water-resistive barrier wrap dispenser apparatus 400, including the process of using the water-resistive barrier wrap $\mathbf{700}^{701-712}$ comprising providing the exterior wall(s) 78 of the stable structure 76, residential building or commercial building at step 701, providing the roll(s) of water-resistive barrier wrap 140 at step 702, providing the water-resistive barrier wrap dispenser kit 500 including the water-resistive barrier wrap dispenser 402, the bag 50 including the at least two removable fasteners $\mathbf{40}^{1+n}$, the driver 60, the first set of unthreaded lower dowels $\mathbf{424}^{1+n}$, the second set of upper threaded dowels $\mathbf{426}^{1+n}$ and the house wrap dispenser carrying case 520, at step 703; selecting the lower wrap barrier bracket 404 and a first lower threaded dowel $\mathbf{424}^{1}$ and threadably connecting the first lower threaded dowel $\mathbf{424}^{1}$ to the first threaded annular anchor hole 412 of the lower base plate 410 of the lower water barrier wrap bracket 404, at step 704; selecting the upper wrap barrier bracket 406 and a first upper threaded dowel $\mathbf{426}^{1}$ and threadably connecting the first lower threaded dowel $\mathbf{424}^{1}$ to the second threaded annual anchor hole 420 of the upper base plate 418 of the upper barrier wrap bracket 406, at step 705; removably attaching the lower barrier wrap bracket 404 to the first exterior wall area 80 of the exterior wall 78 of the stable structure 76 by means of the at least two removable fasteners $\mathbf{40}^{1+n}$ inserted therethrough each of the lower unthreaded anchor holes $\mathbf{460}^{1+n}$, and actuated by the driver 60 to engage with the first exterior wall area 80, at step 706, mounting the roll of water-resistive barrier wrap 140 onto the first lower threaded dowel $\mathbf{424}^{1}$ by inserting the distal end 430 of the first lower threaded dowel $\mathbf{424}^{1}$ into the bottom open end 74 of the hollow cylindrical core 70' of the roll of water-resistive barrier wrap 140 whereby the first lower threaded dowel $\mathbf{424}^{1}$ occupies a lower portion of the roll of water-resistive barrier wrap 140 at step 707; removably affixing the upper barrier wrap bracket 406 to the second exterior wall area 82 of the exterior wall 78 of the stable structure 76 by means of the at least two removable fasteners $\mathbf{40}^{1+n}$ inserted therethrough each of the upper unthreaded anchor holes $\mathbf{466}^{1+n}$, and actuated by the driver 60 to engage with the second exterior wall area 82, whereby the first upper threaded dowel $\mathbf{426}^{1}$ is coaxial with the first lower threaded dowel $\mathbf{424}^{1}$ at step 708 whereby the first lower threaded dowel $\mathbf{424}^{1}$ and the first upper threaded dowel $\mathbf{426}^{1}$ are supporting the roll of water-resistive barrier wrap 140 in an upright orientation; unrolling the water-resistive barrier wrap in an horizontal direction and affixing via stapling and/or nailing the water-resistive barrier wrap 140 to the exterior wall 78 of the stable structure 76, residential building, or commercial building until the roll of water-resistive barrier wrap 140 is depleted of water-resistive barrier wrap 140, at step 709; detaching the lower barrier wrap bracket 404 and detaching the upper barrier wrap bracket 406 from the exterior wall 78, at step 711; dismounting the hollow cylindrical core 70' of the water-resistive barrier wrap from the first lower threaded dowel $424^1$ and the first upper threaded dowel $426^1$, at step 712; repeating steps including $700^{701-712}$ to a second location on the exterior wall(s) 78 of the stable structure 76, wherein providing a second roll of house wrap $140^2$, and repeating steps $700^{701,12}$ until completion of the single user installing the water-resistive barrier wrap on the exterior walls 78 of the stable structure 76, residential building or commercial building.

With this embodiment, in particular, the water-resistive barrier wrap dispenser apparatus 400 including the multiplicity of threaded dowels $446^{1+n}$, method of use process steps $700^{701-712}$ of the water-resistive barrier wrap dispenser apparatus 400 can further include, as shown in FIGS. 16A-16B disconnecting the first lower threaded dowel $424^1$ from the first threaded annular anchor hole 412 of the lower wall plate 408 of the lower barrier wrap bracket 404 and disconnecting the first upper threaded dowel $426^1$ from the second threaded annular anchor hole 420 of the upper base plate 418 of the upper barrier wrap bracket 406, at step 713; threadably connecting the second lower threaded dowel $424^2$ to the first threaded annular anchor hole 412 and threadably connecting the second upper threaded dowel $426^2$ to the second threaded annular anchor hole 420, at step 714 wherein the second lower threaded dowel $424^2$ and the second upper threaded dowel $426^2$ include a cylindrical core diameter that is greater than the cylindrical core diameter of the first lower threaded dowel $424^1$ and the first upper threaded dowel $426^1$, respectively; removably affixing the first lower barrier wrap bracket 404 to the third exterior wall area 80' at step 715; mounting the second roll of water-resistive barrier wrap $140^2$ onto the second lower threaded dowel $424^2$ wherein the second roll of water-resistive barrier wrap $140^2$ which includes a cylindrical core diameter that is greater than the first cylindrical core diameter of the first roll of water-resistive barrier wrap 140 such that the second lower threaded dowel $424^2$ can readily be inserted therethrough the second cylindrical core of the second roll of water-resistive barrier wrap $140^2$ at step 715; removably attaching the upper barrier wrap bracket 406 to a fourth exterior wall area 82' of the exterior wall of the stable structure 76, residential building, or commercial building, at step 716; inserting the distal end $474^2$ of the second upper threaded dowel $426^2$ into the top open end 72 of the second roll of the water-resistive barrier wrap $140^2$, at step 717; removably affixing the upper barrier wrap bracket 406 to the fourth exterior wall area 82' of the exterior wall 78 of the stable structure 76, residential building, or commercial building, at step 718 such that the second lower threaded dowel $424^2$ and the second upper threaded dowel $426^2$ are coaxial to each other whereby the second lower threaded dowel $424^2$ and the second upper threaded dowel $426^2$ conjointly support the second roll of water-resistive barrier wrap $140^2$; unrolling the water-resistive barrier wrap from the second roll of water-resistive barrier wrap $140^2$ in a horizontal direction and stapling and/or nailing the water-resistive barrier wrap to the remaining exterior wall areas of the exterior wall(s) 78 of the stable structure 76, residential building, or commercial building, at step 719, and repeating the method of use $700^{701-719}$, as needed, or as until the exterior wall(s) are completely covered by the water-resistive barrier wrap.

The water-resistive barrier wrap dispenser apparatus kit 500, further includes, the water-resistive barrier wrap dispenser apparatus carrying case 520, as illustrated in FIGS. 16A-16B and 17A-17B, for transporting and storing the water-resistive barrier wrap dispenser apparatus 400, including the water-resistive barrier wrap dispenser 402, the bag 50, containing the at least two removable fasteners $40^{1+n}$, the driver 60, the water-resistive wrap dispenser apparatus instruction sheet 510 for the single user. As illustrated in FIGS. 20A-20B, the water-resistive barrier wrap dispenser apparatus carrying case 520 includes a main body 522 having an elongated box shape, the main body 522 including a bottom interior storage portion 524 and a lid member 526 with an elongated box shape sized to correspond to the elongated box shape of the main body 522 wherein the lid member 526 includes a top interior storage portion 528. The main body 522 includes a front wall 590 and a rear wall 592, a first side wall 574 and an opposing second side wall 576. The lid member 526 includes a front wall 570 and a rear wall 572 and a first side wall 574" and an opposing second side wall 576".

In this embodiment, the lid member 526 and the main body 522 of the house wrap dispenser apparatus carrying case 520 are made with substrates selected from the group of substrates consisting of molded polymer resin and plastic. In another embodiment the water-resistive barrier wrap dispenser apparatus carrying case 520 including the main body 522 and the lid member 526 comprise a hard wood. In another embodiment the water-resistive barrier wrap dispenser apparatus carrying case 520 including the main body 522 and the lid member 526 are made with substrates selected from the group of substrates consisting of metal, steel and aluminum.

FIGS. 20A-1206 illustrate, the lid member 526 includes a rear edge 530 which is hingedly connected by at least one shaft 532 to a rear edge 534 of the main body 522 at corresponding portions of a first peripheral rear surface of the lid member 526 and a second peripheral rear surface of the main body 522 whereby the lid member 526 and the main body 522 are operable for movement between a closed position and an open position. The lid member 526, further, includes an outer surface which includes a brand logo 256 placed thereon facing outward when the bottom interior storage portion of the main body 522 is closed by the lid member 526.

The water-resistive barrier wrap dispenser apparatus carrying case 520, as illustrated in FIG. 20A, includes a locking mechanism 538 having two latches including a right latch 540 and a left latch 542, wherein the main body 522 is provided with a right latch body portion 544 and a left latch body portion 546 positioned on a right peripheral surface of the main body 522 and at a left peripheral surface of the main body 522, respectively, configured to be engageable with a right latch lid portion 548 and a left latch lid portion 550 positioned on a corresponding right peripheral surface and a left peripheral surface of the lid member 526, respectively, and wherein when being engaged the lid member 526 is locked in a position that the open bottom interior storage portion 524 of the main body 522 is closed by the lid member 526.

Further, as illustrated in FIG. 20A, the water-resistive barrier wrap dispenser apparatus carrying case 520 includes a first handle 552, having a first opening 554, affixed to a peripheral front surface of the lid member 526 by means of a fastener means including nails or screws, centered between the right latch lid portion 548 and the left latch lid portion 550, and a second handle 556, having a second opening 558, affixed to a peripheral front surface of the main body 522 by means of a fastener means including nails or screws, centered between the right latch body portion 544 and the left latch body portion 546.

A strap 560, as illustrated in FIG. 20A, is implemented to facilitate maintaining the first handle 552 and the second handle 556 together during transport of the water-resistive barrier wrap dispenser apparatus carrying case 520 to ensure the lid member 526 does not separate from the main body 522 in the event the right latch 540 and the left latch 542 are not secured. The strap 560 includes two ends and a length therebetween, a first end 562 and a second end 564, the strap 560 fixedly fastened to the first handle 552 and the second handle 556 whereby the strap 560 is deployable between the first opening 554 of the first handle 552 and therethrough the second opening 558 of the second handle 556 to fixedly secure the first handle 552 and the second handle 556 contiguous to each other during transportation and storage, wherein the first end 562 includes an incipient magnetic element 566 having a first polarity and the second end 564 includes a terminal magnetic element 568 having a second polarity opposite to the first polarity whereby the first end 562 of the strap 560 is attracted to the second end 564 of the strap 560.

The water-resistive barrier wrap dispenser apparatus carrying case 520, further, includes an expandable handle 578, as illustrated in FIGS. 19 and 20A, affixed to the first side wall 574 by a first fastening means including nails, or screws, or other like operable fastening means, and a set of two or more swivel caster wheels 580 affixed by means of a second fastening means including nails or screws, or other like operable fastening means, to the opposing second side wall 576 of the main body 522, to enable the user with easy movement of the water-resistive barrier wrap dispenser apparatus carrying case 520 along a floor, truck bed, or other surface.

Figure 18:
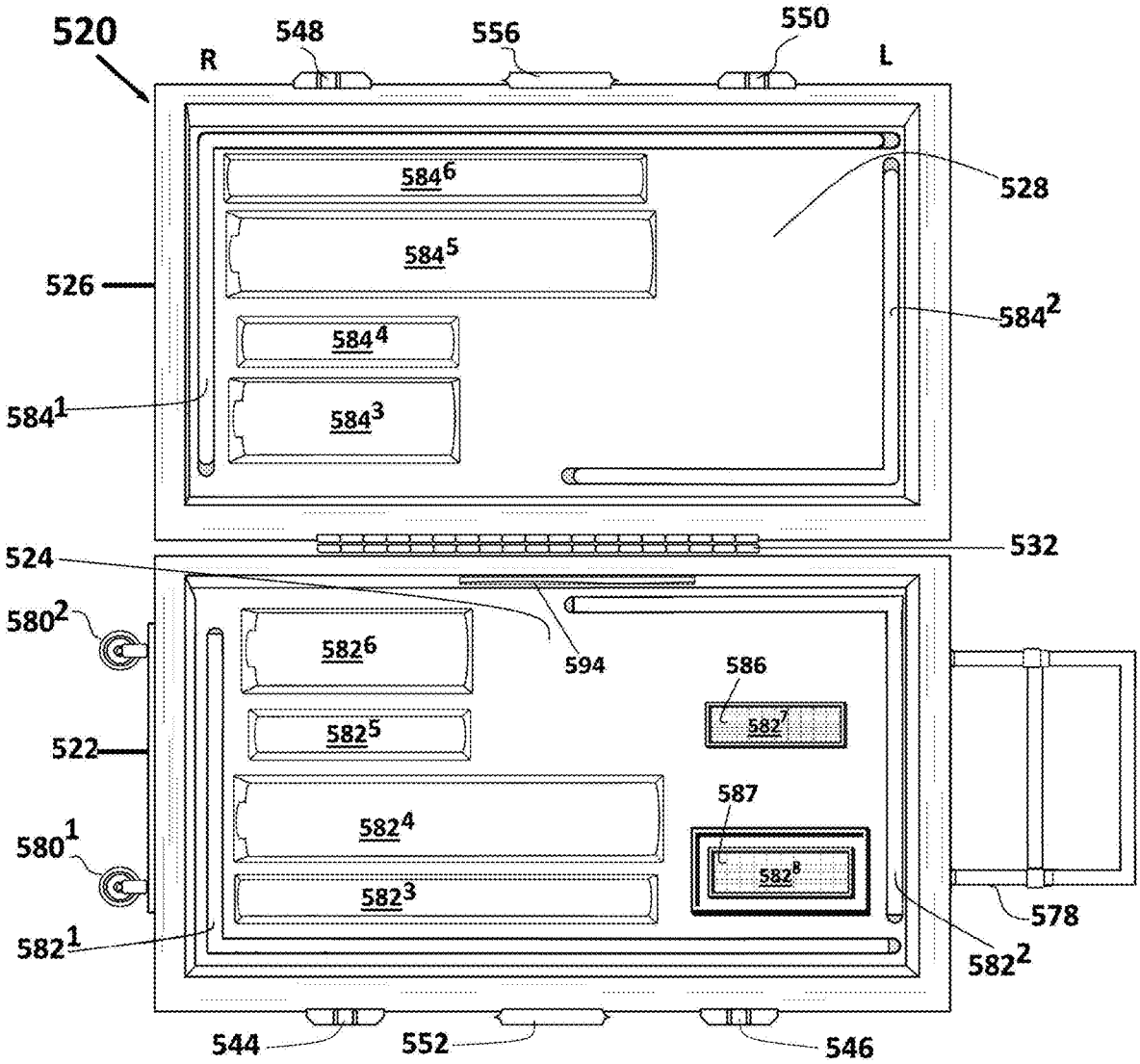
FIG. 18 is a perspective view of an interior of a water-resistive barrier wrap dispenser apparatus carrying case of FIGS. 17A-17B.

The bottom interior storage portion 524, as illustrated in FIGS. 18-19, of the main body 522 of the water-resistive barrier wrap dispenser apparatus carrying case 520 includes a bottom interior recessed stage fabricated with a number of bottom sunken seated areas $\mathbf{582}^{1+n}$, and the top interior storage portion 528 of the lid member 526 includes a top interior recessed stage fabricated with a number of top sunken seated areas $\mathbf{584}^{1+n}$ The number of bottom sunken seated areas $\mathbf{582}^{1+n}$ includes a first bottom sunken seated area $\mathbf{582}^{1}$ having a first L-shape integrally sculpted and sized to receive and urge a right peripheral side edge of the lower barrier wrap bracket 404 into the first bottom sunken seated area $\mathbf{582}^{1}$, and the top interior storage portion 528 of the lid member 526 includes a corresponding first top sunken seated area $\mathbf{584}^{1}$ having a second L-shape integrally sculpted and sized in a mirror image of the first L-shape of the first bottom sunken seated area $\mathbf{582}^{1}$ to receive and urge a left peripheral side edge of the lower barrier wrap bracket 404 into the first top sunken seated area $\mathbf{584}^{1}$ wherein when the main body 522 is closed by the lid member 526.

The bottom interior storage portion 524 of the main body 522 of the water-resistive barrier wrap dispenser apparatus carrying case 520, further includes, a second bottom sunken seated area $\mathbf{582}^{2}$ having a first inverted L-shape, as illustrated in FIG. 18-19, integrally sculpted and sized to receive and urge a right peripheral side edge of the upper barrier wrap bracket 406 into the second bottom sunken seated area $\mathbf{582}^{2}$, and the top interior storage portion 528 of the lid member 526 includes a corresponding second top sunken seated area $\mathbf{584}^{2}$ having a second inverted L-shape integrally sculpted and sized in a mirror image of the first inverted L-shape of the second bottom sunken seated area $\mathbf{582}^{2}$ to receive and urge a left peripheral side edge of the upper barrier wrap bracket 406 into the second top sunken seated area $\mathbf{584}^{2}$. Whereby, with this embodiment, the lower barrier wrap bracket 404 and the upper barrier wrap bracket 406 are removably seated within the water-resistive barrier wrap dispenser apparatus carrying case 520 having the lower barrier wrap bracket 404 congruent with the upper barrier wrap bracket 406 wherein when the main body 522 is closed by the lid member 526.

The bottom interior storage portion 524 of the main body 522 of the water-resistive barrier wrap dispenser apparatus carrying case 520, further, includes a third bottom sunken seated area $\mathbf{582}^{3}$ having a first semi-cylindrical shape integrally sculpted and sized to receive and urge a first circumferential surface of the first lower threaded dowel $\mathbf{424}^{1}$ into the third bottom sunken seated area $\mathbf{582}^{3}$, and the top interior storage portion 528 of the lid member 526 includes a corresponding third top sunken seated area $\mathbf{584}^{3}$ having a second semi-cylindrical shape integrally sculpted and sized in a mirror image of the first semi-cylindrical shape of the third bottom sunken seated area $\mathbf{582}^{3}$ to receive and urge a second circumferential surface of the first lower threaded dowel $\mathbf{424}^{1}$ into the third top sunken seated area $\mathbf{584}^{3}$ whereby the first threaded dowel $\mathbf{424}^{1}$ is removably seated within the house wrap dispenser apparatus carrying case 520 wherein when the main body 522 is closed by the lid member 526.

The bottom interior storage portion 524 of the main body 522 of the water-resistive barrier wrap dispenser apparatus carrying case 520, further includes, a fourth bottom sunken seated area $\mathbf{582}^{4}$, as illustrated in FIGS. 18-19, having a third semi-cylindrical shape integrally sculpted and sized to receive and urge a first circumferential surface of a second lower threaded dowel $\mathbf{424}^{2}$ into the fourth bottom sunken seated area $\mathbf{582}^{4}$, and the top interior storage portion 528 of the lid member 526 includes a corresponding fourth top sunken seated area $\mathbf{584}^{4}$ having a fourth semi-cylindrical shape integrally sculpted and sized in a mirror image of the third semi-cylindrical shape of the fourth bottom sunken seated area $\mathbf{582}^{4}$ to receive and urge a second circumferential surface of the second lower threaded dowel $\mathbf{424}^{2}$ into the fourth top sunken seated area $\mathbf{584}^{4}$ whereby the second lower threaded dowel $\mathbf{424}^{2}$ is removably seated within the water-resistive barrier wrap dispenser apparatus carrying case 520 wherein when the main body 522 is closed by the lid member 526.

The bottom interior storage portion 524 of the main body 522 of the water-resistive barrier wrap dispenser apparatus carrying case 520, further includes, a fifth bottom sunken seated area $\mathbf{582}^{5}$, as illustrated in FIGS. 18-19 having a fifth semi-cylindrical shape integrally sculpted and sized to receive and urge a first circumferential surface of a first upper threaded dowel $\mathbf{426}^{1}$ into the fifth bottom sunken seated area $\mathbf{582}^{5}$, and the top interior storage portion 528 of the lid member 526 includes a fifth top sunken seated area $\mathbf{584}^{5}$ having a sixth semi-cylindrical shape integrally sculpted and sized in a mirror image of the fifth semi-cylindrical shape of the fifth bottom sunken seated area $\mathbf{582}^{5}$ to receive and urge a second circumferential surface of the first upper threaded dowel $\mathbf{426}^{1}$ into the fifth top sunk seated area $\mathbf{584}^{5}$ whereby the first upper threaded dowel $\mathbf{426}^{1}$ is removably seated within the water-resistive barrier wrap dispenser apparatus carrying case 520 wherein when the main body 522 is closed by the lid member 526.

The bottom interior storage portion 524 of the main body 522 of the water-resistive barrier wrap dispenser apparatus carrying case 520, further includes, a sixth bottom sunken seated area 582$^6$, as illustrated in FIGS. 18-19, having a seventh semi-cylindrical shape integrally sculpted and sized to receive and urge a first circumferential surface of a second upper threaded dowel 426$^2$ into the sixth bottom sunken seated area 582$^6$, and the top interior storage portion 528 of the lid member 526 includes a corresponding sixth top sunken seated area 584$^6$ having an eighth semi-cylindrical shape integrally sculpted and sized in a mirror image of the seventh semi-cylindrical shape of the sixth bottom sunk seated area 582$^6$ to receive and urge a second circumferential surface of the second upper threaded dowel 426$^2$ into the sixth top sunken seated area 584$^6$ whereby the second upper threaded dowel 426$^2$ is removably seated within the water-resistive barrier wrap dispenser apparatus carrying case 520 wherein when the main body 522 is closed by the lid member 526.

The bottom interior storage portion 524 of the main body 522 of the water-resistive barrier wrap dispenser apparatus carrying case 520, further includes, a seventh bottom sunken seated area 582$^7$, as illustrated in FIGS. 17A-18, having an elongated rectangular shape integrally sculpted and sized to urge the driver 60 therein, the seventh bottom sunken seated area 582$^7$ having a floor 588 and side walls 590 layered with a first magnetic membrane 586 whereby the magnetic portion 234 of the driver head 230 is magnetically attracted to the first magnetic membrane 586.

The bottom interior storage portion 524 of the main body 522 of the water-resistive barrier wrap dispenser apparatus carrying case 520, further includes, an eighth bottom sunken seated area 582$^8$, as illustrated in FIGS. 18-19, is configured in a geometric shape integrally sculpted and sized to urge the bag 50 having the at least two removable fasteners 40$^{1+n}$ contained therein, the eighth bottom sunken seated area 582$^8$ having a geometric shaped floor 536 and geometric shaped side walls 537, wherein the geometric shaped floor 536 is layered with a second magnetic membrane 592 such that the bag 50 is orientated in an upright position and whereby the at least two removable fasteners 40$^{1+n}$ contained therein are pulled by the second magnetic membrane 592 to a bottom interior region of the bag 50.

The bottom interior storage portion 524 of the main body 522 of the water-resistive barrier wrap dispenser apparatus carrying case 520, further includes, an expandable pocket 594, (not illustrated) fabricated on an interior side wall of the main body 522. The expandable pocket 594 includes a top opening 596 having an elasticized top rim 598 to provide access to an interior cavity, a front face surface having a transparent window 599 (not shown) so that the user can view the contents of the expandable pocket 594. The interior cavity 546 includes a volume capable of maintaining the house wrap dispenser apparatus instruction sheet 510 therein.

The water-resistive barrier wrap dispenser apparatus carrying case 520 including the main body 522 and the lid member 526 can be made with a substrate selected from the group consisting of metal, steel, and aluminum. In another embodiment the water-resistive barrier wrap dispenser apparatus carrying case 520 includes the main body 522 and the lid member 526 which can be made with a hard wood.

As disclosed above, the first set of lower threaded dowels 424$^{1-n}$ and the second set of upper threaded dowels 426$^{1-n}$ includes diameters selected from the group consisting of 1.0 inch, 2.0 inches, and 3.0 inches. In addition, in another embodiment the first set of lower threaded dowels 424$^{1-n}$ and the second set of upper threaded dowels 426$^{1-n}$ can be customized, sized and dimensioned to include a variety of lower threaded dowel 424$^{1-n}$ diameters and upper threaded dowel 426$^{1-n}$ diameters and upper threaded dowel 426$^{1-n}$ lengths, to receive any one of a variety of rolls of water-resistive barrier wrap 140 having a variety of cylindrical core diameters, lengths and surface areas. Further, the water-resistive barrier wrap dispenser 402 can, also, be customized to include the lower wall plate 408 and the upper wall plate 416 to include a variety of lower wall plate 408 lengths, widths, and depths, and upper wall plate 416 lengths, widths, and depths, a variety of lower base plate 410 side lengths, side widths, and depths, and a variety of upper base plate 418 side lengths, side widths, and depths.

The bottom interior storage portion 524 of the main body 522 and the top interior storage portion 528 of the lid member 526 of the water-resistive barrier wrap dispenser apparatus carrying case 520 can be customized to be sized and dimensioned, and configured to carry a variety of sizes of water-resistive barrier wrap dispenser apparatuses 400.

While one or more embodiments of the present invention have been illustrated in detail, the skilled artisan will appreciate that modifications and adaptions to those embodiments may be made without departing from the scope of the present invention, as set forth in the following claims.

What is claimed is:

1. A house wrap dispenser apparatus, for use by a single user, adapted to use with a roll of a house wrap of one or more rolls of the house wrap used to install on an exterior wall of one or more exterior walls of a stable structure, the exterior wall having a longitudinal axis, the roll of the house wrap having a given length, and a hollow cylindrical core limited by a top open end, a bottom open end, and a cylindrical core diameter, the house wrap dispenser apparatus, comprising:

a house wrap dispenser;

a bag to contain at least two removable fasteners;

a driver operably configured to actuate the at least two removable fasteners;

the house wrap dispenser, comprising:

a set of two independent house wrap brackets including a lower house wrap bracket operatively associated with an upper house wrap bracket, the lower house wrap bracket including a lower wall plate, a lower base plate, and a lower non-rotative dowel, the upper house wrap bracket including an upper wall plate, an upper base plate, and an upper non-rotative dowel, wherein the lower house wrap bracket is removably attached to a first exterior wall area of the exterior wall and the upper house wrap bracket is removably attached to a second exterior wall area of the exterior wall of the stable structure such that the lower non-rotative dowel of the lower house wrap bracket is oriented facing the upper non-rotative dowel of the upper house wrap bracket whereby a lower wall plate medial axis of the lower wall plate is aligned with an upper wall plate medial axis of the upper wall plate, having the upper house wrap bracket spaced above from the lower house wrap bracket a distance greater than the given length of the roll of the house wrap whereby the bottom open end of the roll of house wrap is received by the lower non-rotative dowel and the top open end of the roll of house wrap is received by the upper non-rotative dowel such that the lower non-rotative dowel and the upper non-rotative dowel conjointly support the roll of house wrap in an upright orientation for rotation of the roll of the house wrap relative to the lower non-rotative dowel and the upper non-rotative dowel whereby the roll of house wrap can unroll in a horizontal direction relative to the exterior wall of the stable structure;

wherein the lower wall plate includes a first elongated rectangular plane having a lower wall plate length, a lower wall plate width, and a lower wall plate depth;

a first 1.0 inch measuring notch etched on a first peripheral surface of a right side face of the lower wall plate measured vertically upward from a right inferior edge of the lower wall plate, a first 2.0 inch measuring notch etched on a second peripheral surface of the right side face of the lower wall plate measured vertically upward from the right inferior edge of the lower wall plate, a first 6.0 inch measuring notch etched on a third peripheral surface of the right side face of the lower wall plate measured vertically upward from the right inferior edge of the lower wall plate;

a second 1.0 inch measuring notch etched on a first peripheral surface of a left side face of the lower wall plate measured vertically upward from a left inferior edge of the lower wall plate, a second 2.0 inch measuring notch etched on a second peripheral surface of the left side face of the lower wall plate measured vertically upward from the left inferior edge of the lower wall plate, and a second 6.0 inch measuring notch etched on a second peripheral surface of the left side face of the lower wall plate measured vertically upward from the left inferior edge of the lower wall plate;

a first number of lower unthreaded anchor holes integrally formed therethrough the lower wall plate disposed in a first series of one or more lower rows aligned in widthwise rows along the lower wall plate length whereby one or more pairs of a right lower unthreaded anchor hole and a left lower unthreaded anchor hole are disposed symmetrically parallel to each other spaced equidistant from the lower wall plate medial axis;

wherein each of the first number of the lower unthreaded anchor holes includes an inner diameter and a depth, the depth equal to the lower wall plate depth, configured to receive any one of the at least two removable fasteners to selectively attach, detach, and reattach the lower wall plate to one or more exterior wall areas of the exterior wall of the stable structure wherein each of the any one of the at least two removable fasteners is compliant with each of the first number of the lower unthreaded anchor holes whereby each of the any one of the at least two removable fasteners includes an anchor head having an anchor head diameter greater than the inner diameter of each of the first number of the lower unthreaded anchor holes and an anchor body connected to and extending longitudinally from the anchor head to a sharply tapered distal end of the anchor body, the anchor body having an anchor body diameter less than the inner diameter of each of the first number of the lower unthreaded anchor holes, and a body length greater than the depth of each of the first number of the lower unthreadable anchor holes such that the anchor body is inset into the first exterior wall area a wall distance being operable to uphold the lower house wrap bracket stationary on the exterior wall of the stable structure;

wherein the lower base plate is cojoined to the lower wall plate at a right angle along a frontal inferior marginal edge of the lower wall plate and a transversal marginal edge of the lower base plate, the lower base plate having a first horizontal plane with a geometric shape to support the lower non-rotative dowel;

wherein the lower non-rotative dowel having a lower non-rotative dowel proximal end and a lower non-rotative dowel distal end, a lower non-rotative dowel diameter which is less than the cylindrical core diameter of the roll of house wrap of the one or more rolls of house wrap, a lower non-rotative dowel length which is less than the given length of the roll of house wrap, less than the length of the lower wall plate, and greater than an upper non-rotative dowel length;

wherein the lower non-rotative dowel proximal end is integrally affixed to a central portion of a top face of the lower base plate whereby the lower non-rotative dowel is affixed in an vertically upright orientation, wherein a peripheral circumferential surface of the lower non-rotative dowel is spaced a predetermined distance from a peripheral flat surface of a front face of the lower wall plate, the predetermined distance being at least greater than a radius of the roll of the house wrap;

wherein the upper wall plate includes a second upper elongated rectangular plane having an upper wall plate length which is less than the lower wall plate length, an upper wall plate width and an upper wall plate depth, the upper wall plate width and the upper wall plate depth equal to the lower wall plate width and lower wall plate depth, respectively;

a second number of upper unthreaded anchor holes integrally formed therethrough the upper wall plate disposed in a second series of one or more upper rows aligned in widthwise rows along the upper wall plate length whereby a pair of one or more pairs of a right upper unthreaded anchor hole and a left upper unthreaded anchor hole are disposed symmetrically parallel to each other spaced equidistant from the upper wall plate medial axis;

wherein each of the second number of upper unthreaded anchor holes includes an inner diameter and a depth equal to the inner diameter and the depth of each of the first number of the lower unthreaded anchor holes configured to receive any one of the at least two removable fasteners to selectively attach, detach, and reattach the upper wall plate to one or more exterior wall areas of the exterior wall of the stable structure wherein each of the any one of the at least two removable fasteners is compliant with each of the second number of upper unthreaded anchor holes whereby each of the at least two removable fasteners includes the anchor head having the anchor head diameter greater than the inner diameter of the upper unthreaded anchor hole and the anchor body connected to and extending longitudinally from the anchor head to a sharply tapered distal end of the anchor body, the anchor body having the anchor body diameter less than the inner diameter of the upper unthreaded anchor hole, and the anchor body length greater than the depth of the upper unthreadable anchor hole such that the anchor body is inset into the second exterior wall area the wall distance being operable to uphold the upper house wrap bracket stationary on the exterior wall of the stable structure;

the upper base plate is conjoined to the upper wall plate at a right angle along a frontal superior marginal edge of the upper wall plate and a transversal marginal edge of the upper base plate, the upper base plate having a horizontal plane in a geometric shape to support the upper non-rotative dowel;

wherein the upper non-rotative dowel having an upper non-rotative dowel proximal end, an upper non-rotative dowel distal end, an upper non-rotative dowel diameter which is equal to the lower non-rotative dowel diameter that is less than the cylindrical core diameter of the hollow cylindrical core of the roll of the house wrap, an upper non-rotative dowel length which is less than the length of the roll of house wrap, less than the length of the upper wall plate, and less than the length of the lower non-rotative dowel length; and wherein the upper non-rotative dowel proximal end is integrally affixed to a central portion of a bottom face of the upper base plate such that the upper non-rotative dowel is affixed in a vertically downward orientation at a second predetermined distance measured from a front face of the upper wall plate to a peripheral circumferential surface of the upper non-rotative dowel, the second predetermined distance is equal to the first predetermined distance being at least greater than a radius of the roll of the house wrap whereby the upper non-rotative dowel is aligned coaxial with the lower non rotative dowel.

2. The house wrap dispenser apparatus, according to claim 1, wherein the lower house wrap bracket is removably attached at the first exterior wall area prior to removably attaching the upper house wrap bracket to the second exterior wall area to facilitate placement and replacement of the roll of house wrap of the one or more rolls of the house wrap on the lower non-rotative dowel and to accommodate a plurality of lengths, and widths of house wrap.

3. The house wrap dispenser apparatus, according to claim 1, wherein the lower house wrap bracket and the upper house wrap bracket is manufactured from at least one of the materials selected from the group consisting of metal, steel, and aluminum.

4. The house wrap dispenser apparatus, according to claim 1, wherein the lower house wrap bracket and the upper house wrap bracket is manufactured from at least one of the materials selected from the group consisting of polymer resin, and plastic.

5. The house wrap dispenser apparatus, according to claim 1, wherein the lower non-rotative dowel diameter, the lower non-rotative dowel length, the upper non-rotative dowel diameter and the upper non-rotative dowel length, can be sized to receive any one of a variety of rolls of house wrap having a variety of cylindrical core diameters and lengths.

6. The house wrap dispenser apparatus, according to claim 1, wherein the at least two removable fasteners include any one of removable fasteners selected from the group of removable fasteners consisting of screws, full bearing screws, washer faced screws, double chamfered screws, square screws, knurled head screw, eyebolt screws, and lag screws.

7. The house wrap dispenser apparatus, according to claim 1, wherein:

the lower wall plate includes a length of 16.0 inches, a width of 6.0 inches, a depth of 5/16 inches;

the lower base plate includes a side length of 7½ inches, a width of 6.0 inches, and a depth of 5/16 inch;

the lower non-rotative dowel includes a length of 15½ inches and a lower non-rotative dowel diameter of 1.0 inch and is positioned at the first distance of 3% inches from the peripheral flat surface of the front face of the lower wall plate to the peripheral circumferential surface of the lower non-rotative dowel;

wherein the upper wall plate includes a length of 8.0 inches, a width of 6.0 inches, a depth of 5/16 inches, the upper base plate includes a side length of 7½ inches, and a width of 6.0 inches, and a depth of 5/16 inch;

wherein the upper non-rotative dowel includes an upper non-rotative dowel length of 7.50 inches, an upper non-rotative dowel diameter of 1.0 inch wherein the upper non-rotative dowel proximal end is positioned at the second distance of 3% inches from the peripheral flat front face surface of the upper wall plate to the peripheral circumferential surface of the upper non-rotative dowel;

wherein each of the six lower unthreaded anchor holes includes an inner diameter of ¼ inch and the depth of 5/16 inch; and wherein each of the any one of the at least two removable fasteners includes a ¼ inch×1.0 inch lag screw.

8. A water-resistive barrier wrap dispenser apparatus adapted to use with a selected roll of a water-resistive barrier wrap of one or more rolls of the water-resistive barrier wrap used to install on an exterior wall of one or more exterior walls of a residential building or a commercial building, the exterior wall having a longitudinal axis, the selected roll of the water-resistive barrier wrap having a given length, and a hollow cylindrical core limited by a top open end, a bottom open end, and a cylindrical core diameter, the water-resistive barrier wrap dispenser apparatus, comprising:

a water-resistive barrier wrap dispenser;

at least two removable fasteners;

a bag to contain the at least two removable fasteners;

a driver operably configured to actuate the at least two removable fasteners;

the water-resistive barrier wrap dispenser, comprising:

a set of two independent barrier wrap brackets including a lower barrier wrap bracket operatively associated with an upper barrier wrap bracket, the lower barrier wrap bracket including a lower wall plate having a first elongated rectangular plane conjoined to a lower base plate at a right angle having a first horizontal plane such that the lower barrier wrap bracket is configured in a L-shape, the lower base plate including a first threaded annular anchor hole sculpted therethrough a central portion of a top surface of the lower base plate, and the upper barrier wrap bracket including an upper wall plate having a second elongated rectangular plane conjoined to an upper base plate at a right angle having a second horizontal plane such that the upper barrier wrap bracket is configured in an inverted L-shape, the upper base plate including a second threaded annular anchor hole sculpted therethrough a central portion of a bottom surface of the upper base plate;

a multiplicity of threaded dowels including a first set of lower threaded dowels and a second set of upper threaded dowels wherein each of the lower threaded dowels and the upper threaded dowels includes an outer diameter which is less than the cylindrical core diameter of the selected roll of water-resistive barrier wrap of the one or more rolls of the water-resistive barrier wrap;

wherein each of the lower threaded dowels of the first set of lower unthreaded dowels and each of the upper threaded dowels of the second set of upper unthreaded dowels includes a proximal end and a distal end, wherein each of the proximal ends of the lower threaded dowels and each of the proximal ends of the upper threaded dowels includes a circumferential threaded flange adapted to rotationally threadably engage with the first threaded annular anchor hole of the lower base plate and/or to rotationally threadably engage with the second threaded annular anchor hole of the upper base plate such that each of the lower threaded dowels and each of the upper threaded dowels are interchangeable with each other whereby each of the lower threaded dowels and the upper threaded dowels can be firmly threadably connected to the first threaded annular anchor hole of the lower base plate and/or to the second threaded annular anchor hole of the upper base plate;

wherein a peripheral circumferential rim of the first threaded annular anchor hole is spaced a first predetermined distance from a peripheral flat surface of a front face of the lower wall plate, the predetermined distance being at least greater than a radius of the selected roll of the water-resistive barrier wrap, and a peripheral circumferential rim of the second threaded annular anchor hole is spaced a second predetermined distance from a peripheral flat surface of a front face of the upper wall plate, the second predetermined distance being equal to the first predetermined distance;

wherein the lower wall plate includes a lower wall plate length, a lower wall plate width, a lower wall plate depth, a lower wall plate medial axis, and the upper wall plate includes an upper wall plate length, an upper wall plate width, an upper wall plate depth, an upper wall plate medial axis, wherein the upper wall plate length is less than the lower wall plate length, the upper wall plate width and the upper wall plate depth is equal to the lower wall plate width and the lower wall plate depth, respectively;

wherein each of the lower threaded dowels of the first set of lower threaded dowels includes a lower threaded dowel length which is less than the lower wall plate length and less than the given length of the selected roll of water-resistive barrier wrap, and each of the upper threaded dowels of the second set of upper threaded dowels includes an upper threaded dowel length which is less than the upper wall plate length and less than the lower threaded dowel length;

a first 1.0 inch measuring notch etched on a first peripheral surface of a right side face of the lower wall plate measured vertically upward from a right inferior edge of the lower wall plate, a first 2.0 inch measuring notch etched on a second peripheral surface of the right side face of the lower wall plate measured vertically upward from the right inferior edge of the lower wall plate, a first 6.0 inch measuring notch etched on a third peripheral surface of the right side face of the lower wall plate measured vertically upward from the right inferior edge of the lower wall plate;

a second 1.0 inch measuring notch etched on a first peripheral surface of a left side face of the lower wall plate measured vertically upward from a left inferior edge of the lower wall plate, a second 2.0 inch measuring notch etched on a second peripheral surface of the left side face of the lower wall plate measured vertically upward from the left inferior edge of the lower wall plate, and a second 6.0 inch measuring notch etched on a second peripheral surface of the left side face of the lower wall plate measured vertically upward from the left inferior edge of the lower wall plate;

a first number of lower unthreaded anchor holes integrally formed therethrough the lower wall plate disposed in a first series of one or more lower rows aligned in widthwise rows along the lower wall plate length whereby one or more pairs of a right lower unthreaded anchor hole and a left lower unthreaded anchor hole are disposed symmetrically parallel to each other spaced equidistant from the lower wall plate medial axis;

wherein each of the first number of the lower unthreaded anchor holes includes an inner diameter and a depth, the depth equal to the lower wall plate depth, configured to receive any one of the at least two removable fasteners to selectively attach, detach, and reattach the lower wall plate to a first exterior wall area of the exterior wall and wherein the lower house wrap bracket is attached to the first exterior wall area the at least two removable fasteners in cooperation with the lower wall plate is operable to uphold the lower house wrap bracket stationary on the first exterior wall area wherein a selected lower threaded dowel selected from the first set of the lower threaded dowels is firmly threadably connected to the first threaded annular anchor hole of the lower base plate in a vertically upright orientation;

a second number of upper unthreaded anchor holes integrally formed therethrough the upper wall plate disposed in a second series of one or more upper rows aligned in widthwise rows along the upper wall plate length whereby a pair of one or more pairs of a right upper unthreaded anchor hole and a left upper unthreaded anchor hole are disposed symmetrically parallel to each other spaced equidistant from the upper wall plate medial axis;

wherein each of the first number of the upper unthreaded anchor holes includes an inner diameter and a depth, the depth equal to the upper wall plate depth, configured to receive any one of the at least two removable fasteners to selectively attach, detach, and reattach the upper wall plate to a second exterior wall area of the exterior wall wherein the upper house wrap bracket is attached to the second exterior wall area the at least two removable fasteners in cooperation with the upper wall plate is operable to uphold the upper house wrap bracket stationary on the second exterior wall area wherein a selected upper threaded dowel selected from the set of the upper threaded dowels is firmly threadably connected to the second threaded annular anchor hole of the upper base plate in a vertically downward orientation such that the selected lower threaded dowel is coaxial with the selected upper threaded dowel whereby the bottom open end of the selected roll of the water-resistive barrier wrap being received by the selected lower threaded dowel and the top open end of the selected roll of water-resistive barrier wrap being received by the selected upper threaded dowel such that the selected lower threaded dowel and the selected upper threaded dowel conjointly support the roll of water-resistive barrier wrap in an upright orientation for rotation of the selected roll of the water-resistive barrier wrap relative to the selected lower threaded dowel and the selected upper threaded dowel whereby the selected roll of water-resistive barrier wrap can unroll in a horizontal direction relative to the exterior wall of the residential building or the commercial building.

9. The water-resistive barrier wrap dispenser apparatus, according to claim 8, wherein the multiplicity of threaded dowels includes diameters consisting of the group of 1.0 inch diameter, 2.0 inch diameter, and 3.0 inch diameter.

10. The water-resistive barrier wrap dispenser apparatus, according to claim 8, wherein the multiplicity of threaded dowels include diameters in the range of 1.0 inch to 3.5 inches.

11. The water-resistive barrier wrap dispenser apparatus, according to claim 8, wherein the at least two removable fasteners include any one of a group of removable fasteners consisting of screws, full bearing screws, washer faced, double chamfered, square screws, knurled head, and lag screws.

12. The water-resistive barrier wrap dispenser apparatus, according to claim 8, wherein the water-resistive barrier wrap dispenser and the multiplicity of threaded dowels, are manufactured with materials selected from the group of materials consisting of metal, steel, and aluminum.

13. The water-resistive barrier wrap dispenser apparatus, according to claim 8, wherein the water-resistive barrier wrap dispenser, the multiplicity of threaded dowels are manufactured with materials selected from the group of materials consisting of polymer resins, and plastic.

14. The water-resistive barrier wrap dispenser apparatus, according to claim 8, wherein the multiplicity of threaded dowels can be sized to receive any one of a variety of rolls of water-resistive barrier wrap and or a variety of rolls of house wrap having a variety of cylindrical core diameters, lengths and surface areas.

15. The water-resistive barrier wrap dispenser apparatus, according to claim 8, wherein the lower wall plate and the upper wall plate, can be sized to support a variety of lengths and diameters of the threaded dowels.

16. The water-resistive barrier wrap dispenser apparatus, according to claim 8, wherein each of the circumferential threaded flange of the first set of lower threaded dowels and the second set of upper threaded dowels includes a % inch circumferential threaded flange, and each of the first threaded annular anchor hole of the lower base plate, and the second threaded annular anchor hole of the upper base plate includes a % inch threaded annular anchor hole.

17. A house wrap dispenser apparatus kit, comprising:

a house wrap dispenser apparatus;

a bag;

at least two removable fasteners;

a driver;

a house wrap dispenser apparatus instruction sheet; and a house wrap dispenser apparatus carrying case for transporting and storing the house wrap dispenser apparatus;

the house wrap dispenser apparatus, for use by a single user, adapted to use with a roll of a house wrap of one or more rolls of the house wrap used to install on an exterior wall of one or more exterior walls of a stable structure, the exterior wall having a longitudinal axis, the roll of the house wrap having a given length, and a hollow cylindrical core limited by a top open end, a bottom open end, and a cylindrical core diameter, the house wrap dispenser apparatus, comprising:

a house wrap dispenser, comprising:

a set of two independent house wrap brackets including a lower house wrap bracket operatively associated with an upper house wrap bracket, the lower house wrap bracket including a lower wall plate, a lower base plate, and a lower non-rotative dowel, the upper house wrap bracket including an upper wall plate, an upper base plate, and an upper non-rotative dowel, wherein the lower house wrap bracket is removably attached to a first exterior wall area of the exterior wall and the upper house wrap bracket is removably attached to a second exterior wall area of the exterior wall of the stable structure such that the lower non-rotative dowel of the lower house wrap bracket is oriented facing the upper non-rotative dowel of the upper house wrap bracket whereby a lower wall plate medial axis is aligned with an upper wall plate medial axis, having the upper house wrap bracket spaced above from the lower house wrap bracket a distance greater than the given length of the roll of the house wrap whereby the bottom open end of the roll of house wrap being received by the lower non-rotative dowel and the top open end of the roll of house wrap being received by the upper non-rotative dowel such that the lower non-rotative dowel and the upper non-rotative dowel conjointly support the roll of house wrap in an upright orientation for rotation of the roll of the house wrap relative to the lower non-rotative dowel and the upper non-rotative dowel whereby the roll of house wrap can unroll in a horizontal direction relative to the exterior wall of the stable structure;

wherein the lower wall plate includes a first elongated rectangular plane having a lower wall plate length, a lower wall plate width, and a lower wall plate depth;

a first 1.0 inch measuring notch etched on a first peripheral surface of a right side face of the lower wall plate measured vertically upward from a right inferior edge of the lower wall plate, a first 2.0 inch measuring notch etched on a second peripheral surface of the right side face of the lower wall plate measured vertically upward from the right inferior edge of the lower wall plate, a first 6.0 inch measuring notch etched on a third peripheral surface of the right side face of the lower wall plate measured vertically upward from the right inferior edge of the lower wall plate;

a second 1.0 inch measuring notch etched on a first peripheral surface of a left side face of the lower wall plate measured vertically upward from a left inferior edge of the lower wall plate, a second 2.0 inch measuring notch etched on a second peripheral surface of the left side face of the lower wall plate measured vertically upward from the left inferior edge of the lower wall plate, and a second 6.0 inch measuring notch etched on a second peripheral surface of the left side face of the lower wall plate measured vertically upward from the left inferior edge of the lower wall plate;

a first number of lower unthreaded anchor holes integrally formed therethrough the lower wall plate disposed in a first series of one or more lower rows aligned in widthwise rows along the lower wall plate length whereby one or more pairs of a right lower unthreaded anchor hole and a left lower unthreaded anchor hole are disposed symmetrically parallel to each other spaced equidistant from the lower wall plate medial axis;

wherein each of the first number of the lower unthreaded anchor holes includes an inner diameter and a depth, the depth equal to the lower wall plate depth, configured to receive any one of the at least two removable fasteners to selectively attach, detach, and reattach the lower wall plate to one or more exterior wall areas of the exterior wall of the stable structure wherein each of the any one of the at least two removable fasteners is compliant with each of the first number of the lower unthreaded anchor holes whereby each of the at least two removable fasteners includes an anchor head having an anchor head diameter greater than the inner diameter of each of the first number of the lower unthreaded anchor holes and an anchor body connected to and extending longitudinally from the anchor head to a sharply tapered distal end of the anchor body, the anchor body having an anchor body diameter less than the inner diameter of each of the first number of the lower unthreaded anchor holes, and a body length greater than the depth of each of the first number of the lower unthreadable anchor holes such that the anchor body is inset into the first exterior wall area a wall distance being operable to uphold the lower house wrap bracket stationary on the first exterior wall area of the exterior wall of the stable structure;

wherein the lower base plate is cojoined to the lower wall plate at a right angle along a frontal inferior marginal edge of the lower wall plate and a transversal interior edge of the lower base plate, the lower base plate having a first horizontal plane with a geometric shape to support the lower non-rotative dowel;

wherein the lower non-rotative dowel having a lower non-rotative dowel proximal end and a lower non-rotative dowel distal end, a lower non-rotative dowel diameter which is less than the cylindrical core diameter of the roll of house wrap of the one or more rolls of house wrap, a lower non-rotative dowel length which is less than the given length of the roll of house wrap, less than the length of the lower wall plate, and greater than an upper non-rotative dowel length;

wherein the lower non-rotative dowel proximal end is integrally affixed to a central portion of a top face of the lower base plate whereby the lower non-rotative dowel is affixed in a vertically upright orientation, wherein a peripheral circumferential surface of the lower non-rotative dowel is spaced a predetermined distance from a peripheral flat surface of a front face of the lower wall plate, the predetermined distance being at least greater than a radius of the roll of the house wrap;

wherein the upper wall plate includes a second upper elongated rectangular plane having an upper wall plate length which is less than the lower wall plate length, an upper wall plate width and an upper wall plate depth, the upper wall plate width and the upper wall plate depth equal to the lower wall plate width and lower wall plate depth, respectively;

a second number of upper unthreaded anchor holes integrally formed therethrough the upper wall plate disposed in a second series of one or more upper rows aligned in widthwise rows along the upper wall plate length whereby a pair of one or more pairs of a right upper unthreaded anchor hole and a left upper unthreaded anchor hole are disposed symmetrically parallel to each other spaced equidistant from the upper wall plate medial axis;

wherein each of the second number of upper unthreaded anchor holes includes an inner diameter and a depth equal to the inner diameter and the depth of each of the first number of the lower unthreaded anchor holes configured to receive any one of the at least two removable fasteners to selectively attach, detach, and reattach the upper wall plate to one or more exterior wall areas of the exterior wall of the stable structure wherein each of the any one of the at least two removable fasteners is compliant with each of the second number of upper unthreaded anchor holes whereby each of the at least two removable fasteners includes the anchor head having the anchor head diameter greater than the inner diameter of the upper unthreaded anchor hole and the anchor body connected to and extending longitudinally from the anchor head to a sharply tapered distal end of the anchor body, the anchor body having the anchor body diameter less than the inner diameter of the upper unthreaded anchor hole, and the anchor body length greater than the depth of the upper unthreadable anchor hole such that the anchor body is inset into the second exterior wall area the wall distance being operable to uphold the upper house wrap bracket stationary on the exterior wall of the stable structure;

the upper base plate is conjoined to the upper wall plate at a right angle along a frontal superior marginal edge of the upper wall plate and a transversal marginal edge of the upper base plate, the upper base plate having a horizontal plane in a geometric shape to support the upper non-rotative dowel;

wherein the upper non-rotative dowel includes an upper non-rotative dowel proximal end, an upper non-rotative dowel distal end, an upper non-rotative dowel diameter which is equal to the lower non-rotative dowel diameter being less than the cylindrical core diameter of the hollow cylindrical core of the roll of the house wrap, an upper non-rotative dowel length which is less than the length of the roll of house wrap, less than the length of the upper wall plate, and less than the length of the lower non-rotative dowel length; and wherein the upper non-rotative dowel proximal end is integrally affixed to a central portion of a bottom face of the upper base plate such that the upper non-rotative dowel is affixed in a vertically downward orientation at a second predetermined distance measured from a front face of the upper wall plate to a peripheral circumferential surface of the upper non-rotative dowel, the second predetermined distance is equal to the first predetermined distance being at least greater than a radius of the roll of the house wrap whereby the upper non-rotative dowel is aligned coaxial with the lower non rotative dowel;

the bag, comprising:

a flexible pouch sized to enclose and contain the at least two removable fasteners;

the flexible pouch having one or more fastenable openings sized to allow each of the at least two removable fasteners to pass through the one or more fastenable openings;

one or more fasteners of the one or more fastenable openings of the flexible pouch of the bag adapted to close the one or more fastenable openings;

an adjustable strap;

one or more wrist bands attached to one or more exterior surfaces of the bag, each of the one or more wrist bands formed stretchable for placing a wrist band of the one or more wrist bands around the single user's wrist, wherein each of the one or more wrist bands having a magnetic member disposed on a peripheral surface of the wrist band operable to temporarily hold thereon one or more of the at least two removable fasteners; and a brand logo disposed on one or more exterior surfaces of the bag;

the driver, comprising:

a driver head and a driver body, the driver head operatively configured with a magnetic portion disposed therein a peripheral surface of the driver head, the magnetic portion being magnetically attracted to the at least two removable fasteners;

the house wrap dispenser apparatus instruction sheet for the single user, comprising:

a method of use;

diagrams and figures of drawings of the house wrap dispenser apparatus, in use, by a single user when installing the roll of house wrap on the exterior wall of the stable structure;

a warranty; and a help line phone number;

the house wrap dispenser apparatus carrying case for transporting and storing the house wrap dispenser apparatus, the bag containing the at least two removable fasteners, the driver, the house wrap dispenser apparatus instruction sheet for the single user, the house wrap dispenser apparatus carrying case, comprising:

a main body having an elongated box shape, the main body including a bottom interior storage portion;

a lid member with an elongated box shape sized to correspond to the elongated box shape of the main body, the lid member having a top interior storage portion;

a rear edge of the lid member hingedly connected by at least one shaft to a rear edge of the main body at corresponding portions of a first peripheral rear surface of the lid member and a second peripheral rear surface of the main body whereby the lid member and the main body are operable for movement between a closed position and an open position;

an outer surface of the lid member having a brand logo placed thereon facing outward when the bottom interior storage portion of the main body is closed by the lid member;

a locking mechanism having two latches including a right latch and a left latch, wherein the main body is provided with a right latch body portion and a left latch body portion positioned on a right peripheral surface of the main body and at a left peripheral surface of the main body, respectively, configured to be engageable with a right latch lid portion and a left latch lid portion positioned on a corresponding right peripheral surface and a left peripheral surface of the lid member, respectively, and wherein when being engaged the lid member is locked in a position that the open bottom interior storage portion of the main body is closed by the lid member;

a first handle, having a first opening, affixed to a peripheral front surface of the lid member centered between the right latch lid portion and the left latch lid portion, and a second handle, having a second opening, affixed to a peripheral front surface of the main body centered between the right latch body portion and the left latch body portion;

a strap having two ends, a first end and a second end and a length therebetween, the strap fixedly fastened to the first handle and the second handle whereby the strap is deployable between the first opening of the first handle and therethrough the second opening of the second handle to fixedly secure the first handle and the second handle contiguous to each other during transportation and storage, wherein the first end includes an incipient magnetic element having a first polarity and the second end includes a terminal magnetic element having a second polarity opposite to the first polarity whereby the first end of the strap is attracted to the second end of the strap;

wherein the bottom interior storage portion of the main body includes a bottom interior recessed stage fabricated with a number of bottom sunken seated areas, and the top interior storage portion of the lid member includes a top interior recessed stage fabricated with a number of top sunken seated areas;

a first bottom sunken seated area having a first L-shape integrally sculpted and sized to receive and urge a peripheral right side edge of the lower house wrap bracket into the first bottom sunken seated area, and a corresponding first top sunken seated area having a second L-shape integrally sculpted and sized in a mirror image of the first L-shape of the first bottom sunken seated area to receive and urge a peripheral left side edge of the lower house wrap bracket into the first top sunken seated area wherein when the main body is closed by the lid member;

a second bottom sunken seated area having a first inverted L-shape integrally sculpted and sized to receive and urge a peripheral right side edge of the upper house bracket into the second bottom sunken seated area, and a corresponding second top sunken seated area having a second inverted L-shape integrally sculpted and sized in a mirror image of the first inverted L-shape of the second bottom sunken seated area to receive and urge a peripheral left side edge of the upper house wrap bracket into the second top sunken seated area wherein when the main body is closed by the lid member whereby the lower house wrap bracket and the upper house wrap bracket are removably seated within the house wrap dispenser apparatus carrying case having the lower non-rotative dowel congruent with the upper non-rotative dowel wherein when the main body is closed by the lid member;

a third bottom sunken seated area having an elongated rectangular shape integrally sculpted and sized to urge the driver therein, the third bottom sunken seated area having a floor and side walls layered with a first magnetic membrane whereby the magnetic portion of the driver head is magnetically attracted to the magnetic membrane;

a fourth bottom sunken seated area is configured in a geometric shape integrally sculpted and sized to urge the bag having the at least two removable fasteners contained therein, the fourth bottom sunken seated area having a geometric floor and geometric side walls, wherein the geometric floor is layered with a second magnetic membrane such that the bag is orientated in an upright position and whereby the at least two removable fasteners are pulled by the second magnetic membrane to a bottom interior region of the bag; and an expandable pocket fabricated on an interior side edge of the main body, the expandable pocket including a top opening having an elasticized top rim to provide access to an interior cavity, a front face surface having a transparent window, the interior cavity including a volume capable of maintaining the house wrap dispenser apparatus instruction sheet therein.

18. The house wrap dispenser apparatus kit, according to claim 17, wherein the lower non-rotative dowel diameter, the lower non-rotative dowel length, the upper non-rotative dowel diameter and the upper non-rotative dowel length, can be sized to receive any one of a variety of rolls of house wrap having a variety of cylindrical core diameters and lengths.

19. The house wrap dispenser apparatus kit, according to claim 17, wherein the first number of lower unthreaded anchor holes is greater than or equal to the second number of upper unthreaded anchor holes.

20. The house wrap dispenser apparatus kit, according to claim 17, wherein the lid member and the main body are made with a substrate selected from the group consisting of molded polymer resin and plastic.

21. The house wrap dispenser apparatus kit, according to claim 17, wherein the lid member and the main body comprise a hard wood.

22. The house wrap dispenser apparatus kit, according to claim 17, wherein the lid member and the main body are made with a substrate selected from the group of substrates consisting of metal, steel and aluminum.

23. The house wrap dispenser apparatus kit, according to claim 17, wherein the lower wall plate and the upper wall plate, can be sized to support a variety of lengths and diameters of dowels.

24. The house wrap dispenser apparatus kit, according to claim 17, wherein the at least two removable fasteners includes a number of removable fasteners that is greater in number than the number of unthreaded anchor holes.

25. The house wrap dispenser apparatus kit, according to claim 17, wherein the one or more fasteners of the one or more fastenable openings of the flexible pouch of the bag are selected from the group consisting of zippers, magnetic closure, hook and loop, snaps.

26. The house wrap dispenser apparatus kit, according claim 17, wherein the number of bottom sunken seated areas and the number of top sunken seated areas can be sized to receive and contain a variety of sizes of the lower house wrap bracket, the upper house wrap bracket, the bag, and the dowel.

27. A water-resistive barrier wrap dispenser apparatus kit, comprising:

a water-resistive barrier wrap dispenser apparatus;

a bag;

at least two removable fasteners;

a driver;

a water-resistive barrier wrap dispenser apparatus instruction sheet; and a water-resistive barrier wrap dispenser apparatus carrying case for transporting and storing the house wrap dispenser apparatus;

the water-resistive barrier wrap dispenser apparatus adapted to use with a selected roll of a water-resistive barrier wrap of one or more rolls of the water-resistive barrier wrap used to install on an exterior wall of one or more exterior walls of a residential building or a commercial building, the exterior wall having a longitudinal axis, the roll of the water-resistive barrier wrap having a given length, and a hollow cylindrical core limited by a top open end, a bottom open end, and a cylindrical core diameter, the water-resistive barrier wrap dispenser apparatus, comprising:

a water-resistive barrier wrap dispenser, comprising:

a set of two independent barrier wrap brackets including a lower barrier wrap bracket operatively associated with an upper barrier wrap bracket, the lower barrier wrap bracket including a lower wall plate having a first elongated rectangular plane conjoined at a right angle to a lower base plate having a first horizontal plane such that the lower barrier wrap bracket is configured in a L-shape, the lower base plate including a first threaded annular anchor hole sculpted therethrough a central portion of a top surface of the lower base plate, and the upper barrier wrap bracket including an upper wall plate having a second elongated rectangular plane conjoined to an upper base plate at a right angle having a second horizontal plane such that the upper barrier wrap bracket is configured in an inverted L-shape, the upper base plate including a second threaded annular anchor hole sculpted therethrough a central portion of a bottom surface of the upper base plate;

a multiplicity of threaded dowels including a first set of lower threaded dowels and a second set of upper threaded dowels wherein each lower threaded dowel of the set of the lower threaded dowels and each of the upper threaded dowels of the second set of the upper threaded dowels includes an outer diameter which is less than the cylindrical core diameter of the selected roll of water-resistive barrier wrap of the one or more rolls of the water-resistive barrier wrap;

wherein each of the lower threaded dowels and each of the upper threaded dowels includes a proximal end and a distal end, wherein each of the proximal ends of the lower threaded dowels and each of the proximal ends of the upper threaded dowels includes a circumferential threaded flange adapted to rotationally threadably engage with the first threaded annular anchor hole of the lower base plate and/or to rotationally threadably engage with the second threaded annular anchor hole of the upper base plate such that each of the lower threaded dowels and each of the upper threaded dowels are interchangeable with each other whereby each of the lower threaded dowels and each of the upper threaded dowels can be firmly threadably connected to the first threaded annular anchor hole of the lower base plate and/or to the second threaded annular anchor hole of the upper base plate;

wherein a peripheral circumferential rim of the first threaded annular anchor hole is spaced a first predetermined distance from a peripheral flat surface of a front face of the lower wall plate, the predetermined distance being at least greater than a radius of the selected roll of the water-resistive barrier wrap, and a peripheral circumferential rim of the second threaded annular anchor hole is spaced a second predetermined distance from a peripheral flat surface of a front face of the upper wall plate, the second predetermined distance being equal to the first predetermined distance;

wherein the lower wall plate includes a lower wall plate length, a lower wall plate width, a lower wall plate depth, a lower wall plate medial axis, and the upper wall plate includes an upper wall plate length, an upper wall plate width, an upper wall plate depth, an upper wall plate medial axis, wherein the upper wall plate length is less than the lower wall plate length, the upper wall plate width and the upper wall plate depth is equal to the lower wall plate width and the lower wall plate depth, respectively;

wherein each of the lower threaded dowels includes a lower threaded dowel length which is less than the lower wall plate length and less than the given length of the selected roll of water-resistive barrier wrap, and each of the upper threaded dowels includes an upper threaded dowel length which is less than the upper wall plate length and less than the lower threaded dowel length;

a first 1.0 inch measuring notch etched on a first peripheral surface of a right side face of the lower wall plate measured vertically upward from a right inferior edge of the lower wall plate, a first 2.0 inch measuring notch etched on a second peripheral surface of the right side face of the lower wall plate measured vertically upward from the right inferior edge of the lower wall plate, a first 6.0 inch measuring notch etched on a third peripheral surface of the right side face of the lower wall plate measured vertically upward from the right inferior edge of the lower wall plate;

a second 1.0 inch measuring notch etched on a first peripheral surface of a left side face of the lower wall plate measured vertically upward from a left inferior edge of the lower wall plate, a second 2.0 inch measuring notch etched on a second peripheral surface of the left side face of the lower wall plate measured vertically upward from the left inferior edge of the lower wall plate, and a second 6.0 inch measuring notch etched on a second peripheral surface of the left side face of the lower wall plate measured vertically upward from the left inferior edge of the lower wall plate;

a first number of lower unthreaded anchor holes integrally formed therethrough the lower wall plate disposed in a first series of one or more lower rows aligned in widthwise rows along the lower wall plate length whereby one or more pairs of a right lower unthreaded anchor hole and a left lower unthreaded anchor hole are disposed symmetrically parallel to each other spaced equidistant from the lower wall plate medial axis;

wherein each of the first number of the lower unthreaded anchor holes includes an inner diameter and a depth, the depth equal to the lower wall plate depth, configured to receive any one of the at least two removable fasteners to selectively attach, detach, and reattach the lower wall plate to a first exterior wall area of the exterior wall and wherein the lower house wrap bracket is attached to the first exterior wall area the at least two removable fasteners in cooperation with the lower wall plate is operable to uphold the lower house wrap bracket stationary on the first exterior wall area wherein a selected lower threaded dowel from the set of the lower threaded dowels is firmly threadably connected to the first threaded annular anchor hole of the lower base plate in a vertically upright orientation;

a second number of upper unthreaded anchor holes integrally formed therethrough the upper wall plate disposed in a second series of one or more upper rows aligned in widthwise rows along the upper wall plate length whereby a pair of one or more pairs of a right upper unthreaded anchor hole and a left upper unthreaded anchor hole are disposed symmetrically parallel to each other spaced equidistant from the upper wall plate medial axis; and wherein each of the first number of the upper unthreaded anchor holes includes an inner diameter and a depth, the depth equal to the upper wall plate depth, configured to receive any one of the at least two removable fasteners to selectively attach, detach, and reattach the upper wall plate to a second exterior wall area of the exterior wall wherein the upper barrier wrap bracket is attached to the second exterior wall area the at least two removable fasteners in cooperation with the upper wall plate is operable to uphold the upper house wrap bracket stationary on the second exterior wall area wherein a selected upper threaded dowel from the set of the upper threaded dowels is firmly threadably connected to the second threaded annular anchor hole of the upper base plate in a vertically downward orientation such that the selected lower threaded dowel is coaxial with the selected upper threaded dowel whereby the bottom open end of the selected roll of the water-resistive barrier wrap being received by the lower threaded dowel and the top open end of the selected roll of water-resistive barrier wrap being received by the selected upper threaded dowel such that the selected lower threaded dowel and the selected upper threaded dowel conjointly support the selected roll of water-resistive barrier wrap in an upright orientation for rotation of the selected roll of the water-resistive barrier wrap relative to the selected lower threaded dowel and the selected upper threaded dowel whereby the selected roll of water-resistive barrier wrap can unroll in a horizontal direction relative to the exterior wall of the residential building or the commercial building;

the bag, comprising:

a flexible pouch sized to enclose and contain the at least two removable fasteners;

the flexible pouch having one or more fastenable openings sized to allow each of the at least two removable fasteners to pass through the one or more fastenable openings;

one or more fasteners adapted to close the one or more fastenable openings of the flexible pouch of the bag;

an adjustable strap;

one or more wrist bands attached to one or more exterior surfaces of the bag, each of the one or more wrist bands formed stretchable for placing a wrist band of the one or more wrist bands around the single user's wrist, wherein each of the one or more wrist bands having a magnetic member disposed on a peripheral surface of the wrist band operable to temporarily hold thereon one or more of the at least two removable fasteners; and a brand logo disposed on one or more exterior surfaces of the bag;

the driver, comprising:

a driver head and a driver body, the driver head operatively configured with a magnetic portion disposed therein a peripheral surface of the driver head, the magnetic portion being magnetically attracted to the at least two removable fasteners;

the water-resistive barrier wrap dispenser apparatus instruction sheet for the single user, comprising:

diagrams and figures of drawings of the method of use of the water-resistive barrier wrap dispenser apparatus by a single user when installing the selected roll of the water-resistive barrier wrap on the exterior wall of the residential building or commercial building;

a warranty; and a help line telephone number;

the water-resistive barrier wrap dispenser apparatus carrying case for transporting and storing the water-resistive barrier wrap dispenser apparatus, the bag containing the at least two removable fasteners, the driver, the water-resistive barrier wrap dispenser apparatus instruction sheet for the single user;

the water-resistive barrier wrap dispenser apparatus carrying case, comprising:

a main body having an elongated box shape, the main body including a bottom interior storage portion;

a lid member with an elongated box shape sized to correspond to the elongated box shape of the main body, the lid member having a top interior storage portion;

a rear edge of the lid member hingedly connected by at least one shaft to a rear edge of the main body at corresponding portions of a first peripheral rear surface of the lid member and a second peripheral rear surface of the main body whereby the lid member and the main body are operable for movement between a closed position and an open position;

an outer surface of the lid member having a brand logo placed thereon facing outward when the bottom interior storage portion of the main body is closed by the lid member;

a locking mechanism having two latches including a right latch and a left latch, wherein the main body is provided with a right latch body portion and a left latch body portion positioned on a right peripheral surface of the main body and at a left peripheral surface of the main body, respectively, configured to be engageable with a right latch lid portion and a left latch lid portion positioned on a corresponding right peripheral surface and a left peripheral surface of the lid member, respectively, and wherein when being engaged the lid member is locked in a position that the open bottom interior storage portion of the main body is closed by the lid member;

a first handle, having a first opening, affixed to a peripheral front surface of the lid member centered between the right latch lid portion and the left latch lid portion, and a second handle, having a second opening, affixed to a peripheral front surface of the main body centered between the right latch body portion and the left latch body portion;

a strap having two ends, a first end and a second end and a length therebetween, the strap fixedly attached to the first handle and the second handle whereby the strap is deployable between the first opening of the first handle and therethrough the second opening of the second handle to fixedly secure the first handle and the second handle contiguous to each other during transportation and storage, wherein the first end includes an incipient magnetic element having a first polarity and the second end includes a terminal magnetic element having a second polarity opposite to the first polarity whereby the first end of the strap is attracted to the second end of the strap;

wherein the bottom interior storage portion of the main body includes a bottom interior recessed stage fabricated with a number of bottom sunken seated areas, and the top interior storage portion of the lid member includes a top interior recessed stage fabricated with a number of top sunken seated areas;

a first bottom sunken seated area having a first L-shape integrally sculpted and sized to receive and urge a peripheral right side edge of the lower barrier wrap bracket into the first bottom sunken seated area, and a corresponding first top sunken seated area having a second L-shape integrally sculpted and sized in a mirror image of the first L-shape of the first bottom sunken seated area to receive and urge a peripheral left side edge of the lower barrier wrap bracket into the first top sunken seated area wherein when the main body is closed by the lid member;

a second bottom sunken seated area having a first inverted L-shape integrally sculpted and sized to receive and urge a peripheral right side edge of the upper house bracket into the second bottom sunken seated area, and a corresponding second top sunken seated area having a second inverted L-shape integrally sculpted and sized in a mirror image of the first inverted L-shape of the second bottom sunken seated area to receive and urge a peripheral left side edge of the upper barrier wrap bracket into the second top sunken seated area wherein when the main body is closed by the lid member whereby the lower barrier wrap bracket and the upper barrier wrap bracket are removably seated within the water-resistive barrier wrap dispenser apparatus carrying case having the lower barrier wrap bracket congruent with the upper barrier wrap bracket wherein when the main body is closed by the lid member;

a third bottom sunken seated area having a first semi-cylindrical shape integrally sculpted and sized to receive and urge a first circumferential surface of a first lower threaded dowel into the third bottom sunken seated area, and a corresponding third top sunken seated area having a second semi-cylindrical shape integrally sculpted and sized in a mirror image of the first semi-cylindrical shape of the third bottom sunken seated area to receive and urge a second circumferential surface of the first lower threaded dowel into the third top sunken seated area whereby the first threaded dowel is removably seated within the water-resistive barrier wrap dispenser apparatus carrying case wherein when the main body is closed by the lid member;

a fourth bottom sunken seated area having a third semi-cylindrical shape integrally sculpted and sized to receive and urge a first circumferential surface of a second lower threaded dowel into the fourth bottom sunken seated area, and a corresponding fourth top sunken seated area having a fourth semi-cylindrical shape integrally sculpted and sized in a mirror image of the third semi-cylindrical shape of the fourth bottom sunken seated area to receive and urge a second circumferential surface of the second lower threaded dowel into the fourth top sunken seated area whereby the second lower threaded dowel is removably seated within the water-resistive barrier wrap dispenser apparatus carrying case wherein when the main body is closed by the lid member;

a fifth bottom sunken seated area having a fifth semi-cylindrical shape integrally sculpted and sized to receive and urge a first circumferential surface of a first upper threaded dowel into the fifth bottom sunken seated area, and a corresponding fifth top sunken seated area having a sixth semi-cylindrical shape integrally sculpted and sized in a mirror image of the fifth semi-cylindrical shape of the fifth bottom sunken seated area to receive and urge a second circumferential surface of the first upper threaded dowel into the fifth top sunk seated area whereby the first upper threaded dowel is removably seated within the water-resistive barrier wrap dispenser apparatus carrying case wherein when the main body is closed by the lid member;

a sixth bottom sunken seated area having a seventh semi-cylindrical shape integrally sculpted and sized to receive and urge a first circumferential surface of a second upper threaded dowel into the sixth bottom sunken seated area, and a corresponding sixth top sunken seated area having an eighth semi-cylindrical shape integrally sculpted and sized in a mirror image of the seventh semi-cylindrical shape of the sixth bottom sunk seated area to receive and urge a second circumferential surface of the second upper threaded dowel into the sixth top sunken seated area whereby the second upper threaded dowel is removably seated within the water-resistive barrier wrap dispenser apparatus carrying case wherein when the main body is closed by the lid member;

a seventh bottom sunken seated area having an elongated rectangular shape integrally sculpted and sized to urge the driver therein, the seventh bottom sunken seated area having a floor and side walls layered with a first magnetic membrane whereby the magnetic portion of the driver head is magnetically attracted to the magnetic membrane;

an eighth bottom sunken seated area is configured in a geometric shape integrally sculpted and sized to urge the bag having the at least two removable fasteners contained therein, the eighth bottom sunken seated area having a geometric floor and geometric side walls, wherein the geometric floor is layered with a second magnetic membrane such that the bag is orientated in an upright position and whereby the at least two removable fasteners contained therein are pulled by the second magnetic membrane to a bottom interior region of the bag; and an expandable pocket fabricated on an interior side edge of the main body, the expandable pocket including a top opening having an elasticized top rim to provide access to an interior cavity, a front face surface having a transparent window, the interior cavity including a volume capable of maintaining the water-resistive barrier wrap dispenser apparatus instruction sheet therein.

28. The water-resistive barrier wrap dispenser apparatus kit, according to claim 27, wherein the lower barrier wrap bracket and the upper barrier wrap bracket can be configured having the lower wall plate and the upper wall plate in a variety of sizes of lengths, widths, and depths, the lower base plate and the upper base plate can be configured having a variety of side lengths, widths, and depths, and the first threaded anchor hole and the second threaded anchor hole can be configured having a variety of sizes of diameters and threads.

29. The water-resistive barrier wrap dispenser apparatus kit, according to claim 27, wherein the bottom interior storage portion of the main body can be fabricated with a plurality number of bottom sunken seated areas and a plurality of top sunken seated areas sized and dimensioned to accommodate a variety of threaded dowel diameters, threaded diameters lengths, and circumferential threaded flanges.

30. The water-resistive barrier wrap dispenser apparatus kit, according to claim 27, wherein the lid member and the main body are made with a substrate selected from the group consisting of metal, steel, and aluminum.

31. The water-resistive barrier wrap dispenser apparatus kit, according to claim 27, wherein the lid member and the main body comprise a hard wood.

32. The water-resistive barrier wrap dispenser apparatus kit, according to claim 27, wherein the first set of lower threaded dowels and the second set of upper threaded dowels includes diameters selected from the group consisting of 1.0 inch, 2.0 inches, and 3.0 inches.

33. The water-resistive barrier wrap dispenser apparatus kit, according to claim 27, wherein the multiplicity of threaded dowels include a diameter in the range of 1.0 inch to 3.50 inches.

34. The water-resistive barrier wrap dispenser apparatus kit, according to claim 27, wherein the first set of lower threaded dowels, the second set of upper threaded dowels, can include a variety of threaded dowel diameters, threaded dowel lengths, sized and dimensioned to receive any one of a variety of rolls of water-resistive barrier wrap and or a variety of rolls of house wrap having a variety of cylindrical core diameters, lengths and surface areas.

35. The water-resistive barrier wrap dispenser apparatus kit, according to claim 27, wherein the lower barrier wrap bracket and the upper barrier wrap bracket, can be sized to support a variety of lengths and diameters of lower threaded dowels and upper threaded dowels.

36. The water-resistive barrier wrap dispenser apparatus kit, according to claim 27, wherein the at least two removable fasteners includes a number of removable fasteners that is greater in number than the number of unthreaded anchor holes.

37. The water-resistive barrier wrap dispenser apparatus kit, according to claim 27, wherein the one or more fasteners of the one or more fastenable openings of the flexible pouch of the bag are selected from the group consisting of zippers, magnetic closure, hook and loop, snaps.

38. The water-resistive barrier wrap dispenser apparatus kit, according to claim 27, wherein the main body of the water-resistive barrier wrap dispenser carrying case includes an expandable handle affixed by a fastening means to the first side wall of the main body and a set of two or more swivel caster wheels affixed by a second fastening means to the opposing second side wall of the main body.

* * * * *